US009730492B2

(12) United States Patent
Krengel

(10) Patent No.: US 9,730,492 B2
(45) Date of Patent: Aug. 15, 2017

(54) DUALLY ADJUSTABLE, ANCHORED, PARALLEL LACING TECHNOLOGY

(71) Applicant: Anna Krengel, New York, NY (US)

(72) Inventor: Anna Krengel, New York, NY (US)

( * ) Notice: Subject to any disclaimer, the term of this patent is extended or adjusted under 35 U.S.C. 154(b) by 0 days.

(21) Appl. No.: 15/299,555

(22) Filed: Oct. 21, 2016

(65) Prior Publication Data

US 2017/0055642 A1 Mar. 2, 2017

Related U.S. Application Data

(62) Division of application No. 14/918,702, filed on Oct. 21, 2015, now Pat. No. 9,526,300.
(Continued)

(51) Int. Cl.

| | |
|---|---|
| ***A43C 11/00*** | (2006.01) |
| ***A43C 7/00*** | (2006.01) |
| ***A43C 1/04*** | (2006.01) |
| ***A43C 5/00*** | (2006.01) |
| ***A43C 1/00*** | (2006.01) |
| ***A41F 1/00*** | (2006.01) |
| ***A41D 1/06*** | (2006.01) |
| ***A41F 1/04*** | (2006.01) |
| ***A43C 3/00*** | (2006.01) |

(52) U.S. Cl.
CPC ..... *A43C 11/008* (2013.01); *A41D 1/06* (2013.01); *A41F 1/00* (2013.01); *A41F 1/04* (2013.01); *A43C 1/00* (2013.01); *A43C 1/003* (2013.01); *A43C 1/04* (2013.01); *A43C 3/00* (2013.01); *A43C 5/00* (2013.01); *A43C 7/00* (2013.01); *A41D 2300/33* (2013.01)

(58) Field of Classification Search
CPC .... A43C 7/00; A43C 1/04; A43C 5/00; A43C 7/005; A43C 7/08; A43C 7/04; A43C 9/00; A41F 1/02; A41F 1/04
USPC ..... 36/50.1
See application file for complete search history.

(56) References Cited

U.S. PATENT DOCUMENTS 171,274 A * 12/1875 Edmister ..... A43C 7/00 24/335
216,857 A * 6/1879 Jones ..... A43C 5/00 24/714.9

(Continued)

OTHER PUBLICATIONS

Video on youtube.com enter LACE TECH video on vimeo.com enter LACE TECH.

*Primary Examiner* — Khoa Huynh
*Assistant Examiner* — Katharine Gracz

(57) ABSTRACT

A lacing system having multiple anchor types, i.e., interior anchors, end anchors, and dynamically adjustable anchors, that, in combination with parallel lacing technology, provide instant and reliable fastening for shoes, boots, and other articles of manufacture. The lace is threaded and anchored so that, a single arcuate pull on the movable fastener(s) causes the multiple lace segments to move through the eyelets of the shoe, and align in unison, so that the entire shoe opening contracts (or opens wide) simultaneously. The fastener(s) can be hook and loop, ratchet buckles, adjustable buckles, or cord locks. The laces are replaceable. The adjustable opening is customizable for different width feet providing "gross" adjustment. The fastener provides "fine" adjustment. Methods and diagrams are disclosed for threading, anchoring, and customizing the lacing, as well as for indicating that the lacing is correct.

12 Claims, 39 Drawing Sheets

Related U.S. Application Data

(60) Provisional application No. 62/177,512, filed on Mar. 16, 2015, provisional application No. 62/178,324, filed on Apr. 7, 2015, provisional application No. 62/230,572, filed on Jun. 9, 2015.

(56) References Cited

U.S. PATENT DOCUMENTS 268,794 A * 12/1882 Heilner ..... A41F 1/04 450/139
317,528 A * 5/1885 Forbes ..... A43C 7/00 24/712
578,066 A * 3/1897 Munsell ..... A43C 9/00 24/713
607,813 A * 7/1898 Whyman ..... A43C 9/00 24/129 B
645,308 A * 3/1900 Carman ..... A43C 5/00 24/715.1
1,088,067 A * 2/1914 Forbes ..... A43C 1/00 24/69 SK
1,094,262 A * 4/1914 Spangenberg ..... A43C 7/00 24/130
1,407,705 A * 2/1922 Munter ..... A41F 1/04 450/119
2,643,469 A * 6/1953 Herceg ..... A43C 1/00 36/50.1
3,009,221 A * 11/1961 Firari ..... A43C 11/22 24/68 SK
3,200,458 A * 8/1965 Marzocchi ..... A43C 11/008 24/71 SK
3,279,015 A * 10/1966 Henning ..... A43C 1/00 24/712.2
3,526,977 A * 9/1970 Partagas ..... A43B 3/30 36/50.1
3,683,520 A * 8/1972 Partagas ..... A43C 7/04 24/298
4,081,916 A * 4/1978 Salisbury ..... A43C 11/008 36/50.1
4,142,307 A * 3/1979 Martin ..... A43B 5/0447 24/68 SK
4,408,403 A * 10/1983 Martin ..... A43B 5/16 36/115
4,414,761 A * 11/1983 Mahood ..... A43C 1/00 24/712
4,670,949 A * 6/1987 Autry ..... A43C 1/04 24/713.4
5,016,327 A * 5/1991 Klausner ..... A43C 1/00 24/442
5,027,482 A * 7/1991 Torppey ..... A43C 11/1493 24/306
5,129,130 A * 7/1992 Lecouturier ..... A43C 7/00 24/712
5,345,697 A * 9/1994 Quellais ..... A43B 11/00 24/712
5,347,695 A * 9/1994 Lopez Saiz ..... A43C 1/00 24/713.9
5,353,483 A * 10/1994 Louviere ..... A43B 11/00 24/71 SK
5,537,763 A * 7/1996 Donnadieu ..... A43C 1/00 36/50.1
5,566,474 A * 10/1996 Leick ..... A43C 1/00 24/713.4
5,572,777 A * 11/1996 Shelton ..... A43C 1/00 24/68 SK
5,755,044 A * 5/1998 Veylupek ..... A43C 1/003 36/50.1
5,907,912 A * 6/1999 Alaimo ..... A43C 11/008 36/50.1
6,029,323 A * 2/2000 Dickie ..... A43C 1/003 24/712.1
6,327,750 B1 * 12/2001 Muldowney ..... A43C 1/00 24/68 SK
6,510,627 B1 * 1/2003 Liu ..... A43C 1/00 24/115 G
6,513,211 B1 * 2/2003 Fisher ..... A43C 1/00 24/712
6,671,980 B1 * 1/2004 Liu ..... A43B 11/00 24/712
6,941,683 B2 * 9/2005 Freed ..... A43C 1/003 24/712
7,596,838 B1 * 10/2009 Bulmer ..... A43C 7/00 24/130
7,908,769 B2 3/2011 Pellegrini
8,146,271 B2 * 4/2012 Friton ..... A43C 1/00 24/712.1
8,844,168 B2 * 9/2014 Toraya ..... A43C 1/00 24/712
2008/0066344 A1 * 3/2008 Kelley ..... A43C 11/1493 36/50.1
2008/0127511 A1 * 6/2008 Friton ..... A43C 1/00 36/50.1
2008/0216351 A1 * 9/2008 Carroll ..... A43C 1/06 36/50.1
2009/0038128 A1 * 2/2009 Cho ..... A43C 7/00 24/68 SK
2009/0100707 A1 * 4/2009 Bar ..... A43C 11/008 36/50.1
2011/0047822 A1 * 3/2011 Pape ..... A43B 1/0063 36/51
2012/0174437 A1 * 7/2012 Heard ..... A43C 1/04 36/50.1
2014/0157627 A1 6/2014 Smaldone
2014/0366340 A1 * 12/2014 Park ..... A43C 3/00 24/712.2
2015/0040430 A1 * 2/2015 Conrad ..... A43C 1/00 36/83
2016/0095390 A1 * 4/2016 Sanders ..... A43C 7/005 24/712.2

* cited by examiner

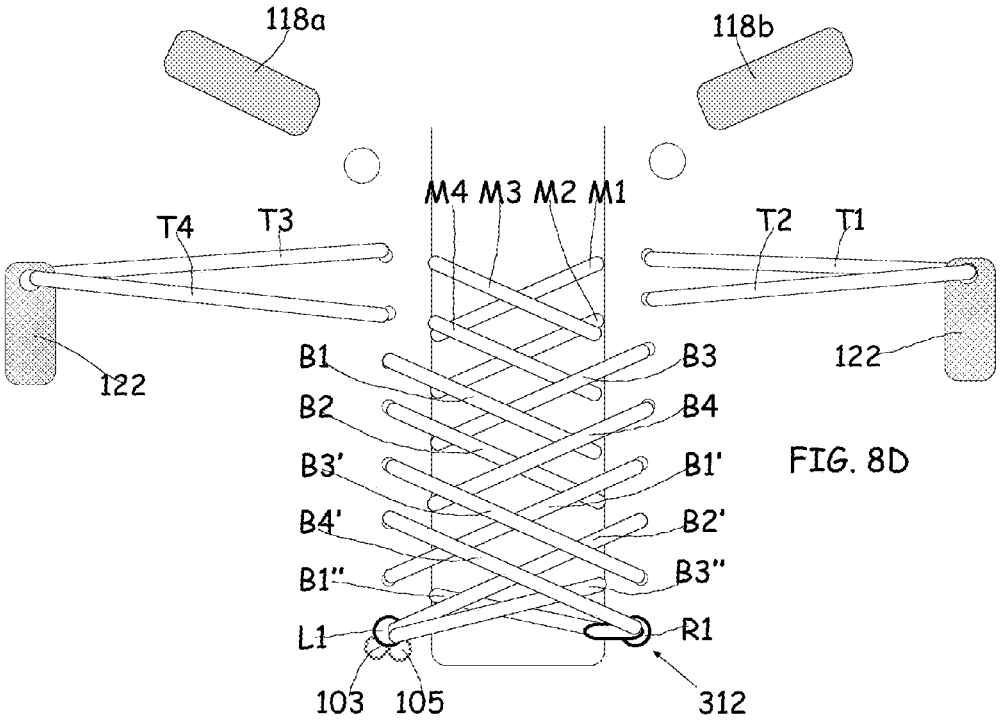
FIG. 8D
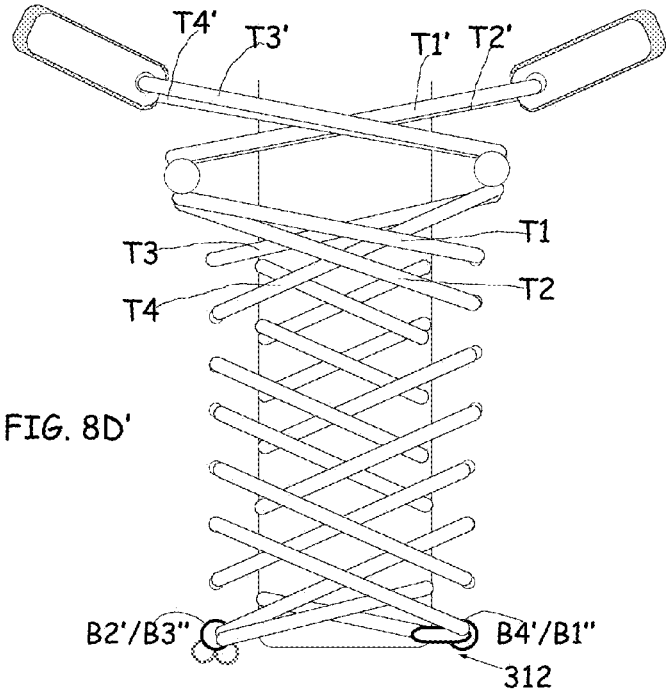
FIG. 8D'
FIG. 8D"
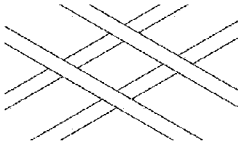
FIG. 8D'''
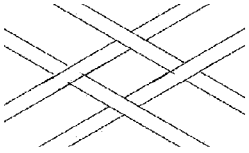

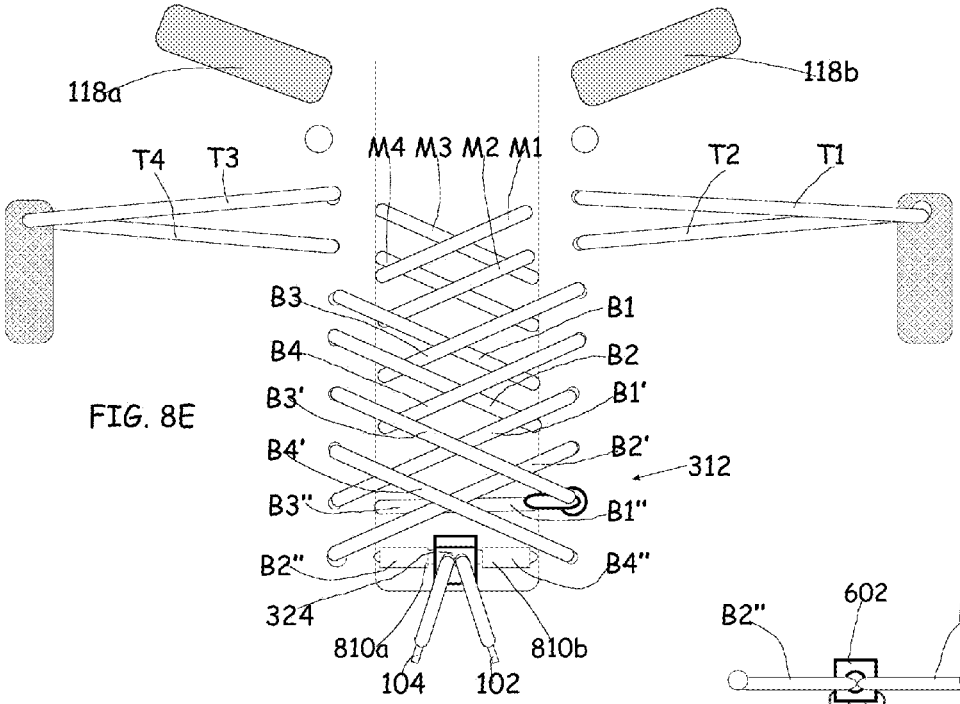
FIG. 8E
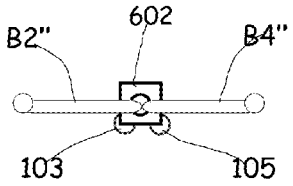
FIG. 8E'
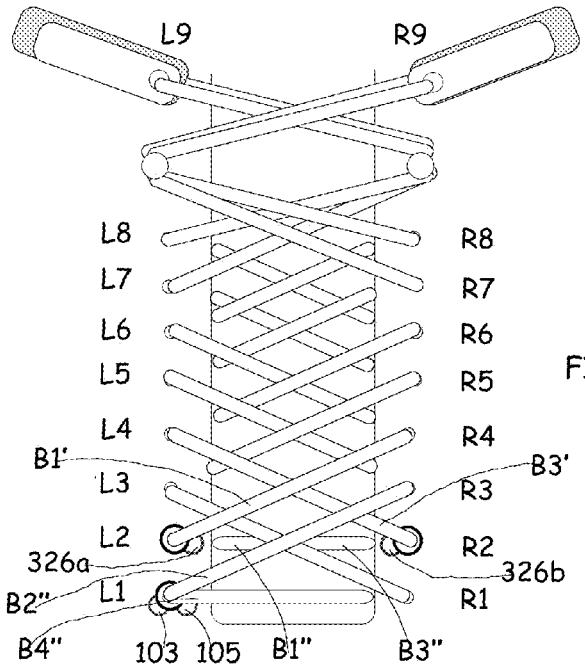
FIG. 8E"

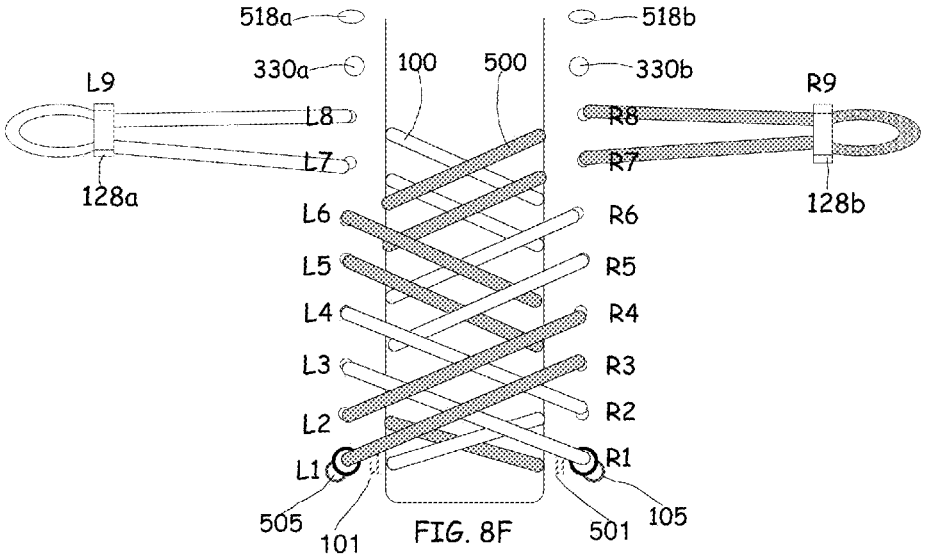
FIG. 8F
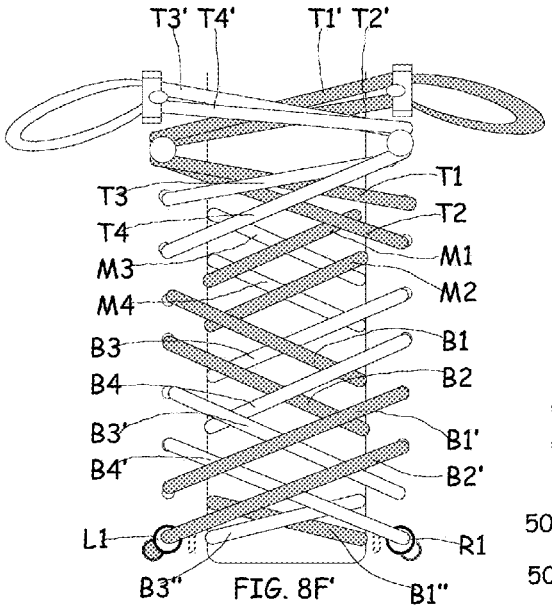
FIG. 8F'
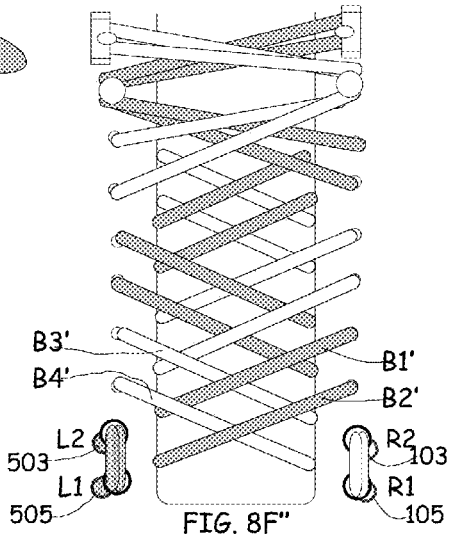
FIG. 8F"

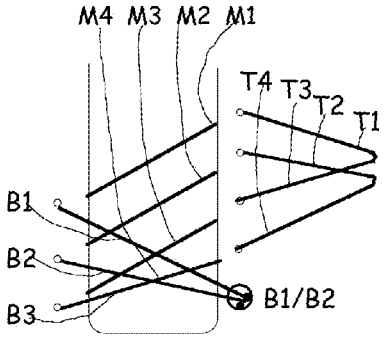
FIG. 25A1
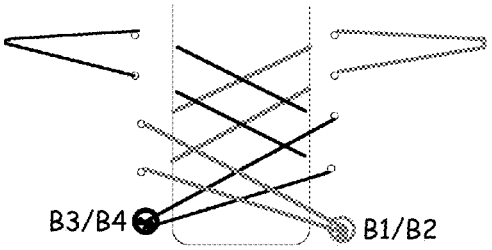
FIG.25B
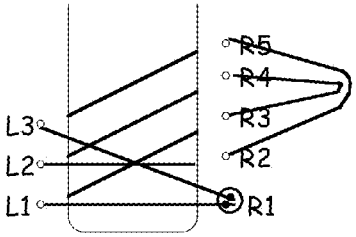
FIG. 25A2
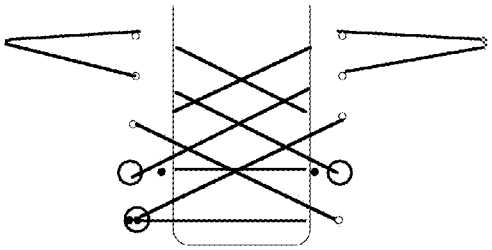
FIG.25B'
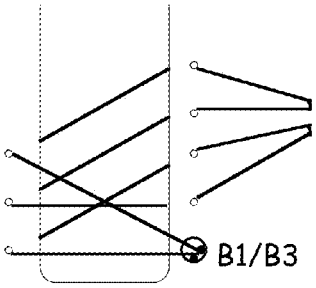
FIG.25A3

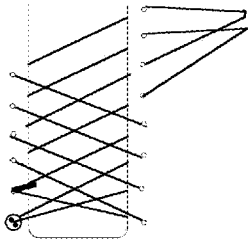
FIG.28A1
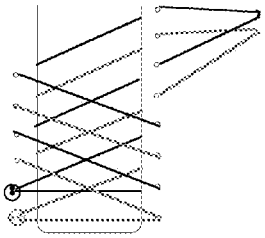
FIG.28A1'
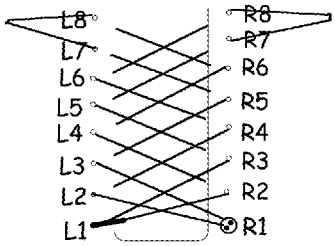
FIG.28B
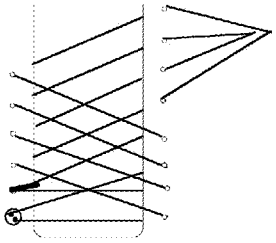
FIG.28A2
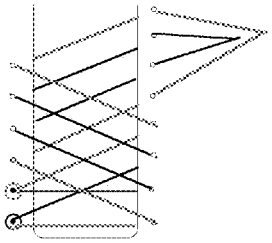
FIG.28A2'
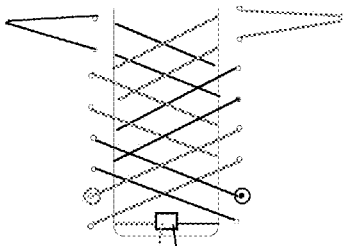
FIG.28B'
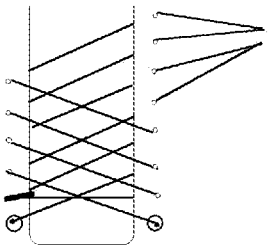
FIG.28A3
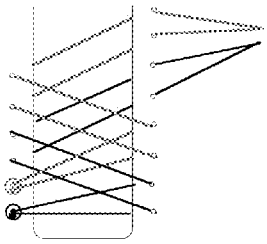
FIG.28A3'
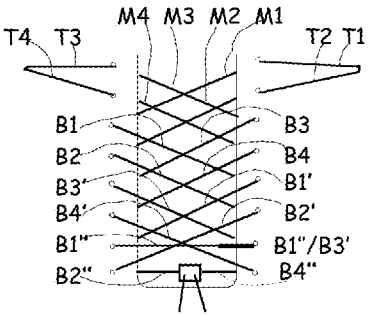
FIG.28B"

DUALLY ADJUSTABLE, ANCHORED, PARALLEL LACING TECHNOLOGY

CROSS-REFERENCES TO RELATED APPLICATIONS

This application is a division of application Ser. No. 14/918,702 filed Oct. 21, 2015, by the present inventor. This application claims the benefit of Provisional Patent Applications Ser. No. 62/177,512 filed Mar. 16, 2015, Ser. No. 62/178,324 filed Apr. 7, 2015, and Ser. No. 62/230,572 filed Jun. 9, 2015, all three (3) by the present inventor. This application is also related to my U.S. Pat. No. 6,941,683, granted Sep. 13, 2005.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of Invention

The present invention relates to the manner in which laces traverse the adjustable opening of shoes for fastening. More specifically this invention relates to the positioning, structure, and methods for lacing and adjusting the adjustable opening and anchoring the lace ends and the lace interior, relative the movable fastener(s) and the adjustable opening, in order to optimize performance, simplify installation, minimize cost, and provide other benefits discussed in this specification. More generally, this invention relates to a lacing system, which in addition to fastening shoes, can also be used to fasten other laced articles of manufacture such as orthopedic devices, and garments etc.

2. Description of the Related Art

U.S. Pat. No. 6,941,683, issued Sep. 13, 2005 shows lace ends attached either in the adjustable opening, FIGS. 5A-5C, or in the movable fastener, FIGS. 5D-5F. I have found that the attached or connected ends within the adjustable opening interfere with the smooth alignment of the laces. The connected ends tend to shift during use and butt up against the side with the eyelet that is closest to the pull from the movable fastener and/or get caught with other lace segments in the adjustable opening, thus impeding alignment, and also detracting from the lacing pattern. The connected ends may also require sewing loops into the lace, as shown in FIG. 5A, or additional parts such as an S-hook as shown in FIG. 5B or a C-hook as shown in FIG. 5A of U.S. Pat. No. 6,941,683. The attached ends may also require the manufacturing of special laces with hooks as shown in FIG. 5C. I have also found that the knotted ends in the retaining member 310 in the movable fastener, at the top of the opening, as shown in FIGS. 5E-5F constrict the adjustable opening from readily expanding and contracting, thus further impeding the alignment of the laces. Additionally, I have found that the two (2) movable fasteners in FIGS. 7A-7D tend to shift during use, changing their distance from the side of the shoe, resulting in misalignment of the two (2) movable fasteners relative the fixed fasteners, and therefore unable to fasten.

SUMMARY OF THE INVENTION

Accordingly it is an object of the present invention to provide for an anchored parallel lacing system that is easy to apply to the shoe, inexpensive, easy to manufacture, strong, durable, reliable, versatile, sleek, and quick and easy for the user to fasten.

It is also an object of the present invention to show and teach manufacturers and users a step by step method for threading and anchoring the adjustable opening having one (1) or two (2) movable fasteners, with varying number of eyelets, anchors, and laces. It is a further object of the present invention to provide the user with a method to help verify that the lace(s) have been threaded correctly.

It is also an object of the present invention to enable the manufacturer to easily fix or set the maximum width of the adjustable opening for different width feet, i.e., "gross adjustment", using adjustable anchors, and to provide a simple way for the user to change or customize that width for his own feet after purchasing, if necessary.

It is also an object of the present invention, that the shoes require only minimal and limited "fine" adjustment after customization, for quick and easy fastening and unfastening, each time the user wears his shoes, and that the user has a choice of discrete or continuous type fasteners, depending on his preference.

It is a further object of the present invention to provide the user with an after market lacing system, including methods and diagrams for the user to follow, to enable the user to install or replace the laces of the present invention on shoes or other articles of manufacture that he/she has already purchased.

It is a further object of the present invention to position the end anchors so that they do not obscure the sleek lacing design or pattern, and are not visible.

It is a further object of the present invention that the lace segments are layered and some segments in the opening lay entirely above other segments that they cross to minimize friction of the crossing segments and thus facilitate the alignment of the lace segments.

It is a further object of the present invention that the user or manufacturer have several means for anchoring the lace ends as well as anchoring the lace interior, and that these means be adjustable and be positioned so they do not interfere with the smooth alignment of the lace segments, for quick and easy adjustment.

It is a further object of the present invention to provide a means for the shoe to be dually adjustable. Adjustable by the movable fastener(s) and also near the toe, for a snug and even fit for the length of a long opening.

It is a further object of the present invention to give the user a choice of lacing patterns, designs, and fasteners, and provide the manufacturer with different lacing patterns, designs, and fasteners to sell.

It is also an object of the present invention to provide the user with different fastening choices for different sports having different requirements, such as speed for triathletes, and reliability for tennis and basketball etc.

It is a further object of the present invention to provide physically challenged people and young children with shoes they can quickly easily fasten and take off.

It is a further object of the present invention to provide a closure for orthopedic braces, clothes and other articles of manufacture.

It is a further object of the present invention to equalize the pressure during wear, by providing one or more anchors, which reduce the friction, thus equalizing the pressure of the lace segments in the adjustable opening during use.

It is a further object of the the present invention that the lace requires no additional parts to create end anchors and interior anchors.

It is a further object of the present invention that it require minimal, or no change to the shoe to install, and add minimal, or no cost to manufacture.

It is a further object of the present invention that it does not require specially manufactured laces.

It is a further object of the present invention to provide a means for the two (2) movable fasteners to maintain the maximum distance from the sides of the adjustable opening, set by the user or manufacturer.

It is a further object of the present invention to provide for an anchored lacing system that may also use two (2) laces, so the user can have two (2) colors in the adjustable opening, as well as provide independent snugness at the top and bottom of the adjustable opening, and also increase speed of adjustment.

It is a further object of the present invention to provide a method to facilitate the immediate expansion and contraction of a very long adjustable opening, such as knee high boots.

BRIEF DESCRIPTION OF THE DRAWINGS

The above and still further objects, features and advantages of the present invention will become apparent upon consideration of the following detailed description of the specific embodiments thereof, especially when taken in conjunction with the accompanying drawings:

FIG. 4A1 shows two (2) segment loops, with the inner segments crossing each other;

FIG. 4A1' shows the loops of FIG. 4A1 on a shoe, embodiment A pattern 1;

FIG. 4A2 shows two (2) segment loops, having one loop disposed inside the other loop;

FIG. 4A2' shows the loops of FIG. 4A2 on a shoe, embodiment A pattern 2;

FIG. 4A3 shows two (2) segment loops disposed side by side;

FIG. 4A3' shows the loops of FIG. 4A3 on a shoe, embodiment A pattern 3;

FIG. 4B' shows the segment loops of FIG. 4B, having one loop on the right side and the other loop on the left side of the adjustable opening, creating embodiment B, which has two (2) movable fasteners;

Figure 5A:
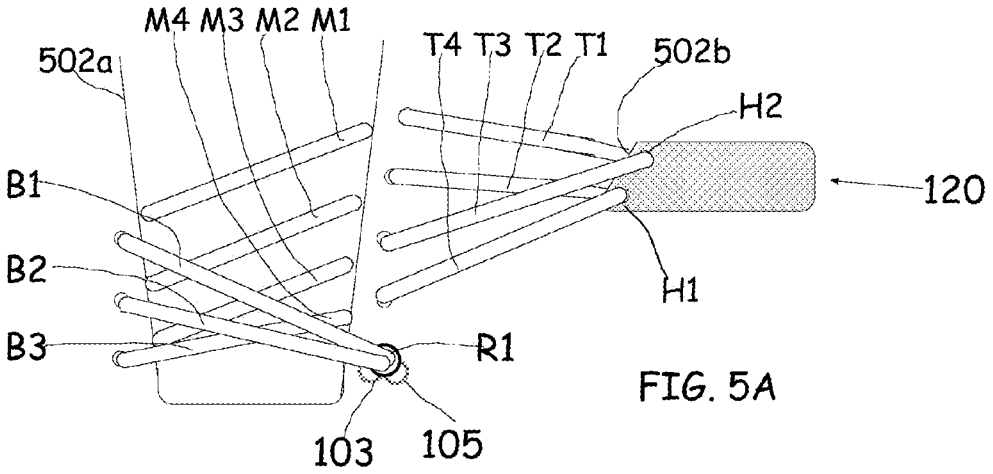
FIG. 5A is a front view the lacing of the adjustable opening of a sneaker, embodiment A1, having five (5) eyelets, in the unfastened position, and the darkened eyelet showing the position of the two (2) end anchors.
Figure 5B:
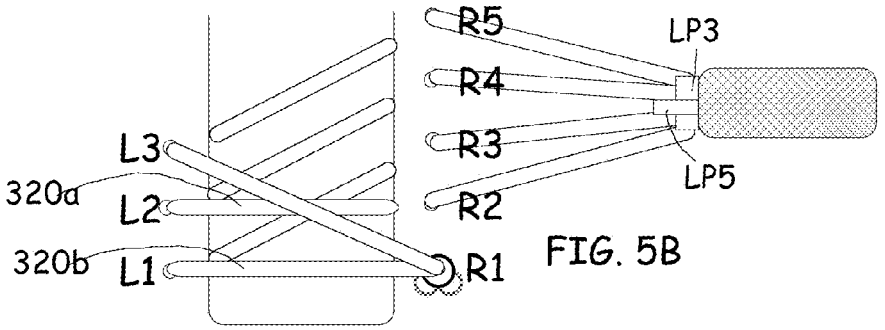
FIG. 5B is a front view of the lacing of the adjustable opening of the sneaker of embodiment A2, having five (5)
Figure 5C:
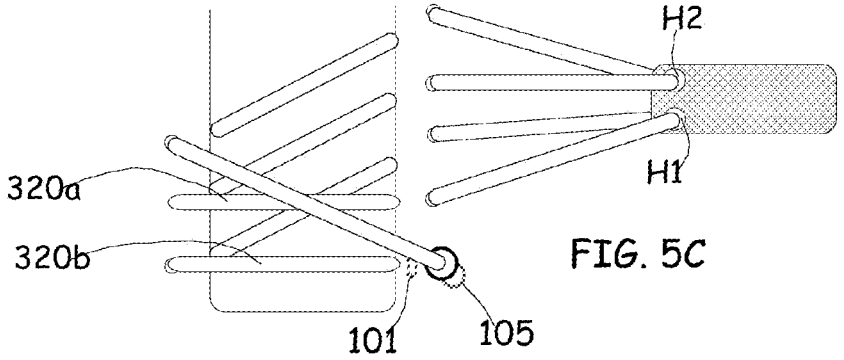
Figure 5D:
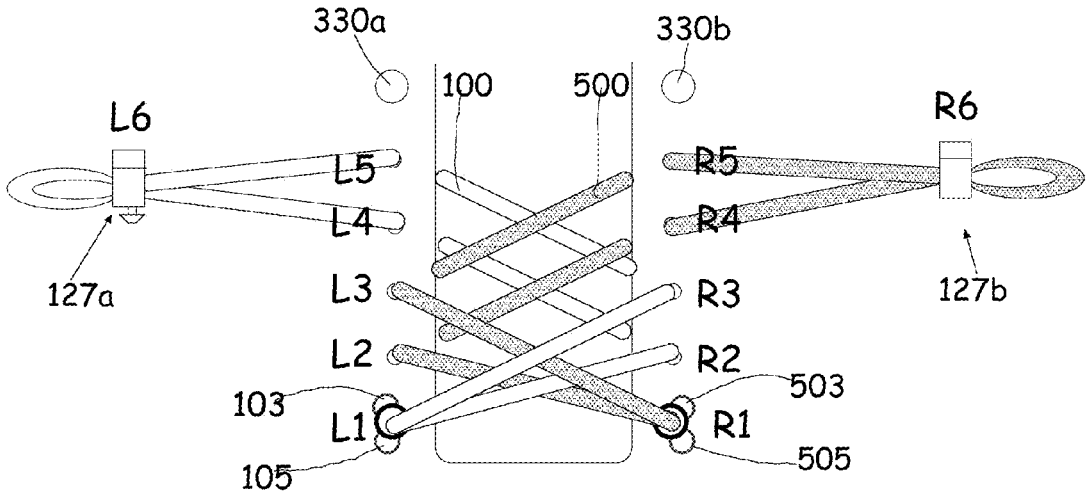
Figure 5E:
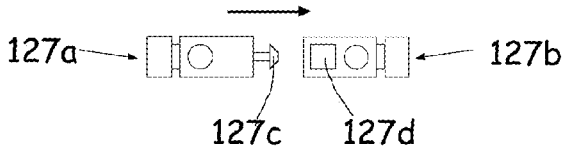
Figure 5F:
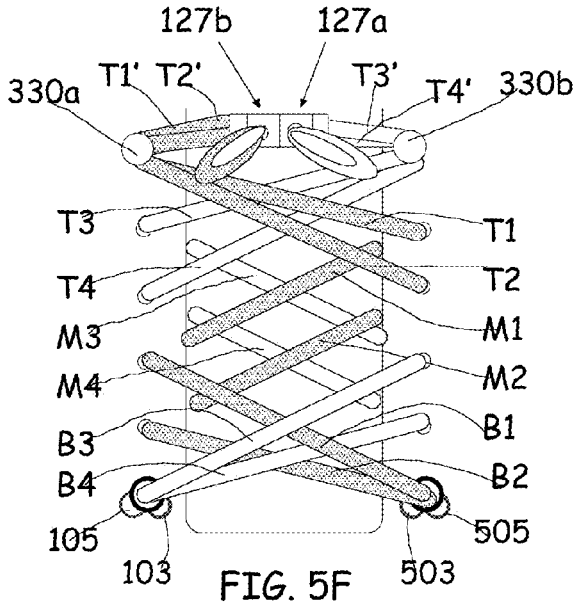
Figure 5G:
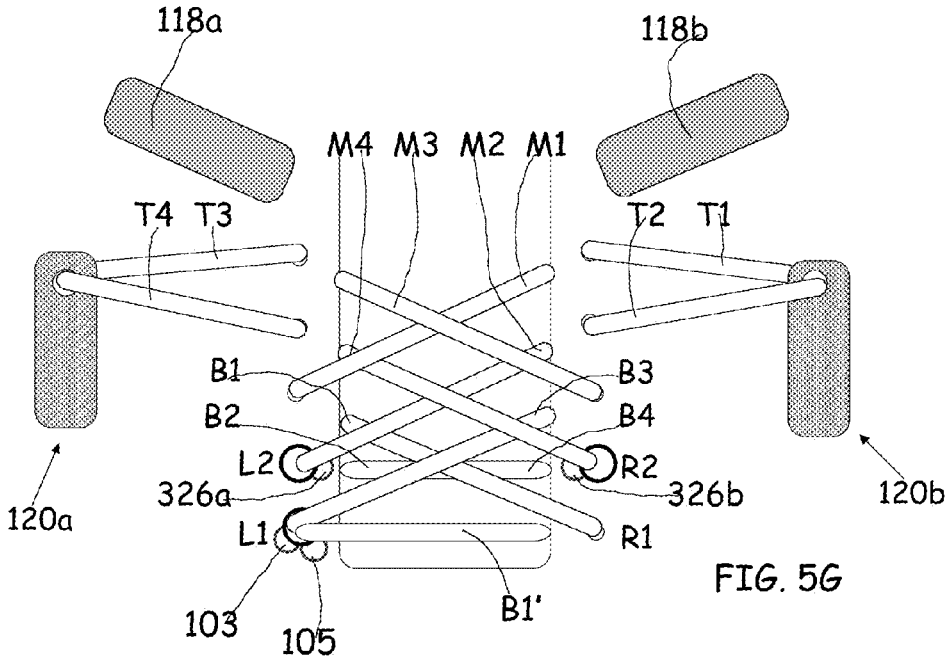
Figure 5H:
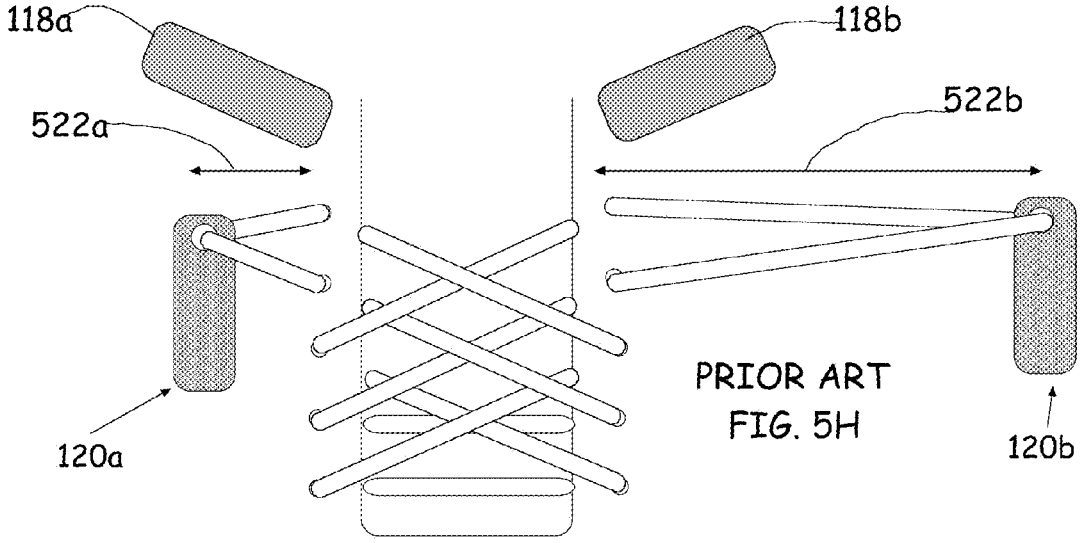
PRIOR ART FIG. 5H
Figure 6A:
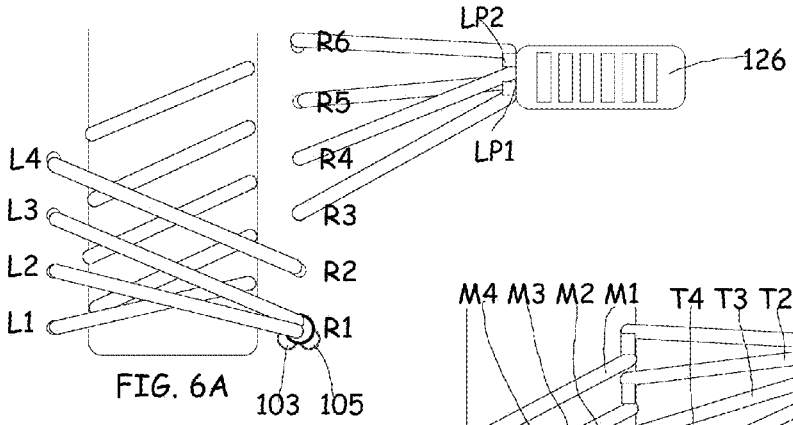
Figure 6B:
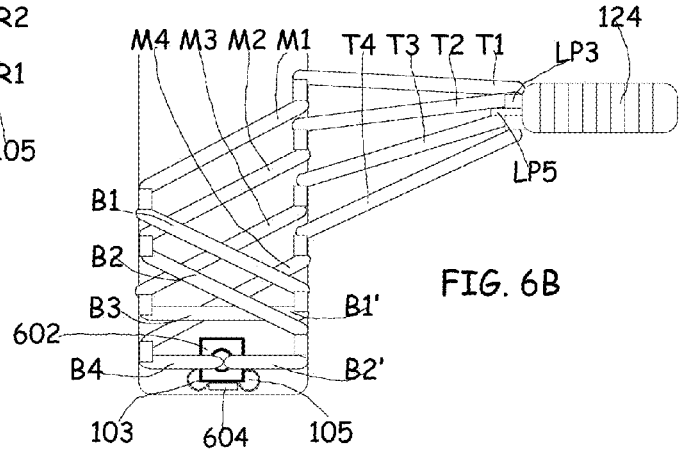
Figure 6C:
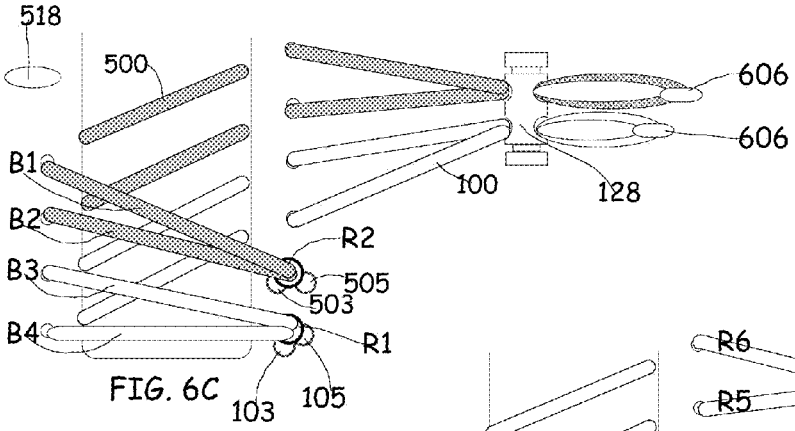
Figure 6D:
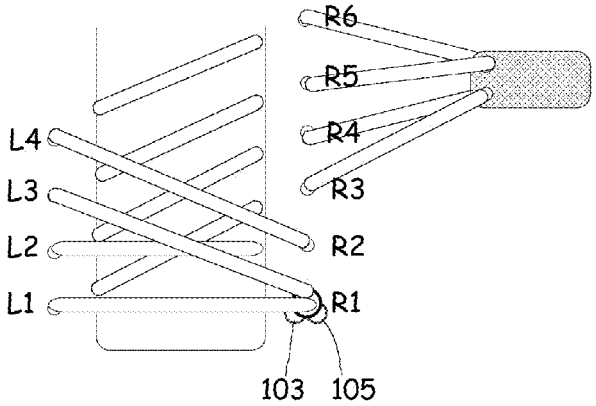
Figure 6E:
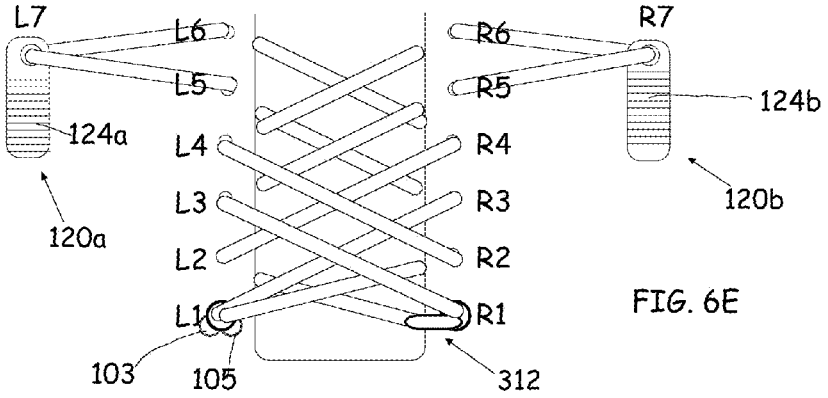
Figure 6F:
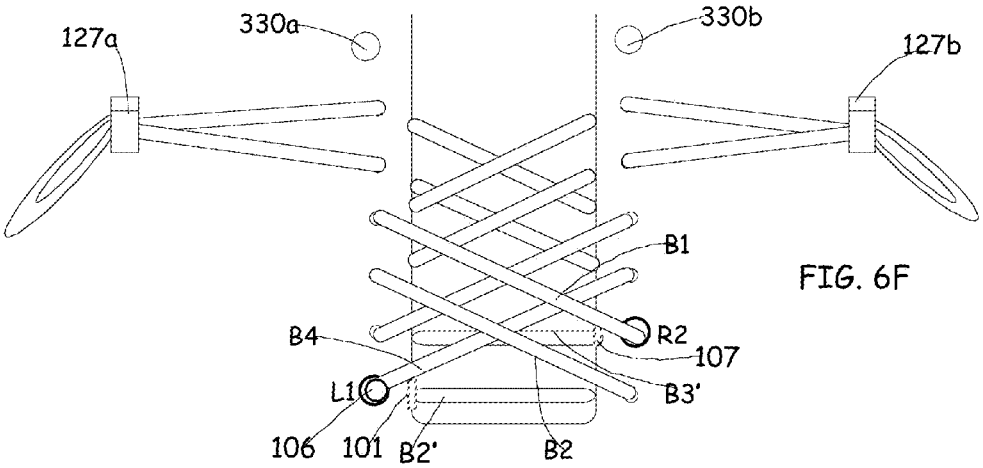
Figure 6G:
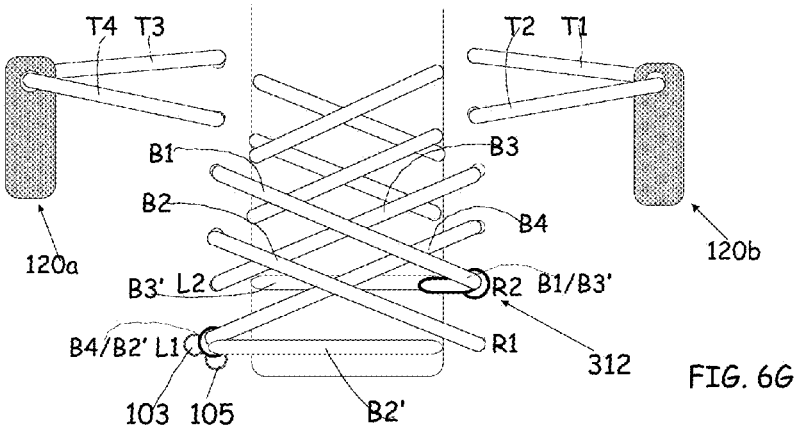
Figure 7A:
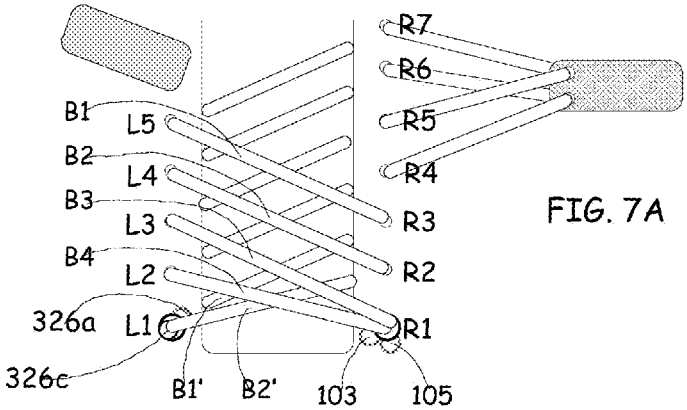
Figure 7B:
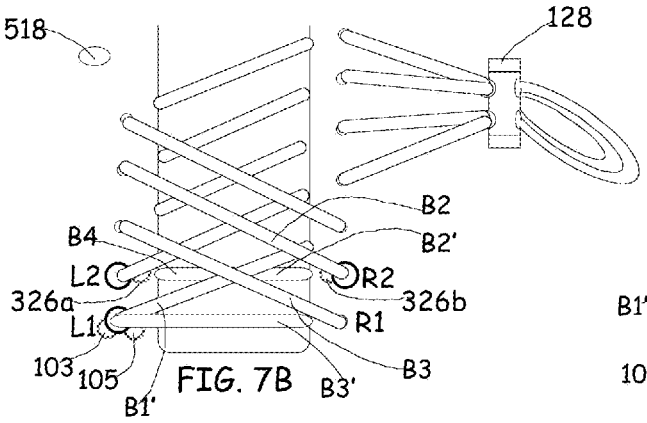
Figure 7B:
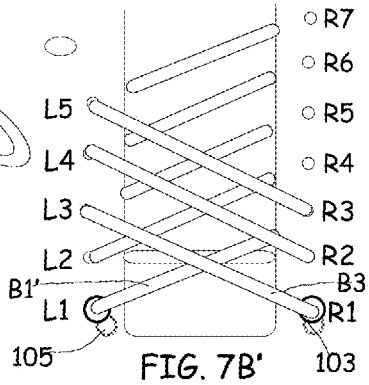
Figure 7C:
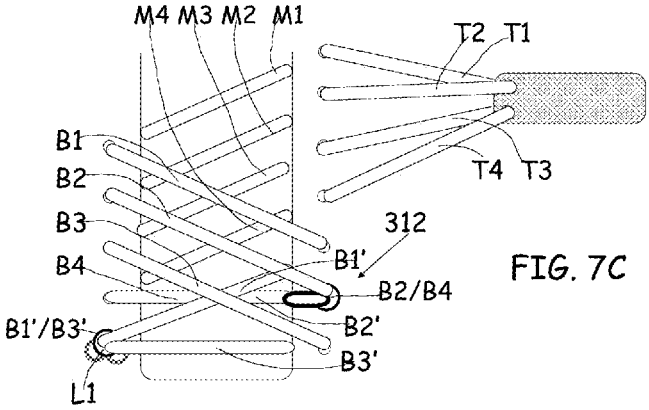
Figure 7D:
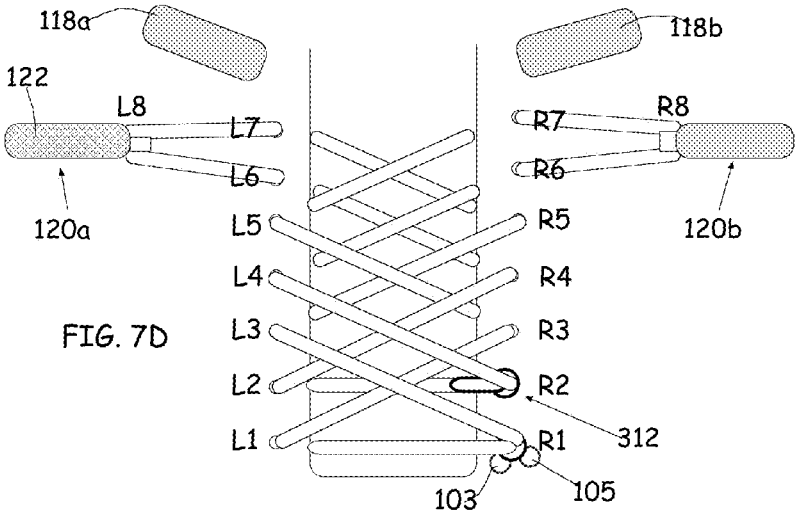
Figure 7E:
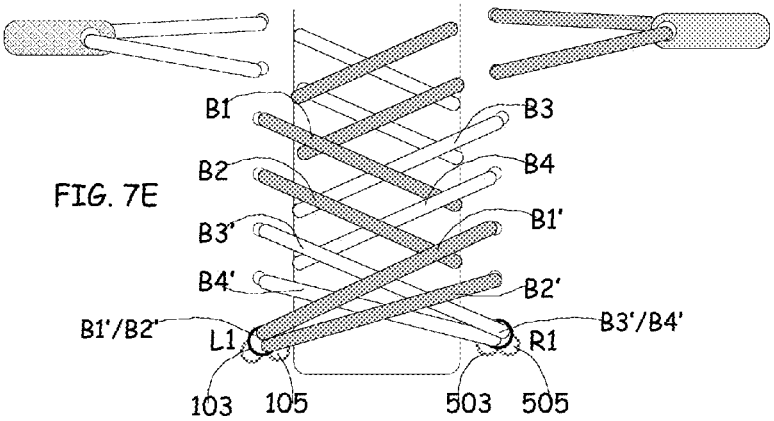
Figure 7F:
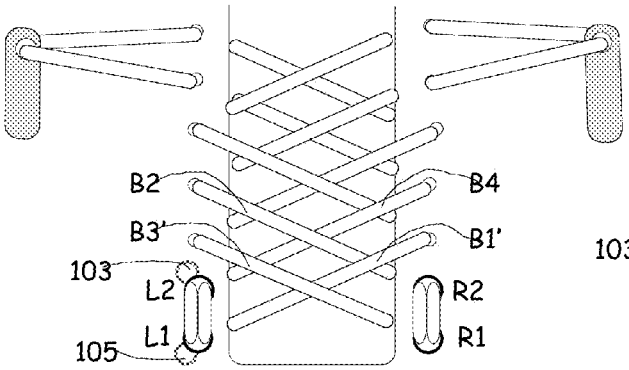
Figure 7F:
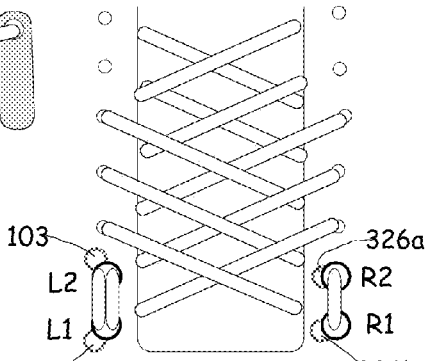
Figure 8A:
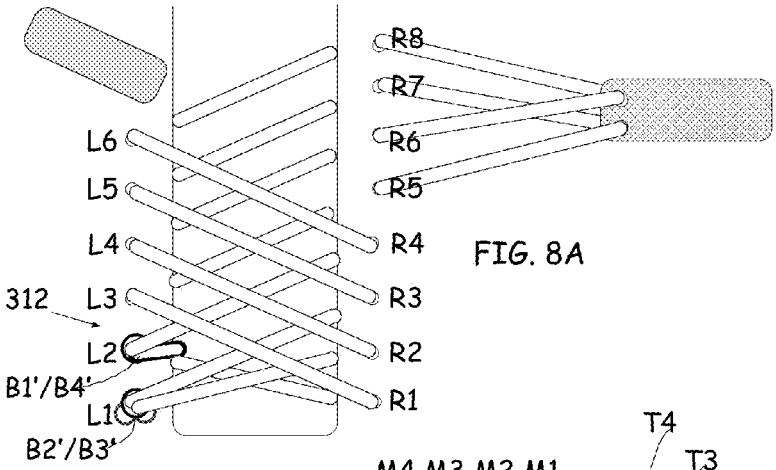
Figure 8B:
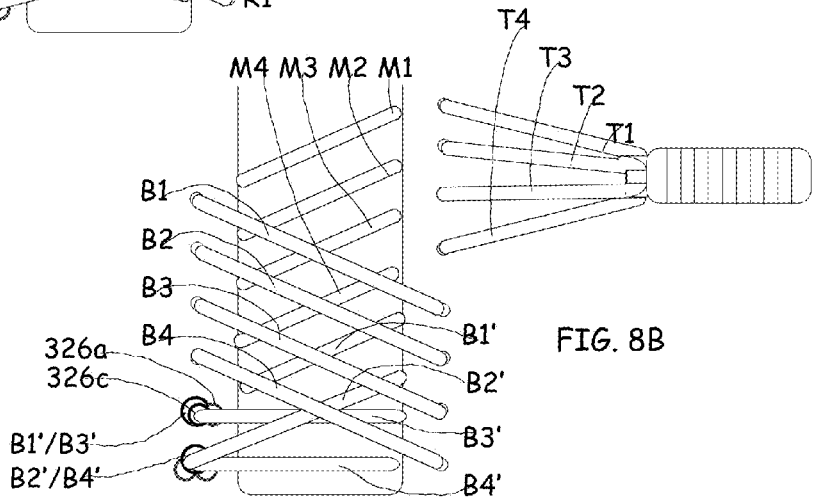
Figure 8C:
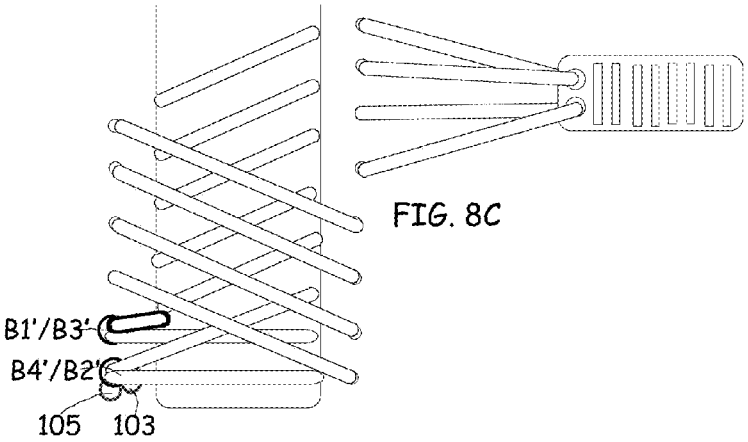
Figure 9A:
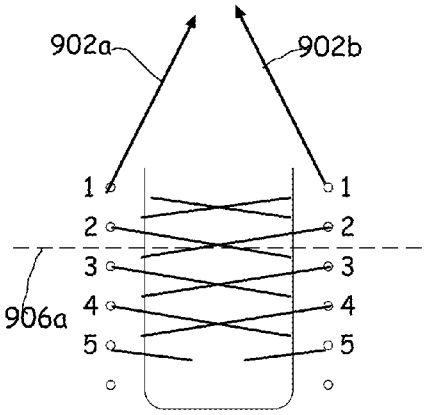
PRIOR ART FIG. 9A
Figure 9B:
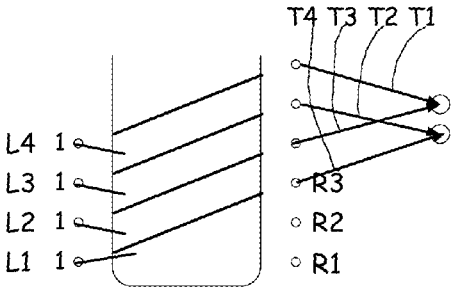
Figure 9C:
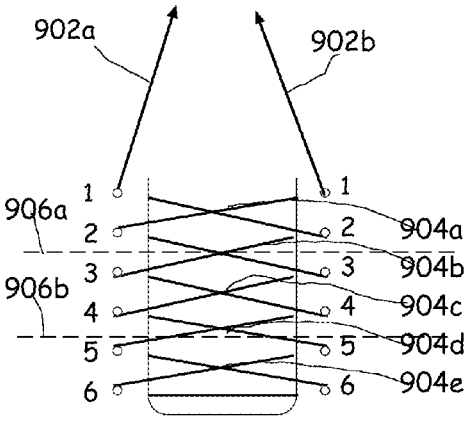
PRIOR ART FIG. 9C
Figure 9D:
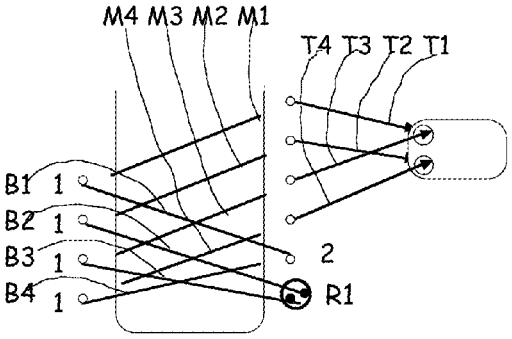
Figure 9E:
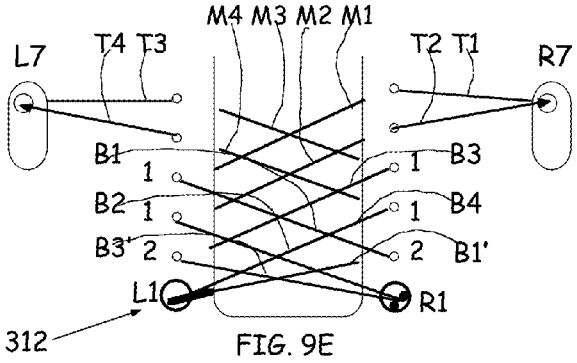
Figure 9F:
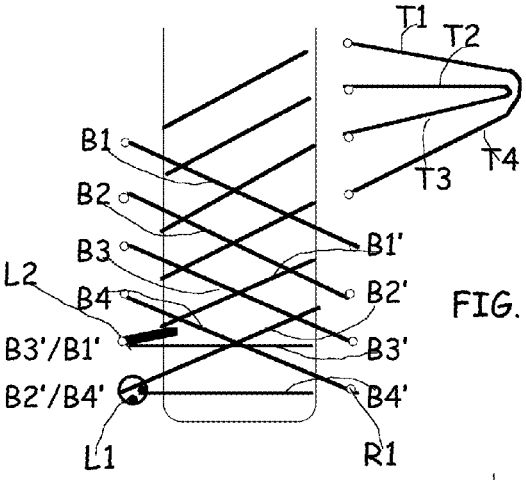
Figure 9G:
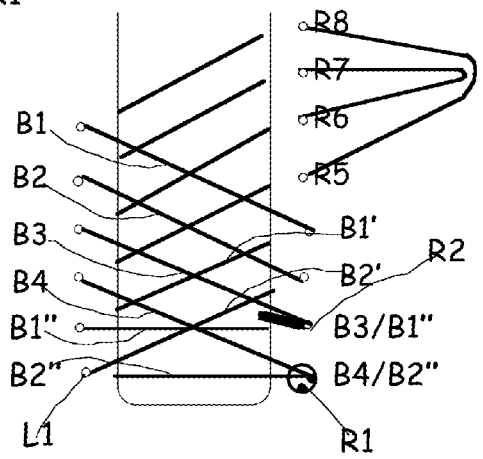
Figure 9H:
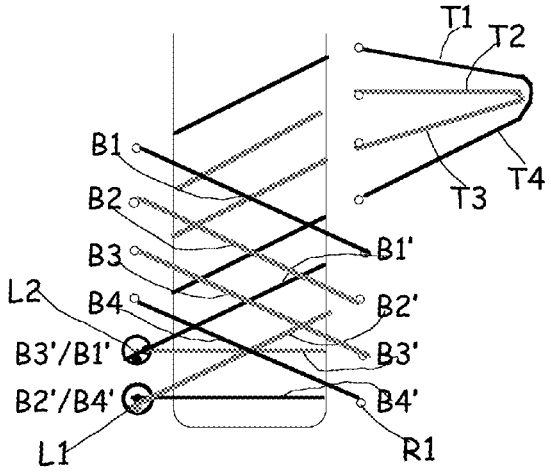
Figure 10A:
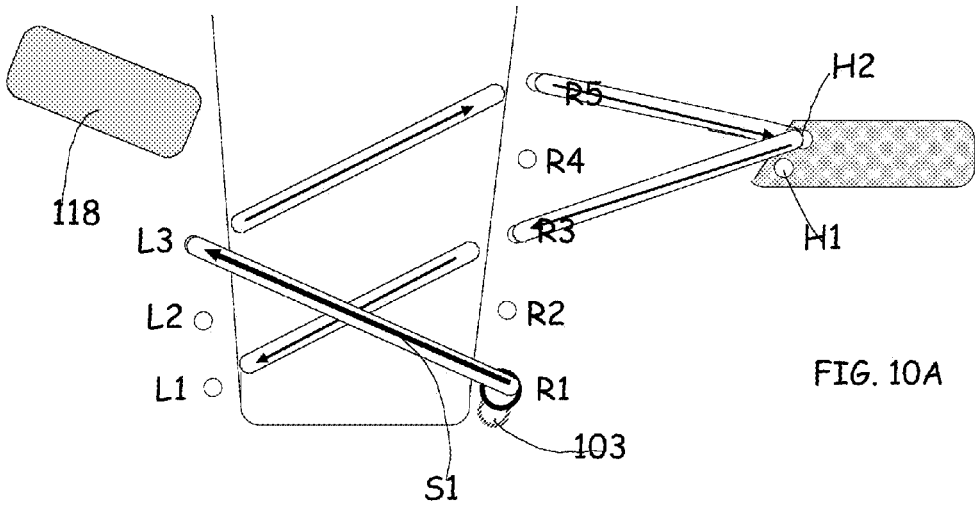
Figure 10B:
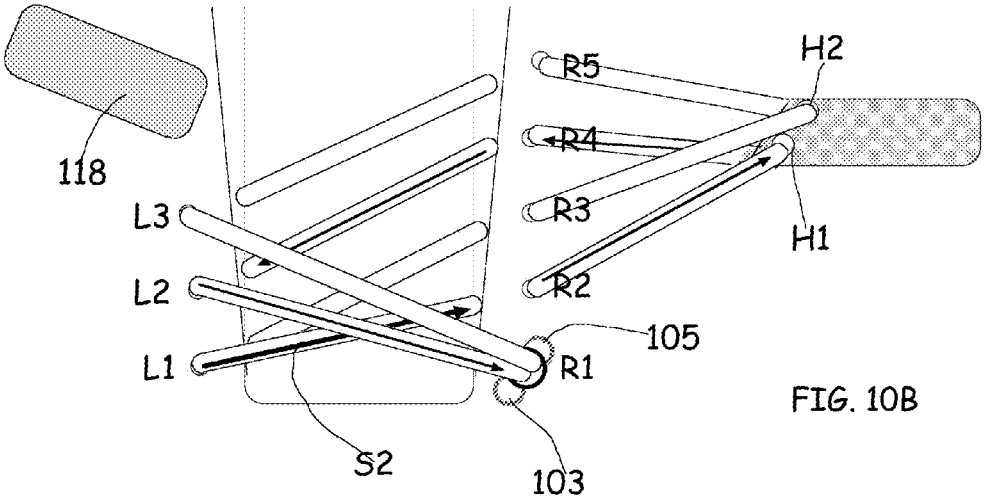
Figure 11A:
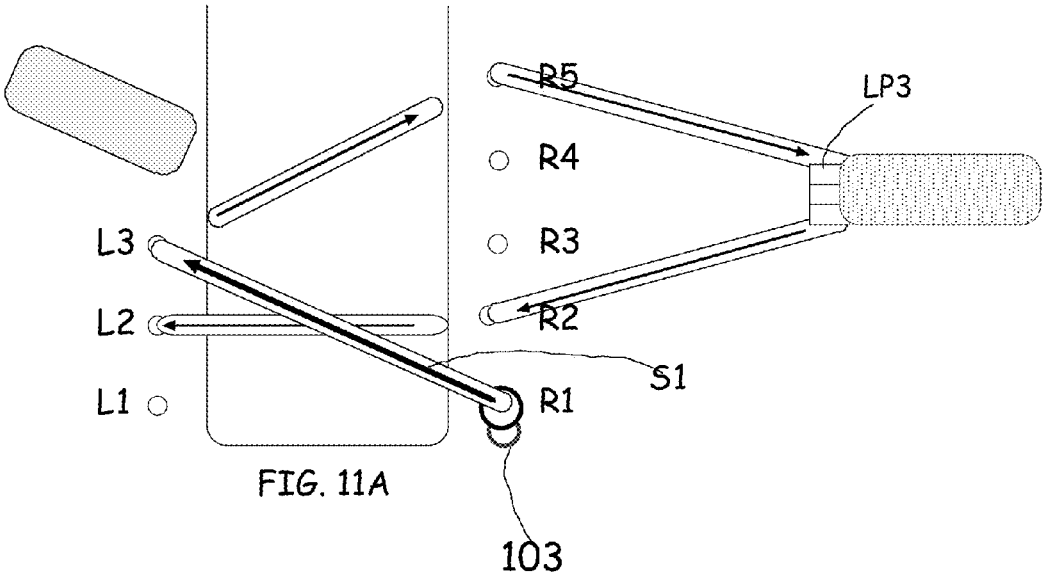
Figure 11B:
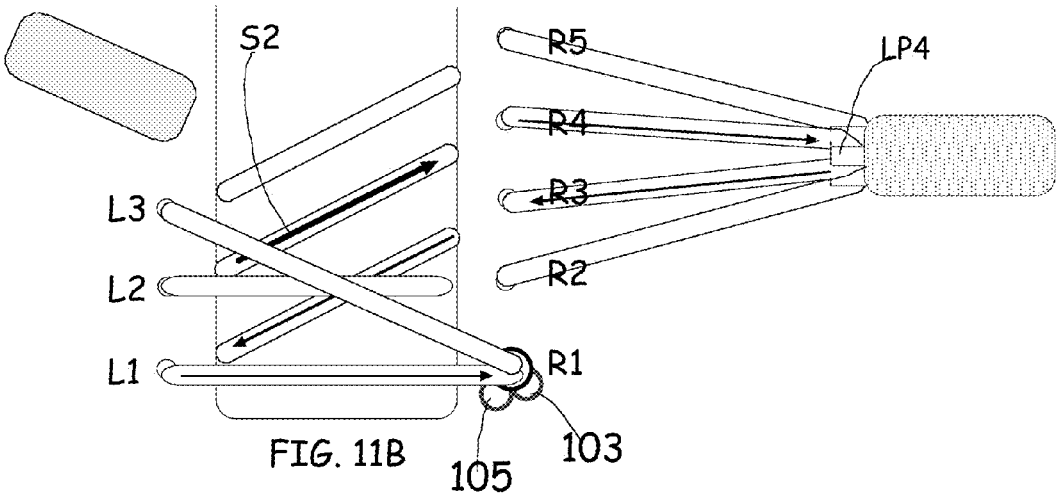
Figure 12A:
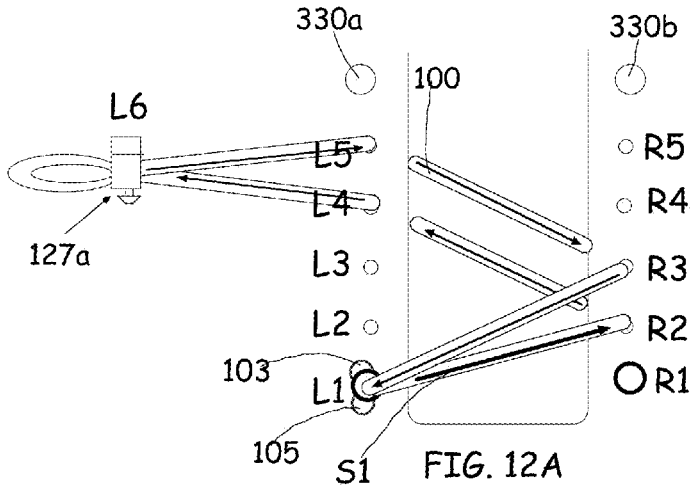
Figure 12B:
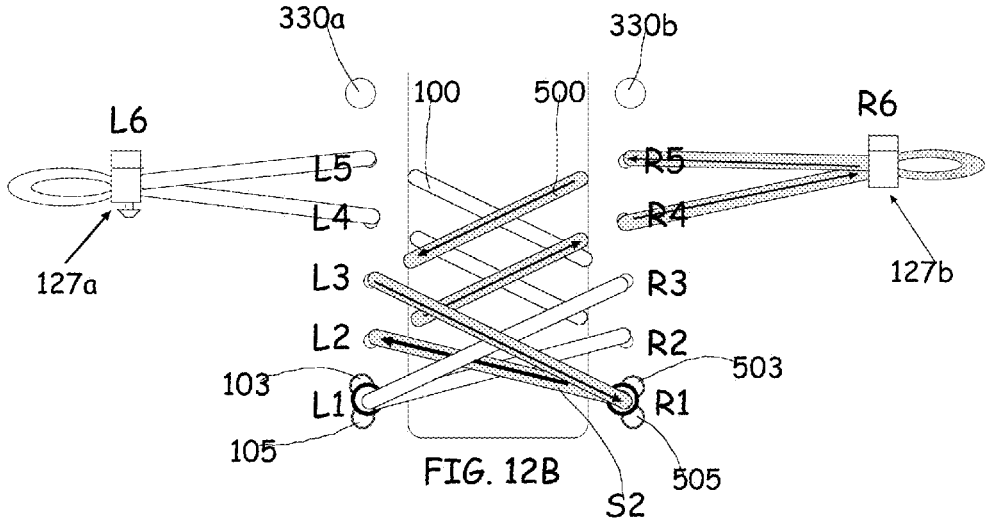
Figure 13A:
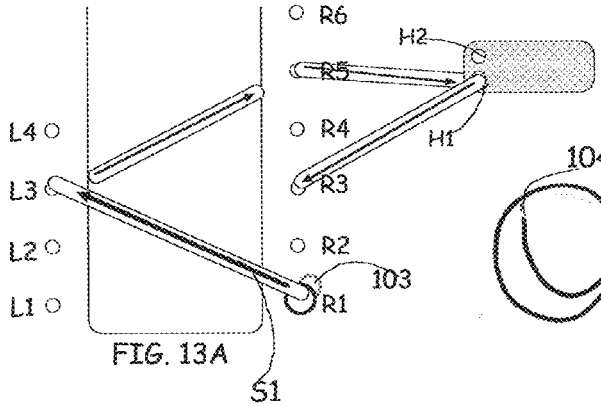
Figure 13A:
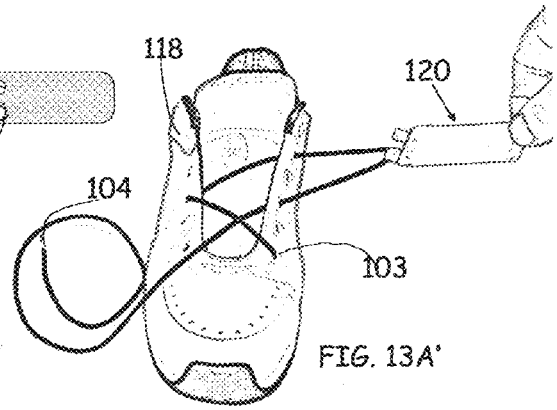
Figure 13B:
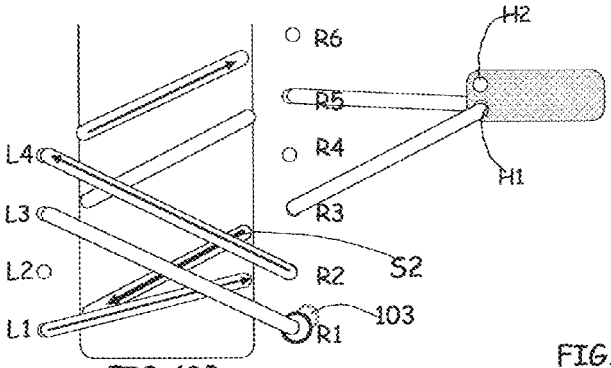
Figure 13B:
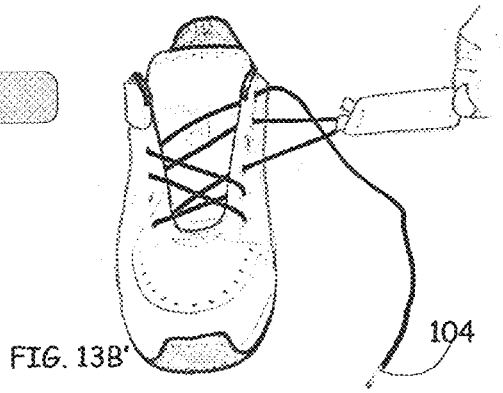
Figure 13C:
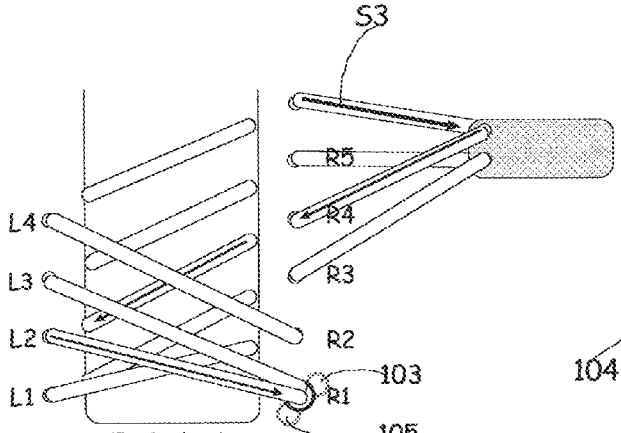
Figure 13C:
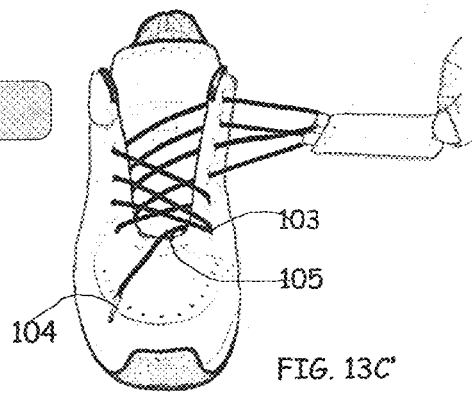
Figure 14A:
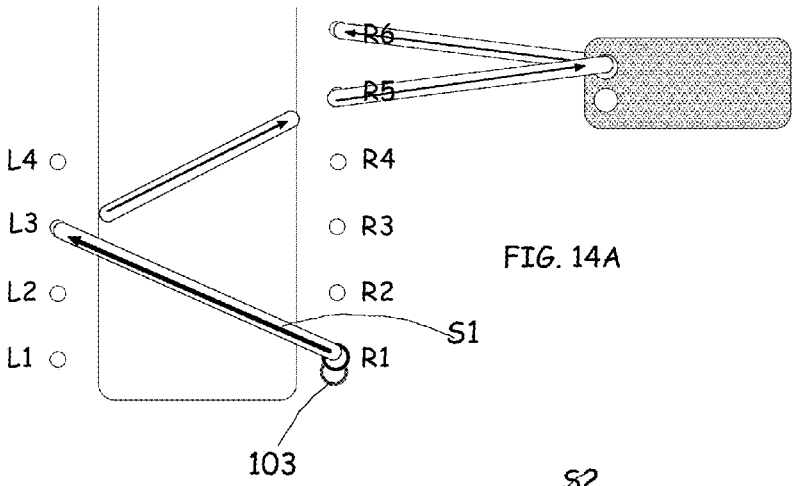
Figure 14B:
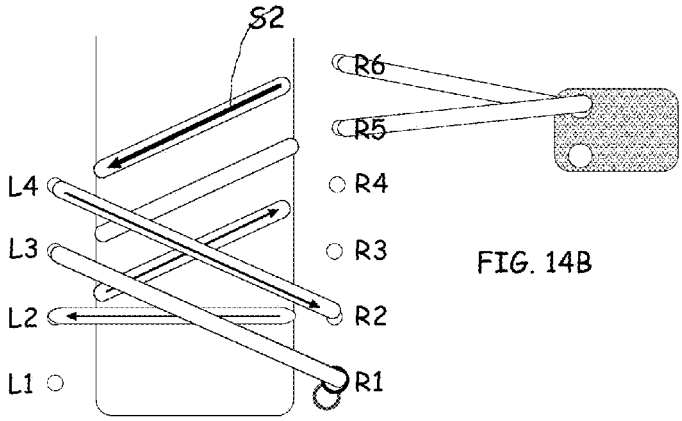
Figure 14C:
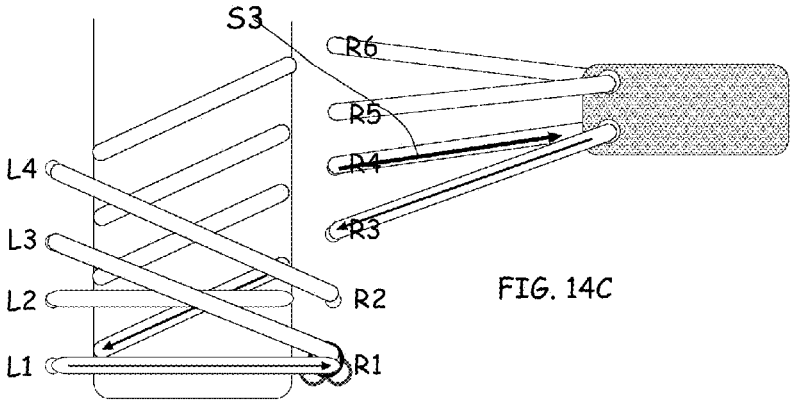
Figure 15A:
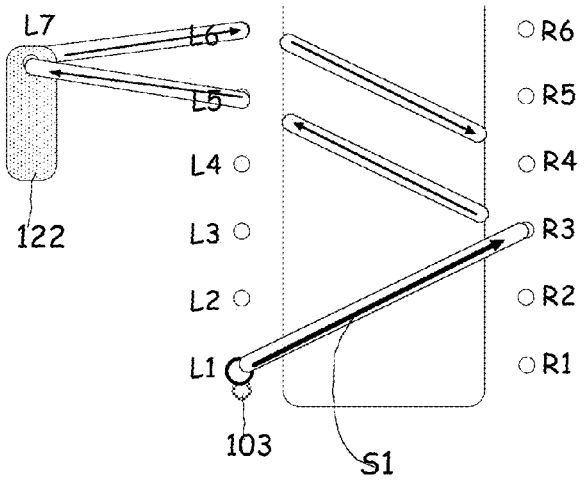
Figure 15B:
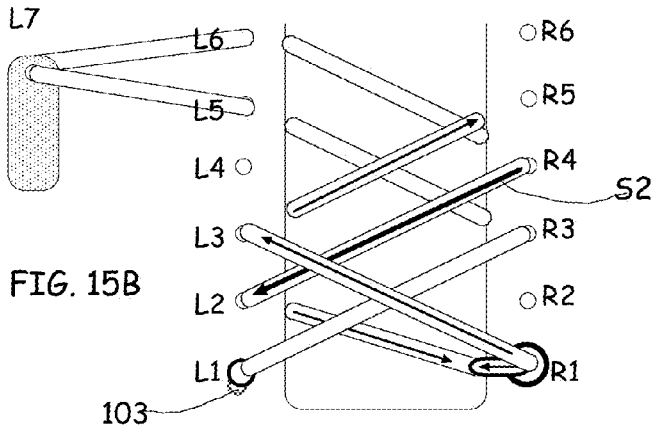
Figure 15C:
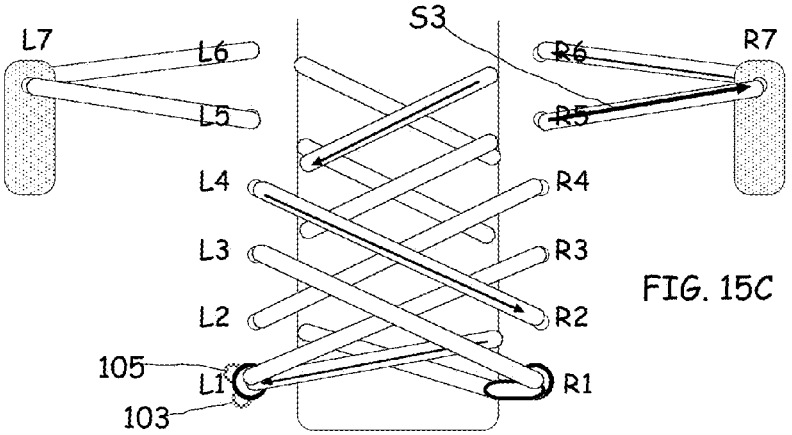
Figure 16A:
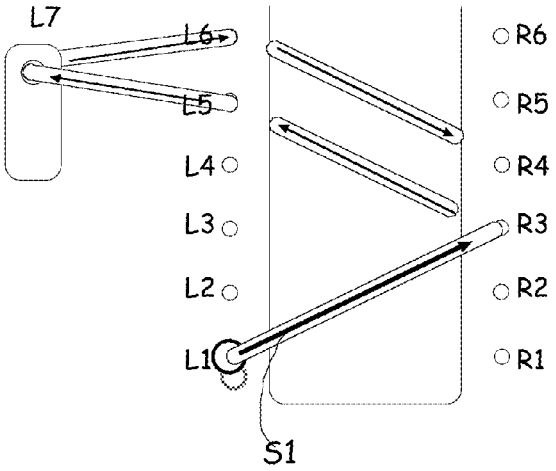
Figure 16B:
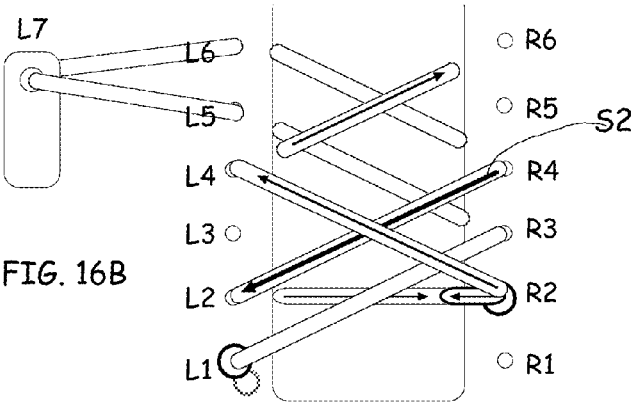
Figure 16C:
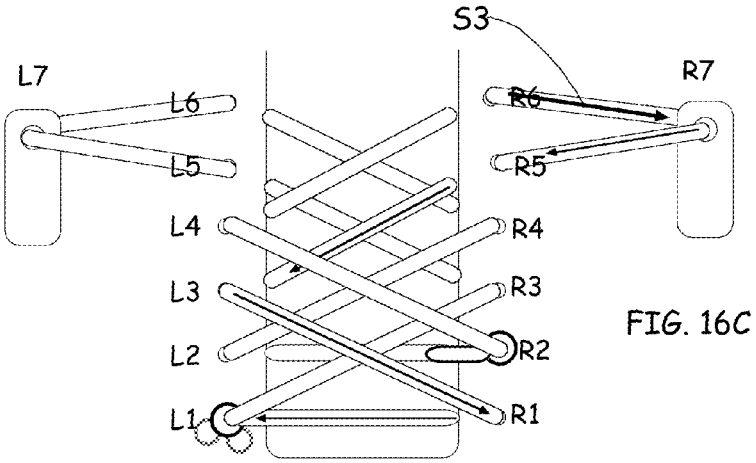
Figure 17A:
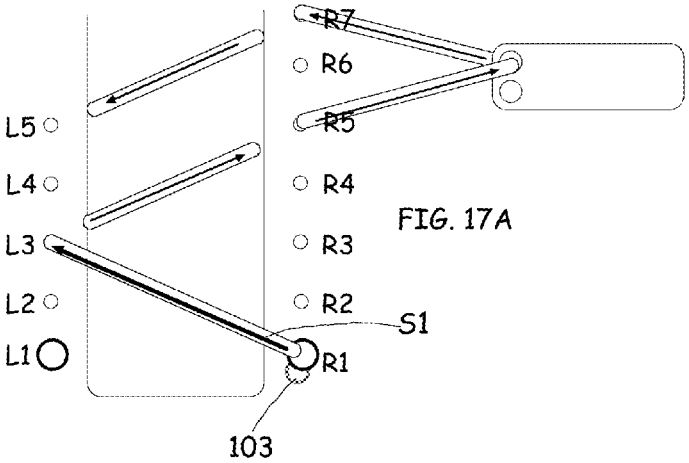
Figure 17B:
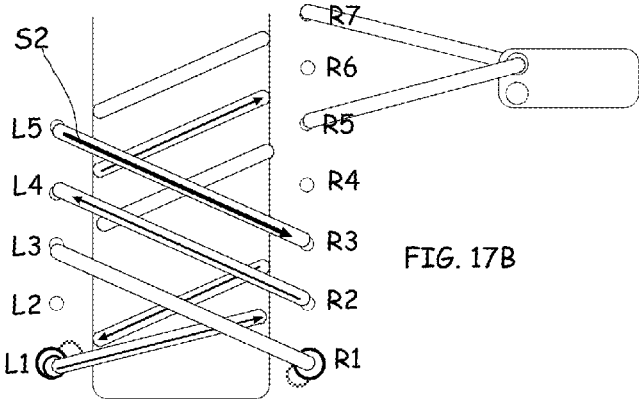
Figure 17C:
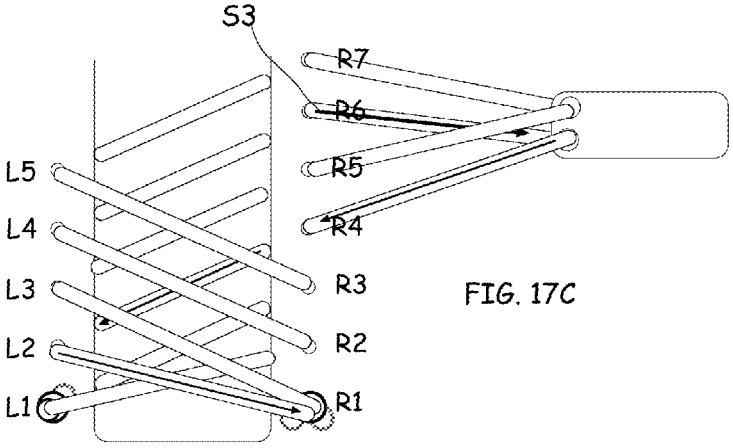
Figure 18A:
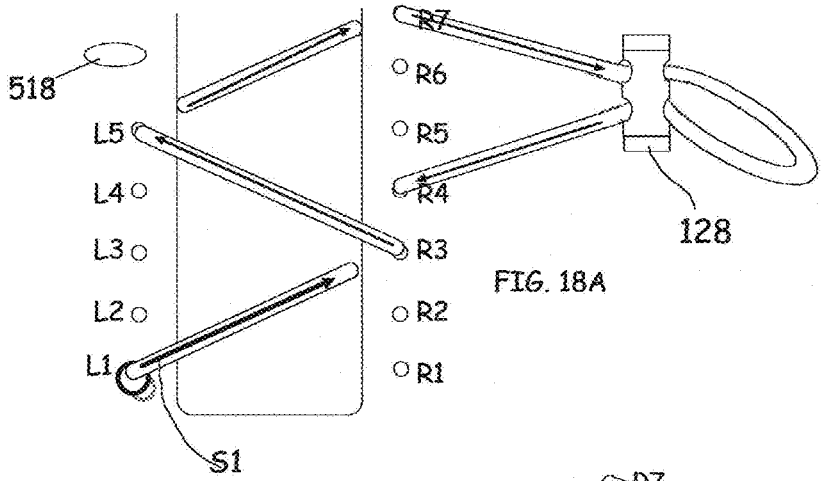
Figure 18B:
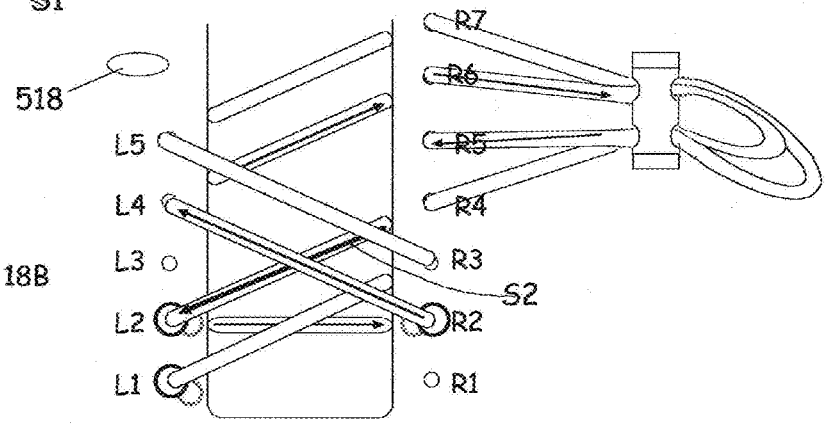
Figure 18C:
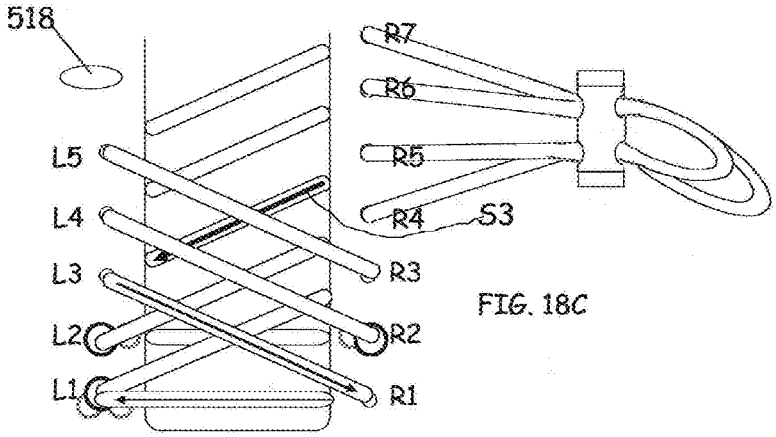
Figure 19A:
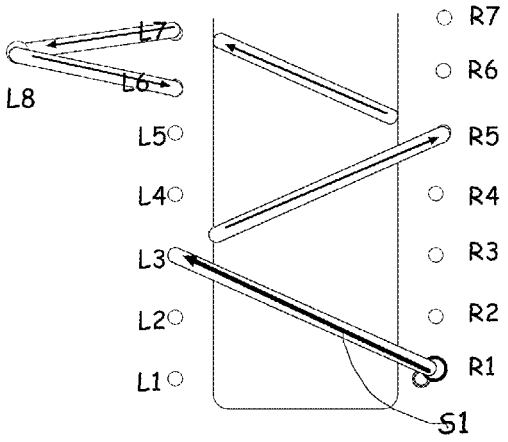
Figure 19B:
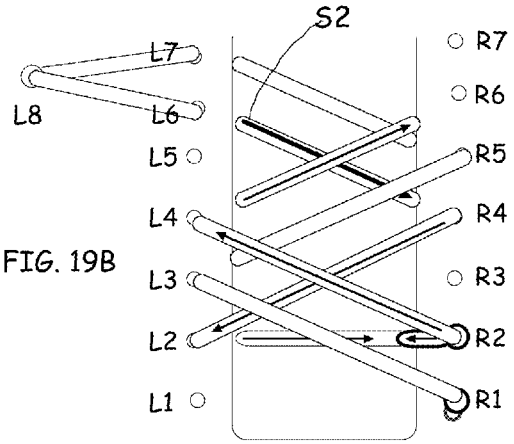
Figure 19C:
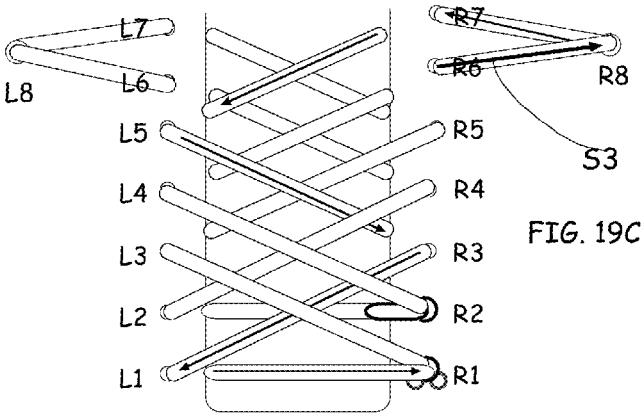
Figure 20A:
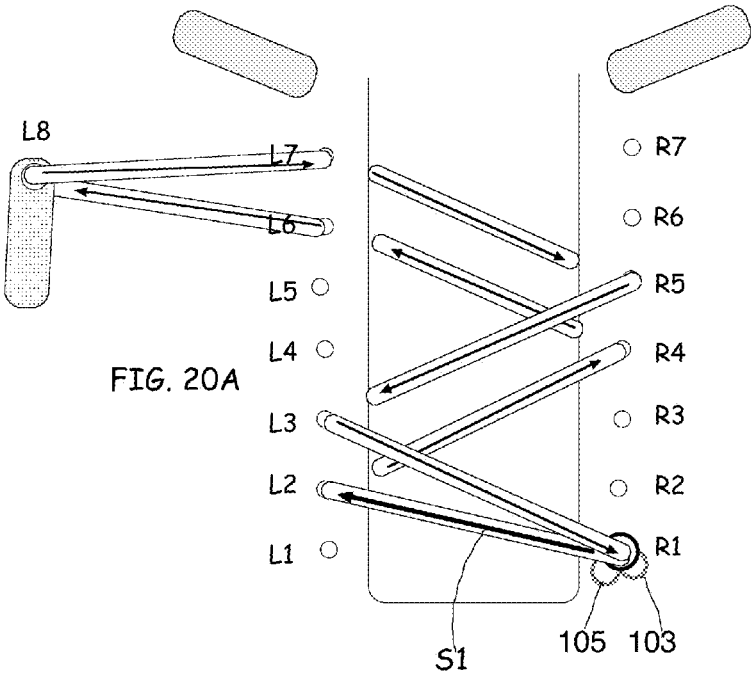
Figure 20B:
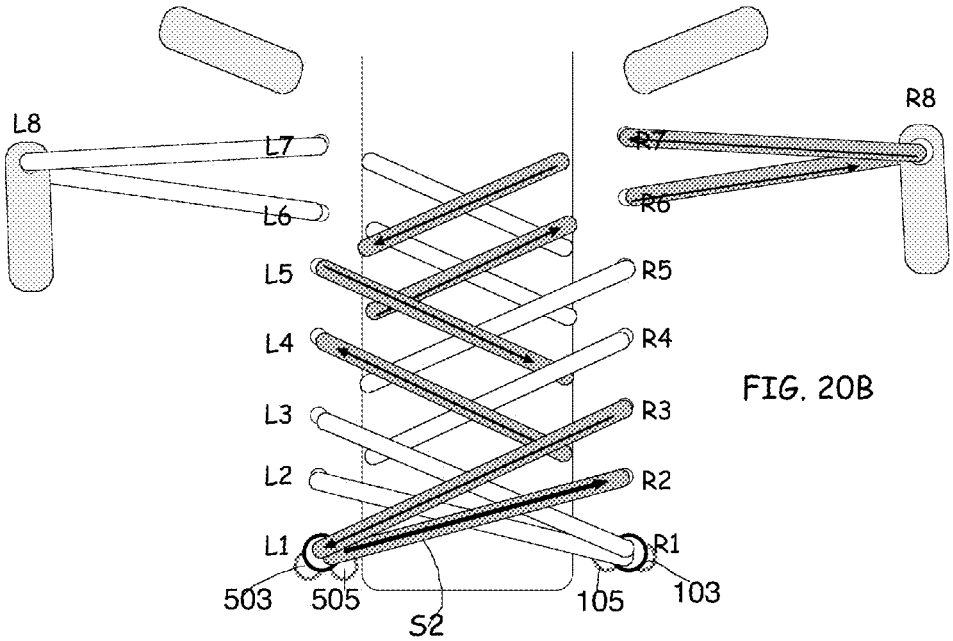
Figure 21A:
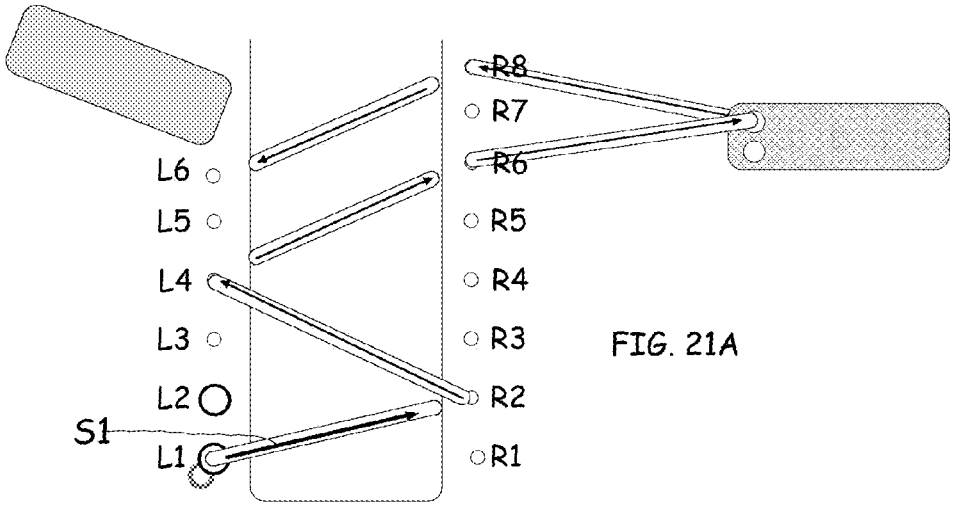
Figure 21B:
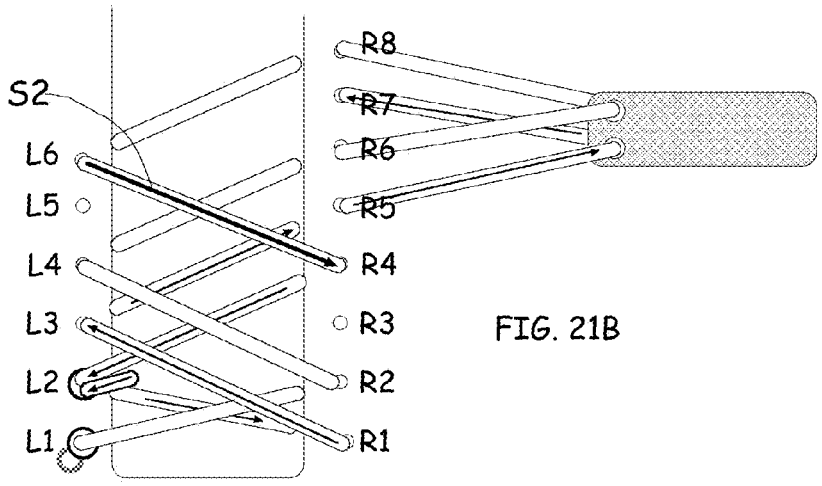
Figure 21C:
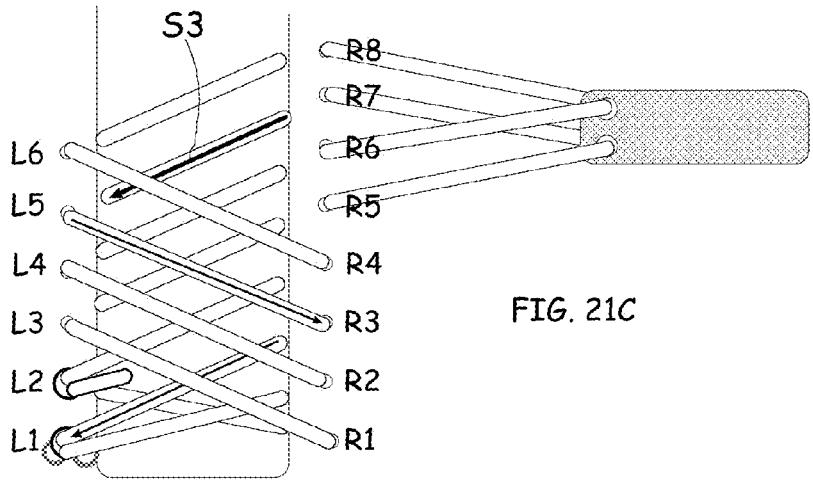
Figure 22A:
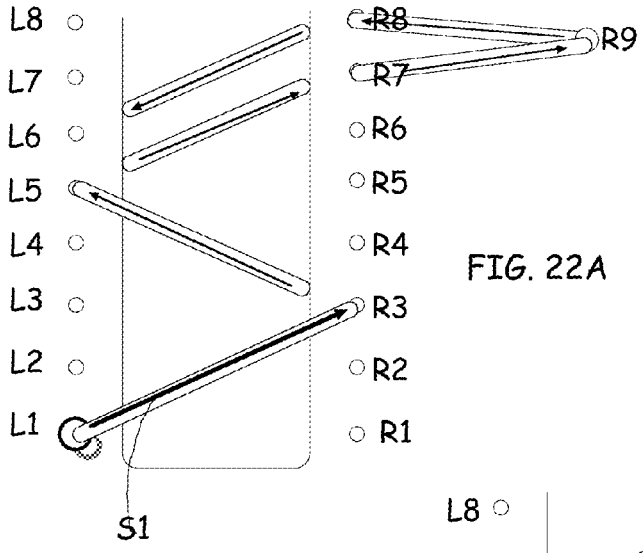
Figure 22B:
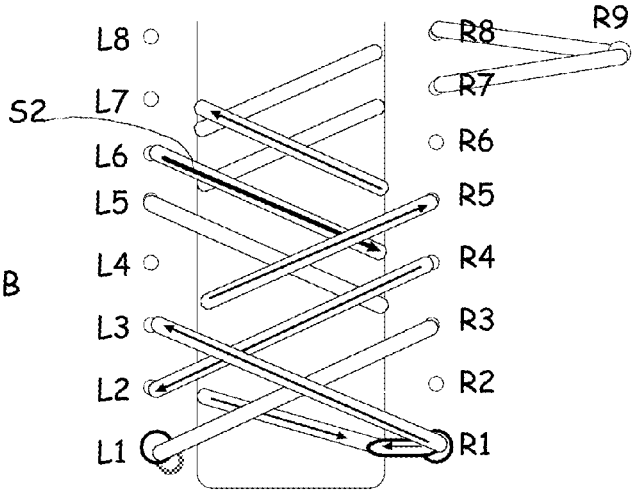
Figure 22C:
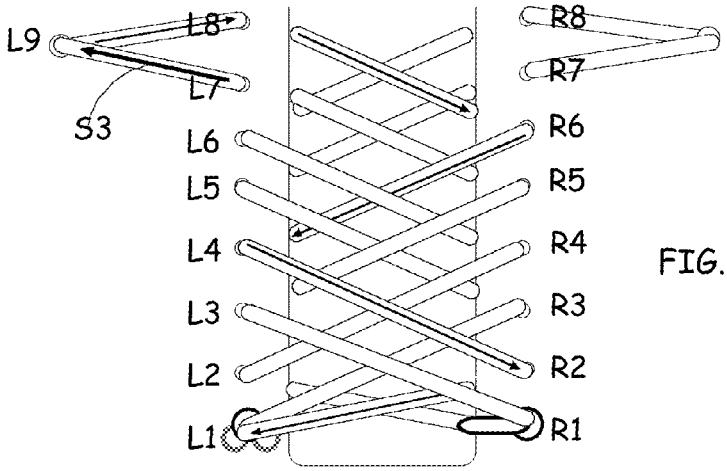
Figure 23A:
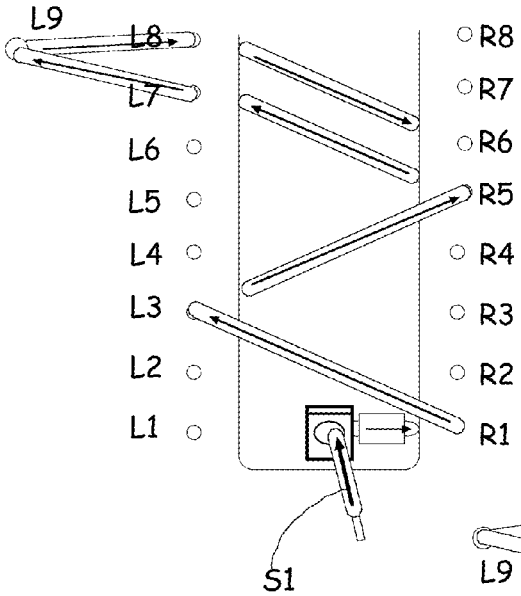
Figure 23B:
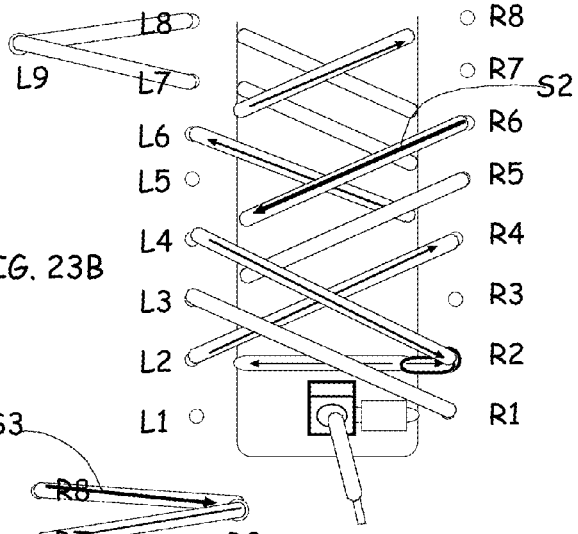
Figure 23C:
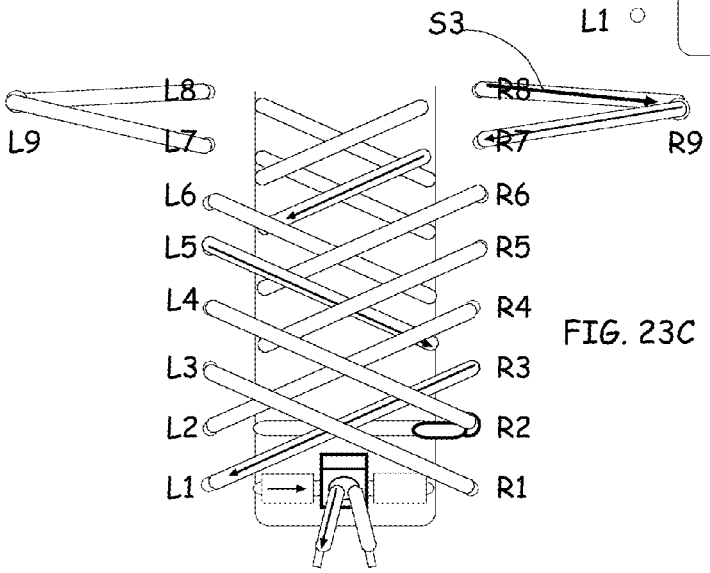
Figure 24A:
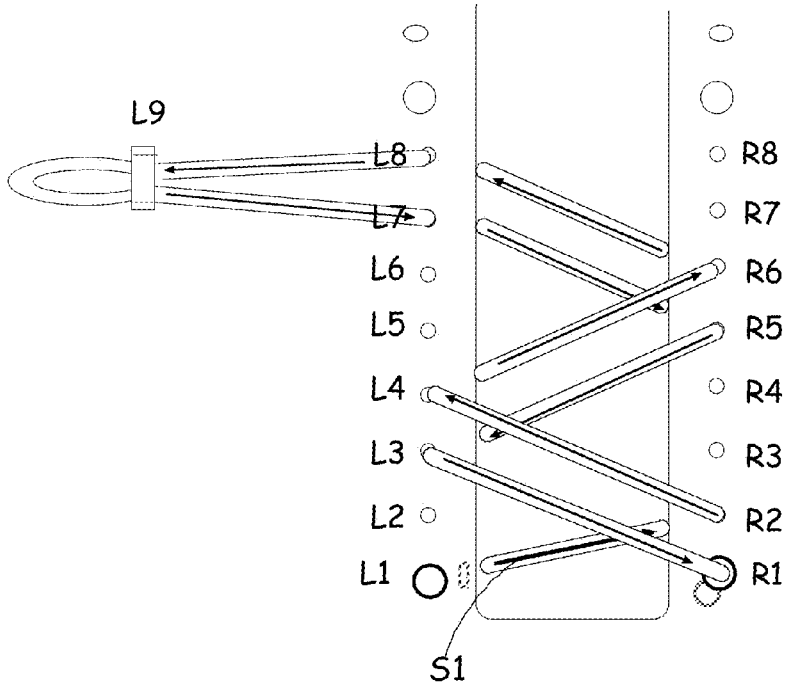
Figure 24B:
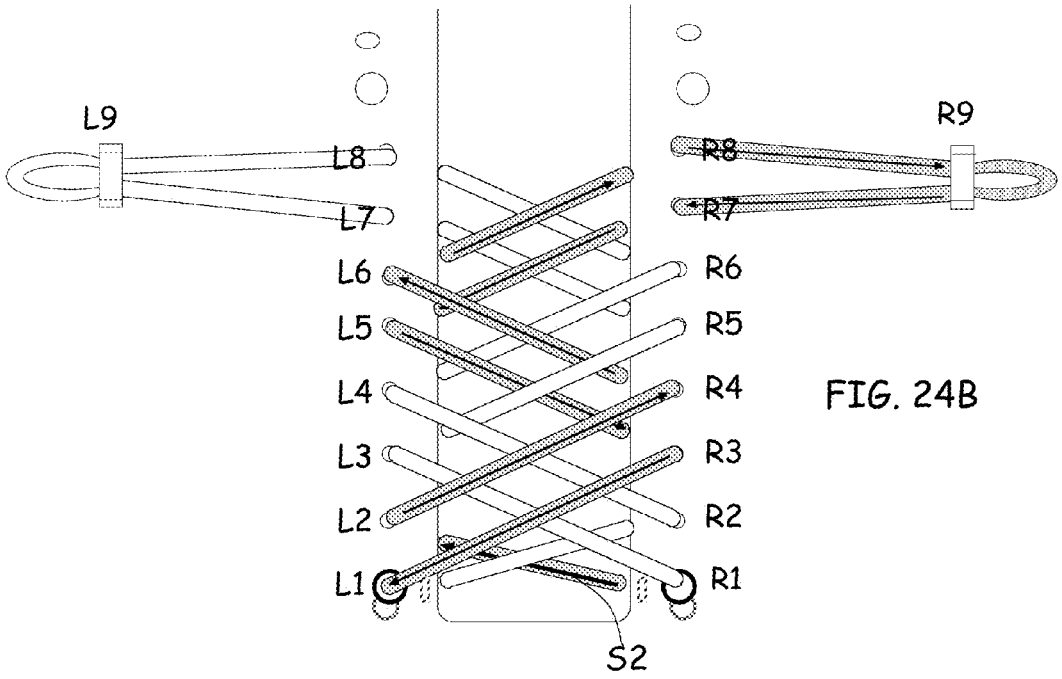
Figure 26B:
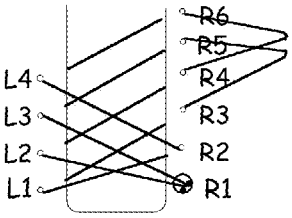
Figure 26B:
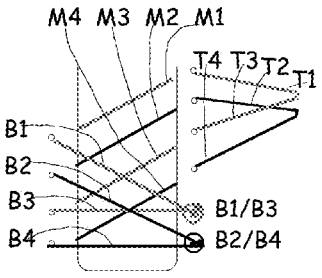
Figure 26B:
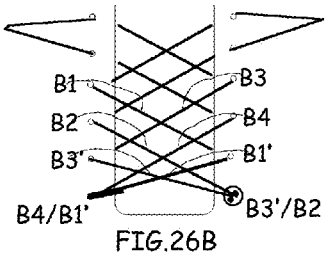
Figure 26B:
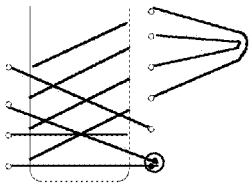
Figure 26B:
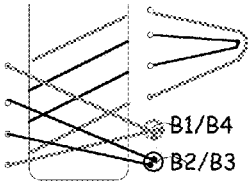
Figure 26B:
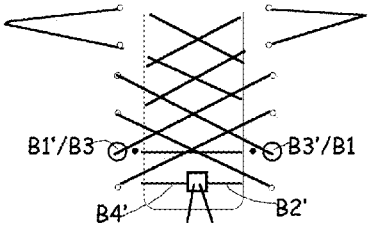
Figure 26B:
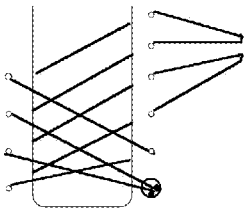
Figure 26B:
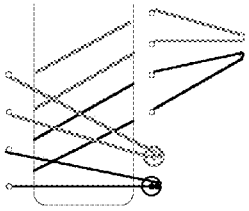
Figure 26B:
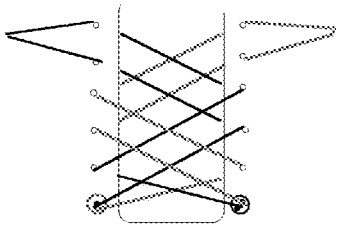
Figure 26B:
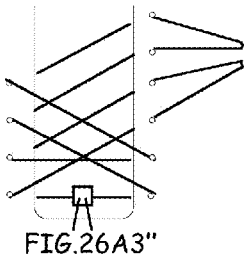
Figure 26B:
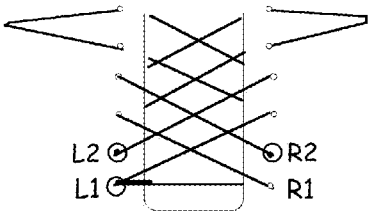
Figure 27B:
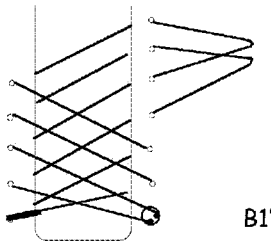
Figure 27B:
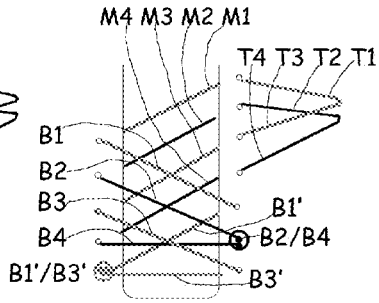
Figure 27B:
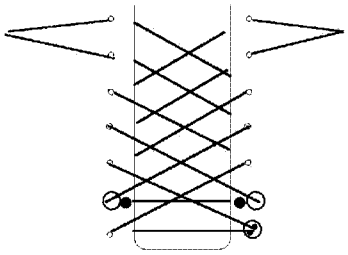
Figure 27B:
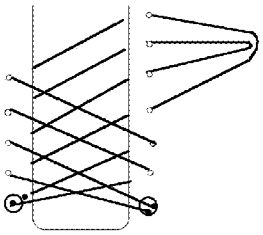
Figure 27B:
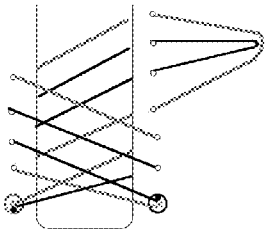
Figure 27B:
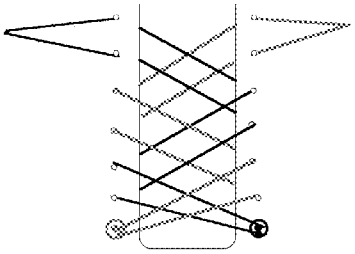
Figure 27B:
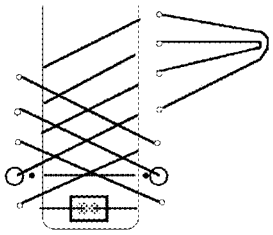
Figure 27B:
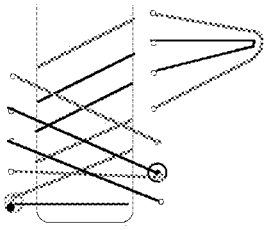
Figure 27B:
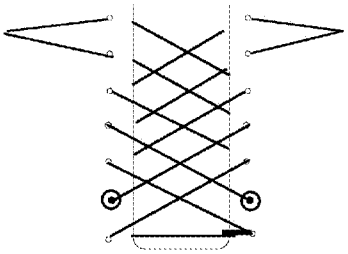
Figure 27B:
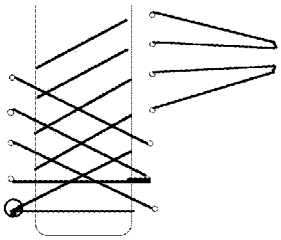
Figure 27B:
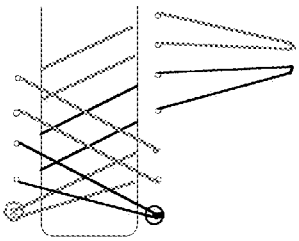
Figure 27B:
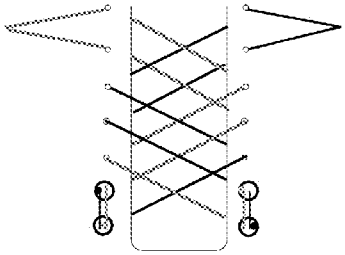
Figure 29A:
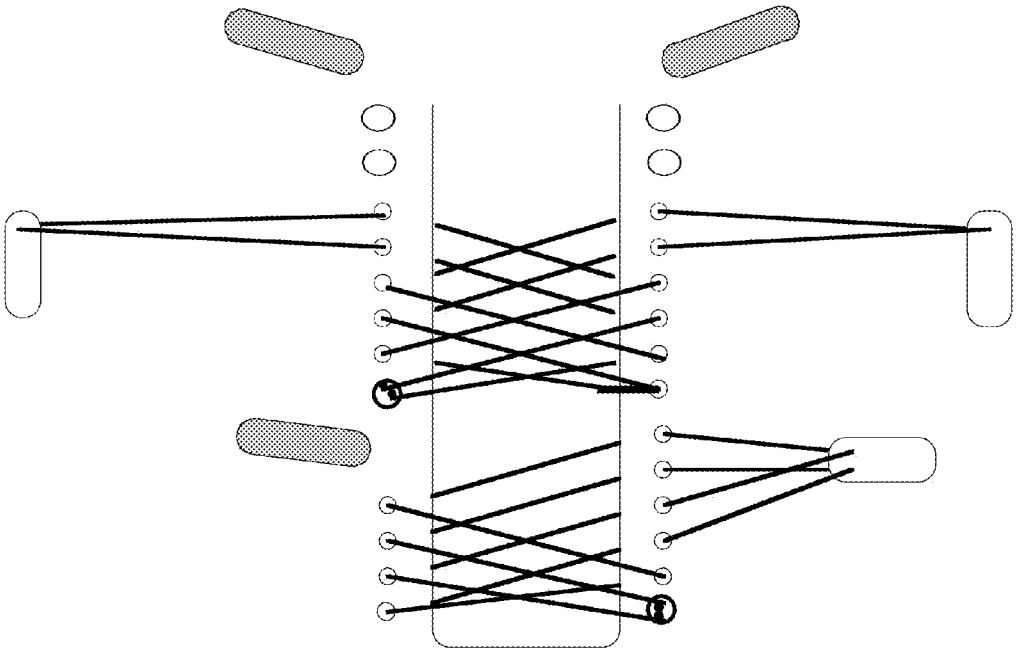
Figure 29B:
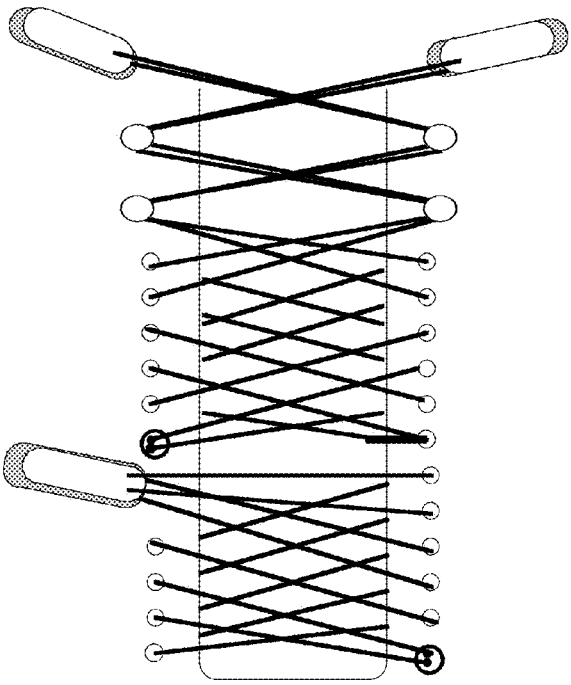
Figure 30A:
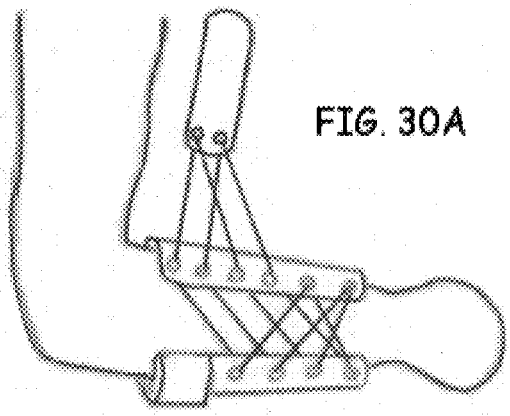
Figure 30B:
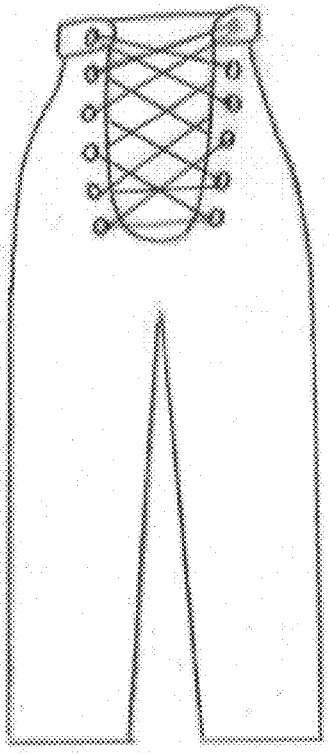
Figure 30C:
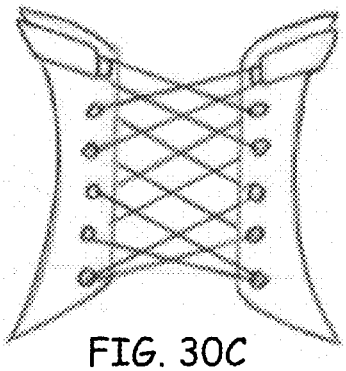

eyelets, in the unfastened position, and the darkened eyelet showing the position of the two (2) end anchors;

FIG. 5C is a front view of the lacing of the adjustable opening of the sneaker of embodiment A3, having five (5) eyelets, in the unfastened position, and the darkened eyelet showing the position of the two (2) end anchors;

FIG. 5D is a front view of embodiment B, having five (5) eyelets, two (2) movable fasteners, two (2) laces, in the unfastened position, and the darkened eyelets showing the position of the two (2) sets of two (2) end anchors;

FIG. 5E shows a side view of two (2) cord-locks used in FIG. 5D that snap into each other;

FIG. 5F shows FIG. 5D in the fastened position, where the two (2) movable fasteners wrap around hooks or knobs and the cord-locks attach to each other in the middle of the adjustable opening;

FIG. 5G shows embodiment B with one (1) lace, two (2) end anchors and two (2) secondary interior knotted anchors;

FIG. 5H shows a prior art version of FIG. 5G, without any interior anchors or end anchors and the resulting shift of the movable fasteners;

FIG. 6A is a front view of embodiment A1, having six (6) eyelets, in the unfastened position, and the darkened eyelet showing the position of the two (2) end anchors;

FIG. 6B is a front view of embodiment A2, having six (6) eyelets that are lugs or loops, in the unfastened position, and a darkened stationary retainer, disposed in the bottom of the adjustable opening, anchoring the two (2) lace ends;

FIG. 6C is a front view of embodiment A3, having six (6) eyelets, two (2) laces, in the unfastened position, and the darkened eyelets showing the position of two (2) sets of the two (2) end anchors;

FIG. 6D is a different lacing of embodiment A3, having six (6) eyelets, one (1) lace, and in the unfastened position, and a darkened eyelet showing the position of the two (2) end anchors;

FIG. 6E is a front view of embodiment B, having six (6) eyelets per side, in the unfastened position, and the darkened areas showing the position of the end anchors and an interior anchor wrapped around or encircling a bottom eyelet;

FIG. 6F is embodiment B with the two (2) ends of the lace non-adjustably anchored at retainer eyelet L1, and a non-adjustable interior anchor at retainer eyelet R2;

FIG. 6G shows embodiment B with one (1) lace, two (2) end anchors and a secondary interior wrap around anchor;

FIG. 7A is a front view of embodiment A1, having seven (7) eyelets, in the unfastened position, and the darkened areas showing the position of the two (2) end anchors, and an adjustable interior anchor comprised of a knot below retainer L1 and another knot above retainer L1;

FIG. 7B is a front view of embodiment A2, having seven (7) eyelets, in the unfastened position, and the two (2) darkened eyelets showing the position of the two (2) end anchors, the two (2) knotted interior anchors, and the movable fastener is a cord lock, that hooks onto a hook;

FIG. 7B' shows a part of FIG. 7B with the two (2) ends anchored at two (2) separate eyelet retainers L1 and R1, and no interior anchor(s);

FIG. 7C is a front view of embodiment A3, having seven (7) eyelets, in the unfastened position, and the darkened eyelets showing the position of the two (2) end anchors, a wrap around interior anchor, and the movable fastener is locking tape;

FIG. 7D is a front view of embodiment B, having seven (7) eyelets per side, one (1) lace, in the unfastened position, and the darkened areas showing the two (2) end anchors and an interior wraparound anchor;

FIG. 7E is a front view of embodiment B, having seven (7) eyelets per side, two (2) laces, in the unfastened position, and the darkened eyelets showing the position of the two (2) sets of two (2) end anchors;

FIG. 7F is a front view of embodiment B, having seven (7) eyelets per side, one (1) lace, in the unfastened position, and the darkened eyelets showing the position of the four (4) eyelet retainers, the lace wraps around eyelet retainers R2 and R1, and the two (2) ends are anchored at L1 and L2;

FIG. 7F' shows a part of FIG. 7F, where the interior anchor includes two (2) knots disposed under eyelets R2 and R1;

FIG. 8A is a front view of embodiment A1, having eight (8) eyelets and one movable fastener, and an interior wrap-around anchor;

FIG. 8B is a front view of embodiment A2, having eight (8) eyelets and one movable fastener, and an interior anchor comprised of an inside and outside knot;

FIG. 8C is a front view of embodiment A3, having eight (8) eyelets and one (1) movable fastener, and an interior wrap around anchor;

FIG. 8D is a front view of embodiment B, having two (2) movable fasteners, eight (8) eyelets per side, one (1) lace, an interior wrap-around anchor at R1 and two (2) end anchors anchored under eyelet L1;

FIG. 8D' is FIG. 8D with the two (2) movable fasteners crossed around knobs and crossed again in the fastened position;

FIG. 8D" shows two (2) lace segments totally above the two (2) lace segments underneath, minimizing friction;

FIG. 8D"' shows two (2) lace segments woven into two (2) lace segments underneath, increasing friction;

FIG. 8E is a front view of embodiment B, an interior wrap around anchor, and two (2) dynamically adjustable end anchors in a cord-lock, and tubes on the bottom segments to keep the cord lock stationary;

FIG. 8E' shows the bottom segments of FIG. 8E attached by a different stationary retaining member with just a hole (and no spring) in the middle bottom of the adjustable opening;

FIG. 8E" is FIG. 8E with the adjustable interior anchors being two (2) knots and two (2) end anchors under eyelet L1;

FIG. 8F shows a front view of embodiment B, in the unfastened position, having eight (8) eyelets per side, and two (2) movable fasteners, and two (2) laces, with two (2) sets of two (2) end anchors, one set of end anchors at L1, and the other set of end anchors at R1, and one (1) end anchor on each lace is not adjustable and is sewn to the shoe;

FIG. 8F' is FIG. 8F in the fastened position, with the two (2) laces from the two (2) cord-lock moveable fasteners crossed, then wrapped around knobs, crossed again, and then hooked onto hooks;

FIG. 8F" shows a part of FIGS. 8F' with the four (4) bottom segments anchored at four (4) separate eyelet retainers, and the four (4) knotted anchored ends disposed under the eyelet retainers;

FIG. 9A is a front view of the lacing of a prior art shoe having only ten (10) of it's twelve (12) eyelets laced;

FIG. 9B shows the lacing of the present invention, embodiment A1, with only ten (10) of its twelve (12) eyelets laced;

FIG. 9C shows the lacing of prior art shoe with all the eyelets laced and indicating points of friction;

FIG. 9D shows the lacing of the present invention, embodiment A1, with all the eyelets laced and indicating points of friction;

FIG. 9E is a front view of the lacing of embodiment B of the present invention, having two (2) movable fasteners and one (1) lace showing points of friction, and two (2) end anchor retainers at R1 and an interior wrap around anchor at eyelet L1;

FIG. 9F shows the lacing of the present invention, embodiment A2, having one (1) lace, eight (8) eyelets per side, two (2) end anchors at L1 and an interior wrap around anchor at L2;

FIG. 9G shows embodiment A2 as in FIG. 9F, with the end anchors at R1, and the interior anchor at R2;

FIG. 9H shows embodiment A2 as in FIG. 9F, but having two (2) laces and two (2) sets of two (2) end anchors;

FIGS. 10A-10B show the sequential lacing method for the shoe of FIG. 5A;

FIGS. 11A-11B show the sequential lacing method for the shoe of FIG. 5B;

FIGS. 12A-12B show the sequential lacing method for the shoe of FIG. 5D; FIGS. 13A-13C' show the sequential three (3) stage lacing method for the shoe of FIG. 6A in a diagram and the corresponding lacing on a shoe;

FIGS. 14A-14C show the sequential lacing method for the shoe of FIG. 6D;

FIGS. 15A-15C show the sequential lacing method for the shoe of FIG. 6E;

FIGS. 16A-16C show the sequential lacing method for the shoe of FIG. 6G;

FIGS. 17A-17C show the sequential lacing method for the shoe of FIG. 7A;

FIGS. 18A-18C show the sequential lacing method for the shoe of FIG. 7B;

FIGS. 19A-19C show the sequential lacing method for the shoe of FIG. 7D;

FIGS. 20A-20B show the sequential lacing method for the shoe of FIG. 7E;

FIGS. 21A-21C show the sequential lacing method for the shoe of FIG. 8A;

FIGS. 22A-22C show the sequential lacing method for the shoe of FIG. 8D;

FIGS. 23A-23C show the sequential lacing method for the shoe of FIG. 8E;

FIGS. 24A-24B show the sequential lacing method for the shoe of FIG. 8F;

FIG. 25A1 shows embodiment A1 of the present invention with five (5) eyelets;

FIG. 25A2 shows embodiment A2 of the present invention with five (5) eyelets;

FIG. 25A3 shows embodiment A3 of the present invention with five (5) eyelets;

FIG. 25B shows embodiment B of the present invention with five (5) eyelets and two (2) laces;

FIG. 25B' shows embodiment B of the present invention with five (5) eyelets and one (1) lace;

FIG. 26A1 shows embodiment A1 of the present invention with six (6) eyelets;

FIG. 26A1' shows embodiment A1 of the present invention with six (6) eyelets, and two (2) laces;

FIG. 26A2 shows embodiment A2 of the present invention with six (6) eyelets;

FIG. 26A2' shows embodiment A2 of the present invention with six (6) eyelets, and two (2) laces;

FIG. 26A3 shows embodiment A3 of the present invention with six (6) eyelets;

FIG. 26A3' shows embodiment A3 of the present invention with six (6) eyelets and two (2) laces;

FIG. 26A3" shows embodiment A3 of the present invention, with six (6) eyelets, and a cord-lock attached to the horizontal bottom segment;

FIG. 26B shows embodiment B of the present invention with six (6) eyelets, and an interior wrap around anchor;

FIG. 26B' shows embodiment B of the present invention with six (6) eyelets, a horizontal bottom segment, a cord-lock anchoring the two (2) ends, and two (2) interior knot anchors;

FIG. 26B" shows embodiment B of the present invention with six (6) eyelets, and two (2) laces, and four (4) end anchors, anchored at two (2) retainers;

FIG. 26B"' shows embodiment B of the present invention with six (6) eyelets, one (1) lace, three (3) retainers, and end anchors under retainers L2 and R2, and an interior wrap around anchor at L1;

FIG. 27A1 shows embodiment A1 of the present invention with seven (7) eyelets and an interior anchor;

FIG. 27A1' shows embodiment A1 of the present invention with seven (7) eyelets and two (2) laces, and four (4) ends anchored at two (2) retainers;

FIG. 27A2 shows embodiment A2 of the present invention with seven (7) eyelets and an interior anchor, comprised of an inside and outside knot, and two (2) end anchors;

FIG. 27A2' shows embodiment A2 of the present invention with seven (7) eyelets and two (2) laces, and two (2) sets of two (2) end anchors;

FIG. 27A2" shows embodiment A2 of the present invention with seven (7) eyelets, one (1) lace, and a retainer anchoring the two (2) ends on a horizontal bottom segment and two (2) interior knotted anchors;

FIG. 27A2"' shows embodiment A2 of the present invention with seven (7) eyelets and two (2) laces, and four (4) end anchors;

FIG. 27A3 shows embodiment A3 of the present invention with seven (7) eyelets and an interior wrap-around anchor;

FIG. 27A3' shows embodiment A3 of the present invention with seven (7) eyelets, two (2) laces, and four (4) end anchors, anchored to two (2) retainers;

FIG. 27B shows embodiment B of the present invention with seven (7) eyelets, one (1) lace, and two (2) knotted interior anchors, and two (2) end anchors and three (3) retainers;

FIG. 27B' shows embodiment B of the present invention with seven (7) eyelets, two (2) laces, two (2) sets of two (2) end anchors;

FIG. 27B" shows embodiment B of the present invention having one (1) lace and the two (2) ends of the lace anchored separately at L2 and R2, and having one (1) interior wrap around anchor at R1;

FIG. 27B"' shows embodiment B of the present invention having two (2) laces, and the four (4) ends of the two (2) laces anchored separately, at four (4) separate eyelet retainers;

FIG. 28A1 shows embodiment A1 of the present invention with eight (8) eyelets and an interior anchor;

FIG. 28A1' shows embodiment A1 of the present invention with eight (8) eyelets and two (2) laces;

FIG. 28A2 shows embodiment A2 of the present invention with eight (8) eyelets and an interior anchor;

FIG. 28A2' shows embodiment A2 of the present invention with eight (8) eyelets and two (2) laces;

FIG. 28A3 shows embodiment A3 of the present invention with eight (8) eyelets, an interior anchor, and two (2) end anchors anchored on two (2) separate retainers;

FIG. 28A3' shows embodiment A3 of the present invention with eight (8) eyelets and two (2) laces, and two (2) sets of two (2) end anchors;

FIG. 28B shows embodiment B of the present invention with eight (8) eyelets and an interior anchor;

FIG. 28B' shows embodiment B of the present invention with eight (8) eyelets, and two (2) laces, two (2) end anchors at separate retainers, and a cord-lock on a bottom end segment of each lace;

FIG. 28B" shows embodiment B of the present invention with eight (8) eyelets, one (1) lace, an interior wrap-around anchor, and having a horizontal bottom segment with a cord-lock anchor for dynamic dual adjustability;

FIG. 29A shows a knee high boot with the lacing of embodiment A over the instep, and the lacing of embodiment B around the calf, in the open position;

FIG. 29B shows the boot of FIG. 29A in the fastened position;

FIG. 30A shows the lacing system of the present invention having one (1) movable fastener on an arm brace;

FIG. 30B shows the lacing system of the present invention having two (2) movable fasteners on a pair of pants; and FIG. 30C shows the lacing system of the present invention having two (2) movable fasteners on a corset.

DETAILED DESCRIPTION OF THE PRESENTLY PREFERRED EXEMPLARY EMBODIMENTS

This specification discloses two (2) presently preferred exemplary embodiments, A and B, of the present invention. Embodiment A has one (1) movable fastener and embodiment B has two (2) movable fasteners.

The adjustable openings of the present invention disclosed in this specification have five (5) through eight (8) eyelets per side. Some examples of embodiments A and B having five (5) eyelets are depicted in FIGS. 25A1-25B'. Some examples of embodiments A and B having six (6) eyelets are depicted in FIGS. 26A1-26B'". Some examples of embodiments A and B having seven (7) eyelets are depicted in FIGS. 27A1-27B'". Some examples of embodiments A and B having eight (8) eyelets are depicted in FIGS. 28A1-28B".

Shoes having one (1) movable fastener, i.e., embodiment A, are often referred to as "sneakers", and shoes having two (2) movable fasteners, i.e., embodiment B, are often referred to as "boots".

Most laced sneakers and boots have 5-8 eyelets per side. Boots (which are usually taller) may also have knobs, and hooks, above the top eyelets, for added height. For the sake of brevity in this specification, only the right shoe of the present invention, having one (1) movable fastener, embodiment A, is shown and discussed throughout the disclosure, however one skilled in the art will readily recognize that the lacing system can easily be incorporated into a left shoe with one (1) movable fastener. The lacing of shoes having two (2) movable fasteners, embodiment B, is the same whether it's a right shoe or a left shoe. FIGS. 29A-29B shows a tall, right, knee high boot having the lacing of embodiment A on the bottom part, and the lacing of embodiment B on the top part.

The eyelets are sequentially labeled and numbered starting from the bottom, at the toe, where "L"=Left and "R"=Right. Eyelets L1, L2, L3, L4 etc. are on the left side of the opening. Eyelets R1, R2, R3, R4 etc. are on the right side of the opening. At least one (1) lace forms two (2) segment loops that contribute to creating embodiments A and B. Each segment loop is attached to a movable fastener and is movable in both directions thru its attachment to the movable fastener. Each segment loop forms two (2) segments that extend from the movable fastener to the the side of the shoe or opening.

Embodiment A has two (2) segment loops that are movably attached to one (1) movable fastener 120 by holes or lugs (eyelet loops). The two (2) segment loops form four (4) segments that extend from movable fastener 120, to the right side of the shoe. The lugs or eyelet loops are labeled LP1, LP2, LP3, LP4, LP5 and the eyelet holes are labeled H1,H2. Cord lock movable fasteners have an internal spring and can have one (1) or two (2) holes.

Embodiment B has two (2) movable fasteners 120*a*,120*b*. One movable fastener is on the right of the shoe and the other movable fastener is on the left side of the shoe. One segment loop is movably attached to the right movable fastener, and forms two (2) segments that extend from the right movable fastener to the right side of the shoe. The other segment loop is movably attached to the left movable fastener, and forms two (2) segments that extend from the left movable fastener to the left side of the shoe. Each movable fastener of embodiment B has one (1) eyelet which may be a hole or an eyelet loop (also referred to as a lug). The holes or lugs are labeled R6,L6 or R7,L7 or R8,L8 etc.

Figure 1A:
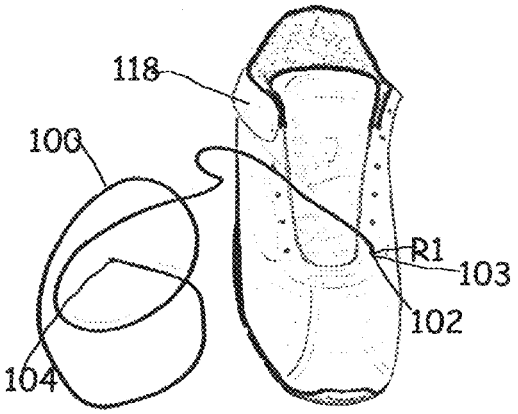
FIG. 1A shows a front view a right shoe, embodiment A1, having six (6) eyelets, one (1) lace, the fixed end is anchored under a bottom eyelet, and the free end of the lace is shown, prior to lacing.
Figure 1B:
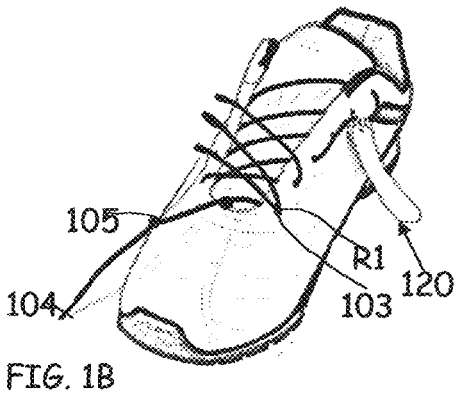
FIG. 1B is the shoe of FIG. 1A, showing the movable fastener and the upper layer of lace segments disposed entirely above a lower layer of lace segments.

FIGS. 1A-1F show embodiment A1. FIG. 1A shows the front of a shoe having one (1) lace 100. Lace 100 has two (2) ends 102, 104. The shoe, in FIG. 1F, has four (4) eyelets on the left, L1,L2,L3,L4 and six (6) eyelets on the right R1,R2,R3,R4,R5,R6. Movable fastener 120 has the other two (2) "left" eyelets L5 and L6, which move to the left side of the shoe when the user fastens the shoe. The eyelets on the movable fasteners have several structures, as further shown and discussed in FIGS. 4C-4S. End 102 of lace 100 is fixed, and is immediately anchored at R1, by a stopper (such as knot 103) under eyelet R1 (FIG. 1A), which is a stationary retainer and holds knot 103 without moving. End 104 of lace 100 is free, and is used to lace or thread the shoe as shown in FIG. 6A, by following the precise three (3) stage lacing method illustrated and depicted in FIGS. 13A-13C'. FIG. 1B shows the shoe of FIG. 1A, after it has been laced. End 104 of lace 100 has an adjustable stopper or knot 105, which has not yet been pulled under the stationary retainer eyelet R1.

Lace 100 is comprised of Top segments, Middle segments, and Bottom segments. The four (4) top lace segments T1,T2,T3,T4 (FIG. 1D) extend from movable fastener 120 to the right side of the shoe. Middle lace segments M1,M2, M3,M4 continue downward from the right side of the opening to the left side of the opening. Segment M1 creates a gap with the left side of the opening, providing extra room for the user to insert or remove the foot. Bottom segments B1,B2,B3 continue from the left side to the right side.

Figure 1C:
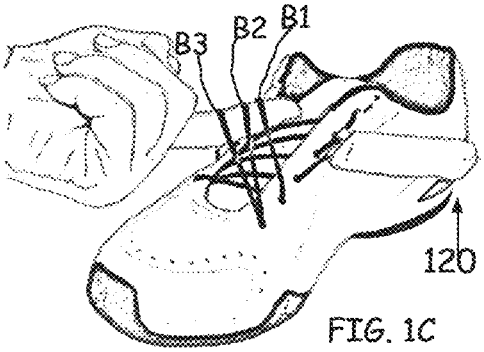
FIG. 1C shows the user lifting three (3) segments, unimpeded, which helps determine that he has laced the shoe correctly.

Bottom segments B1,B2,B3 are layered above the middle segments M2,M3,M4 as shown in FIGS. 1B-1C. FIG. 1C shows the users' fingers lifting segments B1,B2,B3 unimpeded by the middle segments underneath, which also helps indicate that the lacing is correct.

Figure 1D:
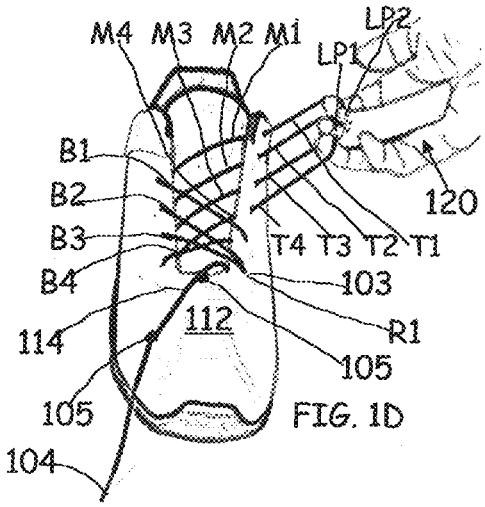
FIG. 1D is the shoe of FIG. 1B, and shows the user pulling on the movable fastener, using his three (3) fingers for a firm pull, which pull directly to the bottom of the shoe.

FIG. 1D shows the user inserting his three (3) fingers into the three (3) loops created by the four (4) top segments T1,T2,T3,T4 extending from eyelets LP1, LP2 of movable fastener 120 to the right side of the adjustable opening, thus simultaneously exerting a direct pull on all the middle segments M1,M2,M3,M4 that go straight from movable fastener 120, to the bottom 112 of the adjustable opening. With his three (3) fingers in the loops, the user pulls, shifts or wiggles the movable fastener back and forth in an arc, causing substantially all the lace segments to flow through all the eyelets of the adjustable opening and the movable fastener, (except where anchored) and to instantly align for a tight and even fit.

After the user has determined that the fit is correct and the lace segments are equally taut, he makes a knot 105 (or moves knot 105) in the free end 104, near stationary retainer, eyelet R1, and either cuts the excess of the free end at 114, or tucks the remainder of the lace under the side of the opening.

Figure 1E:
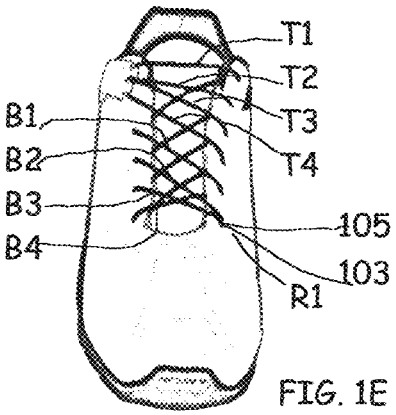
FIG. 1E is the shoe of FIG. 1B in the fastened position.
Figure 1F:
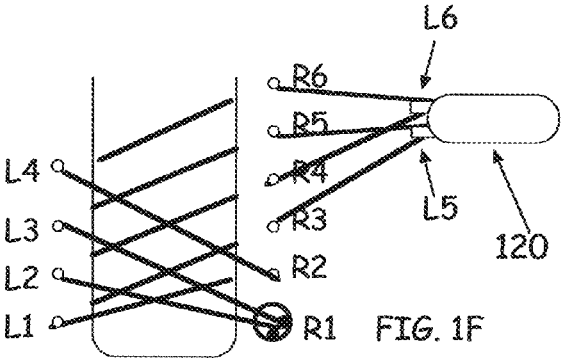
FIG. 1F is a diagram of the lacing of FIGS. 1B-1E.

The shoe in FIG. 1E, is in the fastened position, and knot anchor 103, and knot anchor 105 in the free end, are both disposed under stationary retainer, eyelet R1. FIG. 1F shows the angles that bottom segments L2-R1 and L1-R2 form at the bottom 112 of the adjustable opening.

Figure 2A:
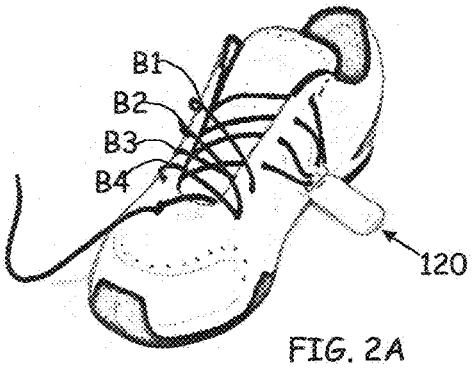
FIG. 2A shows a front view of a right shoe, embodiment A2, in the unfastened position, showing the upper layers of lace segments totally above the lower layer of lace segments.
Figure 2B:
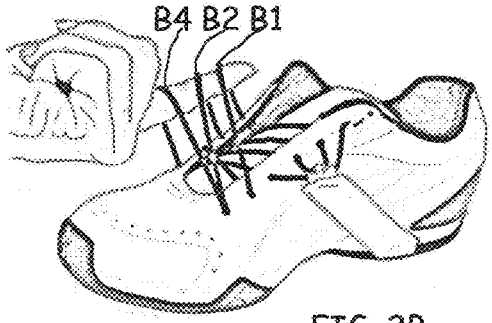
FIG. 2B is the shoe of FIG. 2A, in the unfastened position, showing the user checking that the upper lace segments are layered above the lower layer of lace segments, to help verify that he has laced the shoe correctly.

FIGS. 2A-2E show embodiment A2. FIG. 2A shows embodiment A2, after it has been laced, but not yet customized. FIG. 2B shows the user inserting his finger under segments B1,B2,B4 confirming that they are layered above the middle lace segments which are underneath, indicating that the lacing has been done correctly. A pull on movable fastener 120, pulls segments T1,T2,T3,T4 which pull on middle segments M1,M2,M3,M4 simultaneously, and pull directly to the bottom 112 of the adjustable opening.

Figure 2C:
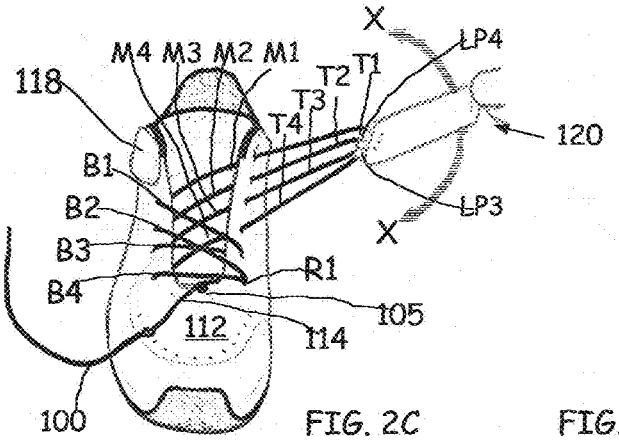
FIG. 2C is the shoe of FIG. 2A showing the user shifting the movable fastener back and forth, to align the lace segments in the adjustable opening.

FIG. 2C shows the user shifting moveable fastener 120, back and forth in an arc, designated by arrow X. This pulling (shifting, shaking, or wiggling) motion causes the four (4) segments of lace 100 to flow through eyelets LP3,LP4 of the movable fastener and the eyelets of the adjustable opening, and evens out and adjusts all the segments of the adjustable opening instantly and in unison, assuring a tight and even fit. When all the segments are equally taut and movable fastener 120 is engagable with fixed fastener 118, the user makes a knot 105 in lace 100, near stationary retainer, eyelet R1. He cuts lace 100 past knot 105 at 114 (or tucks the lace in the shoe). This "gross" adjustment is done once and sets or fixes the maximum width of the adjustable opening in the fastened position, and therefore customizes the shoe for the width of the users foot. The user need only concern himself with "fine" adjustment thereafter, each time he fastens his shoe, i.e. engaging movable fastener 120, with the fixed fastener 118.

Figure 2D:
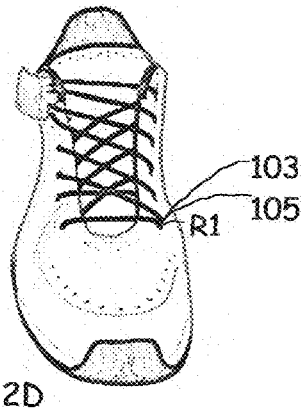
FIG. 2D is the shoe of FIG. 2A in the fastened position.

FIG. 2D shows the shoe of embodiment A2 after the shoe has been laced and the width of the opening has been customized. End anchor knots 103 and 105 are not visible and are under stationary retainer R1, and the shoe has been fastened by the hook and loop fastener, i.e. fine adjustment.

Figure 2E:
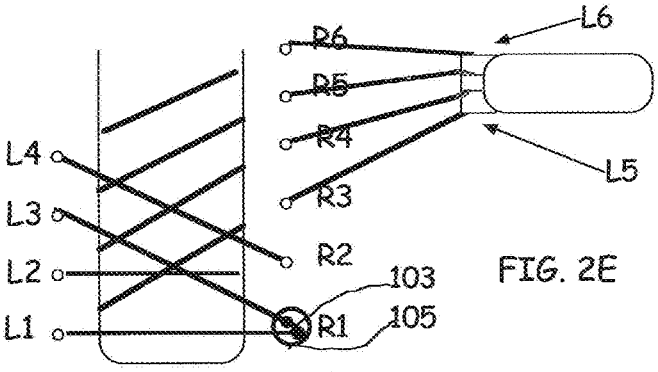
FIG. 2E is a diagram of the lacing of FIGS. 2A-2D.

FIG. 2E shows the horizontal segment on the bottom 112 of an adjustable opening. Horizontal segment L1-R1, at the bottom of the adjustable opening has utility for dynamic dual adjustability as shown in FIG. 3C, a center retainer as shown in FIG. 6B, or a logo attachment.

Figure 3A:
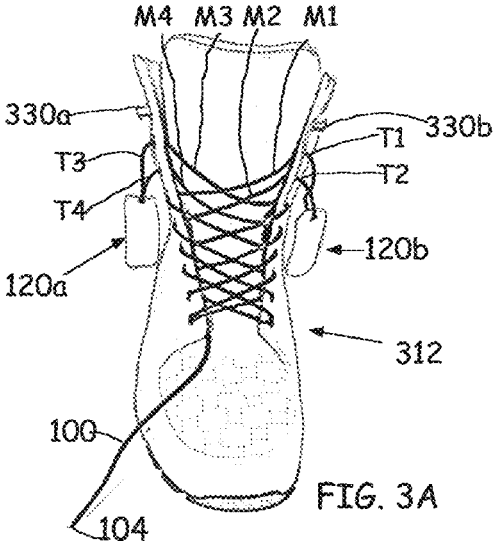
FIG. 3A is a front view of a boot, embodiment B, with two (2) movable fasteners, one (1) lace, in the unfastened position.
Figure 3B:
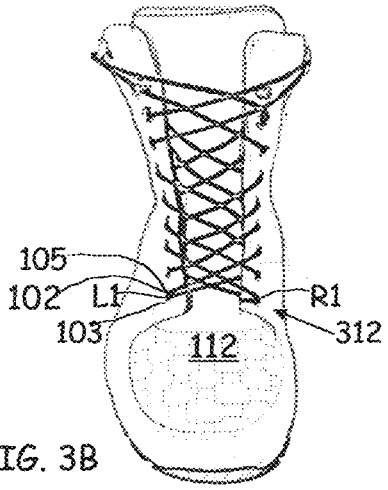
FIG. 3B is the boot of FIG. 3A in a fastened position.
Figure 3C:
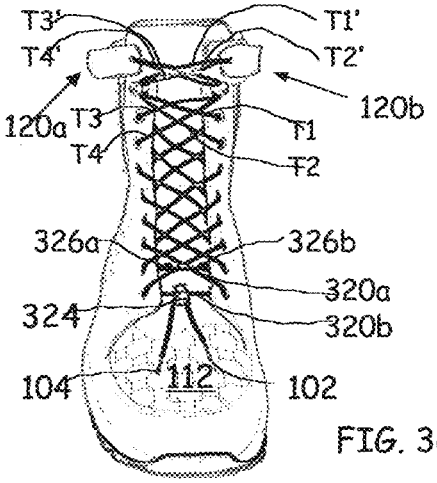
FIG. 3C is a front view of embodiment B having one (1) lace, that is dually adjustable.

FIGS. 3A-3B show embodiment B of the present invention. It has two (2) moveable fasteners 120*a* and 120*b*, one (1) lace 100, and two (2) hooks or knobs 330*a*,330*b*. Lace ends 103 and 105 are anchored at stationary retainer, eyelet L1. Knot 105 is adjustable, to enable the user to customize the adjustable opening for a wider or narrower foot (i.e., gross adjustment). For a wider foot the user moves knot 105 down further towards the free end 104 of lace 100. For a narrower foot, the user moves the knot 105 in the other direction. The end anchors set the maximum width of the adjustable opening in the fastened position. Interior anchor 312 at eyelet R1, and the two (2) end anchors 103,105, under stationary retainer eyelet L1, insure that the movable fasteners 120*a*, 120*b* maintain their distance from the sides of the boot that was set by the user or manufacturer during customization. The manufacturer may set an equal or unequal distance of the movable fasteners from the sides of the shoe (depending on the position of the fixed fasteners). In either case the distance of the movable fasteners from the sides of the shoe, set by the manufacturer (or user) is maintained with the inclusion of the interior anchor.

A gap is formed at the top of the adjustable opening by middle segments M1 and M3 when the shoe is in the unfastened position. The gap provides extra room for the user to insert or remove his foot. The gap is covered by top segments T1 and T3 when the shoe is fastened.

Figure 3D:
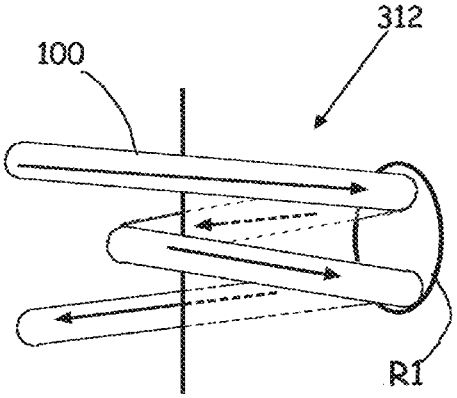
FIG. 3D is a detailed front view of an interior anchor created by the lace being wrapped around or encircling eyelet R1, as shown in FIGS. 3A-3B.

FIG. 3D is a detailed view of interior wrap-around anchor 312. The interior anchor is adjustable and positioned on bottom segments as far from the movable fasteners 120*a*, 120*b* as possible. FIG. 3D shows lace 100, wrapped around or encircling eyelet R1, thus creating a stationary and adjustable interior anchor 312, at eyelet R1.

FIG. 3B shows the boot of FIG. 3A, embodiment B in the fastened position. The movable fasteners 120*a*,120*b* did not utilize the optional hooks or knobs 330*a*,330*b*.

FIG. 3C shows the boot of embodiment B. Lace segments 320*a*,320*b*, at the bottom 112 are horizontal. A cord-lock 324 can be disposed on bottom segment 320*b*, without interfering with the smooth alignment of the other lace segments. Cord-lock 324 is preferably stationary. It can be made stationary by attaching two (2) tubes 810*a*,810*b* as shown in FIG. 8E, which prevent cord-lock 324 from shifting. Cord-lock 324 could alternatively be hooked or sewn, etc. to the shoe. Stationary cord-lock 324 anchors the two (2) lace ends 104,102 with it's spring, permitting dynamic "fine" adjustment at the bottom 112 of the boot, thus also providing the user with further dual "fine" adjustability, (i.e. adjustability at the toe as well as the ankle or top). Cord-lock 324 on a bottom segment also provides "gross" adjustment, to customize the adjustable opening for a wide, medium, or narrow foot. Interior anchors 326*a*,326*b* are adjustable knots and are anchored by the two (2) stationary eyelet retainers on either side. Interior anchors 326*a*,326*b* are stationary, since they cannot move in either direction. Interior anchor knots 326*a*, 326*b* in conjunction with the anchored ends 102,104 in cord-lock 324 maintain the maximum distance (set during customization) of the movable fasteners 120*a*,120*b* from the sides of the adjustable opening, and set the maximum width of the adjustable opening in the fastened position. A single knot would also work on segment 320*a*, since movement in each direction is minimal and limited by the two (2) eyelet retainers, however, two (2) knots are preferred because they are disposed under or near the eyelet retainers and do not interfere with the smooth alignment of the other lace segments. The two (2) interior stoppers (anchor knots) could be disposed under the left eyelet retainer L2 and the right eyelet retainer R2. Alternatively, one interior stopper 326*c*, could be disposed above retainer L2, and the other interior stopper 326*a*, could be disposed below retainer L2, as shown in FIG. 8B. Or segment 320*a* could be anchored to a hole at the top of the cord-lock retainer 324 by encircling the hole as shown in FIG. 3D, thus the interior anchor 312, and the two (2) end anchors, are anchored to one (1) retainer.

Figure 3E:
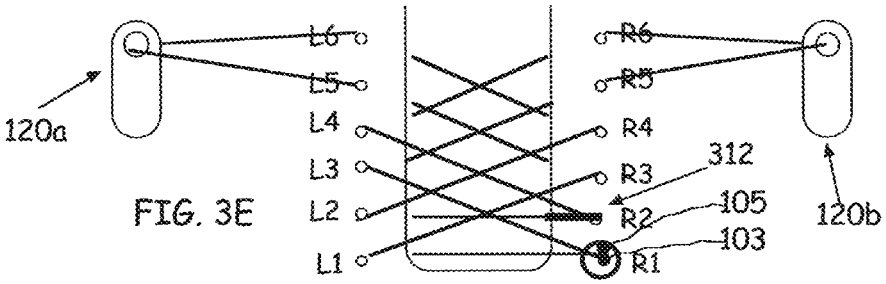
FIG. 3E is a view of an adjustable opening having two (2) movable fasteners, and six (6) eyelets per side, an interior anchor encircling R2, two (2) end anchors at R1, and one (1) lace.

FIG. 3E shows embodiment B, having two (2) end anchors at R1, and one (1) interior wrap around anchor at R2, six (6) eyelets per side, and one (1) lace. The anchors are disposed in an anchor area, which is the area of the adjustable opening below R3 and L3.

Figure 4B:
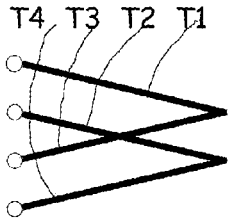
FIG. 4B shows two (2) segment loops, side by side, and one segment loop has moved to the other side.
Figure 4B:
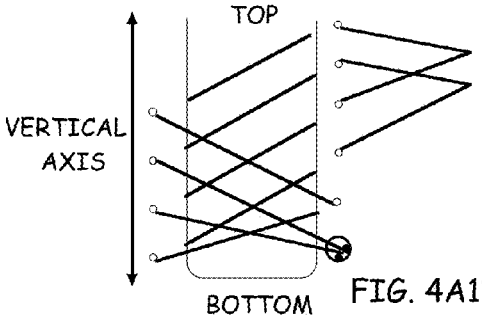
Figure 4B:
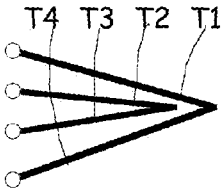
Figure 4B:
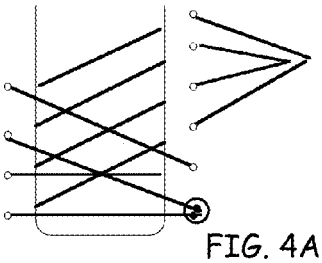
Figure 4B:
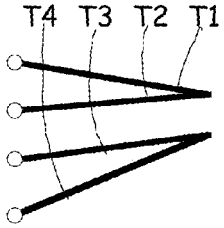
Figure 4B:
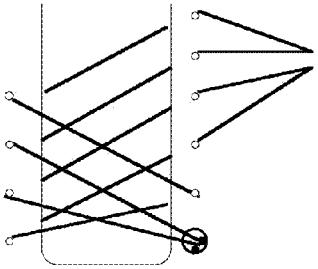
Figure 4B:
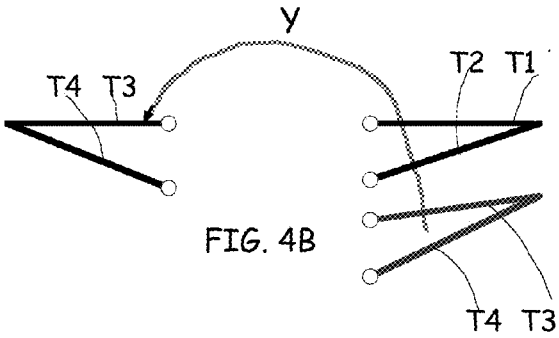
Figure 4B:
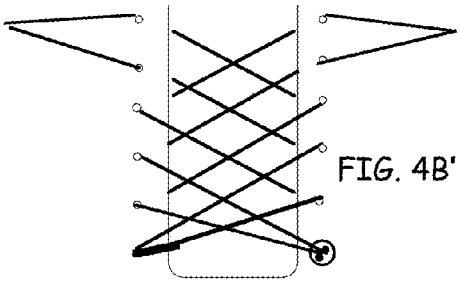
Figure 4C:
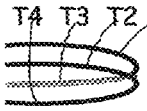
FIG. 4C shows the two (2) segment loops of embodiment A pattern 1, i.e., A1.

Referring to FIGS. 4A1-4B', two (2) segment loops are movably attached to movable fastener 120, and create four (4) segments which pull all the lace segments in the adjustable opening in unison. The position of the two (2) segment loops determine which embodiment, A or B is created. Each segment loop forms two (2) segments. The four (4) segments of the two (2) segment loops can be crossed as shown in FIG. 4A1, creating embodiment A1. The four (4) segments of the two (2) loops can be disposed within each other as shown in FIG. 4A2, creating embodiment A2. The four (4) segments of the two (2) loops can be disposed side by side as shown in FIG. 4A3, creating embodiment A3.

FIGS. 4A1-4A3' shows the structure of the four (4) lace segments attached to the movable fasteners of embodiments A1,A2,A3.

FIG. 4A1 shows the four (4) top segments, T1,T2,T3,T4, with segments T2 and T3 crossing each other, forming embodiment A1, shown in FIGS. 1A-1F.

FIG. 4A1' shows an adjustable opening laced according to FIG. 4A1.

FIG. 4A2 shows the four (4) top segments, T1,T2,T3,T4 with segments T2,T3 disposed within segments T1,T4 forming embodiment A2, shown in FIGS. 2A-2E.

FIG. 4A2' shows an adjustable opening laced according to FIG. 4A2.

FIG. 4A3 shows the four (4) top segments, T1,T2,T3,T4, with segments T1,T2 disposed next to segments T3,T4, forming embodiment A3.

FIG. 4A3' shows an adjustable opening laced according to FIG. 4A3.

FIG. 4B shows the four (4) top segments, T1,T2,T3,T4, with segments T1,T2 initially disposed next to segments T3,T4, however, segments T3,T4 are moved to the other side of the shoe, in the direction of arrow Y. The two (2) segments on either side of the adjustable opening, attach to two (2) movable fasteners and form embodiment B, which has two (2) movable fasteners, one on each side of the shoe, as shown in FIGS. 3A-3E.

FIG. 4B' shows an adjustable opening laced according to FIG. 4B.

Figure 4D:
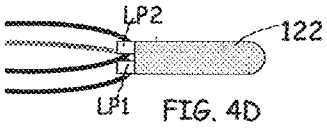
FIG. 4D shows FIG. 4C attached to a hook and loop movable fastener having two (2) loop eyelets.
Figure 4E:
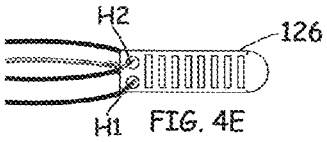
FIG. 4E shows FIG. 4C attached to a movable fastener with slots having two (2) hole eyelets.
Figure 4F:
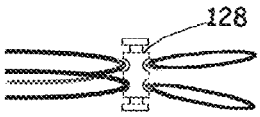
FIG. 4F shows FIG. 4C attached to a cord lock movable fastener having two (2) holes.
Figure 4K:
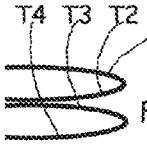
FIG. 4K shows the two (2) segment loops of embodiment A pattern 3, i.e., A3.

FIGS. 4C-4F represent the movable fastener structure of embodiment A1. The two (2) inner segments of the two (2) loops cross each other. FIG. 4D shows embodiment A1 attached to a hook and loop fastener 122 by two (2) eyelet loops, LP1,LP2. FIG. 4E shows the two (2) crossed segment loops attached to a movable fastener, with slots 126 that engage with an adjustable buckle on the shoe (not shown), and the two (2) segment loops are attached to the movable fastener by eyelet holes, H1,H2. FIG. 4F shows the two (2) crossed segment loops attached to the two (2) holes in a cord lock 128, which hook onto a fixed fastener 518 as shown in FIGS. 6C,7B.

Figure 4L:
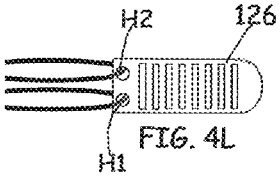
FIG. 4L shows FIG. 4K attached to a movable fastener with slots having two (2) hole eyelets.
Figure 4M:
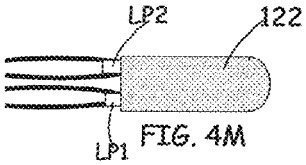
FIG. 4M shows FIG. 4K attached to a movable fastener with locking tape having two (2) loop eyelets.
Figure 4N:
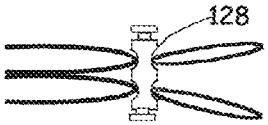
FIG. 4N shows FIG. 4K attached to a cord lock movable fastener having two (2) holes.
Figure 4G:
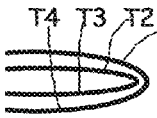
FIG. 4G shows the two (2) segment loops of embodiment A pattern 2, i.e., A2.
Figure 4H:
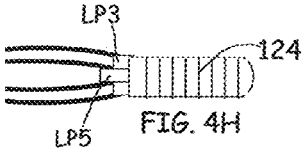
FIG. 4H shows FIG. 4G attached to a movable fastener with teeth having two (2) loop eyelets, which are disposed within each other.
Figure 4I:
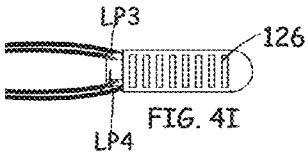
FIG. 4I shows FIG. 4G attached to a movable fastener with slots having two (2) loop eyelets which are disposed on top of each other.
Figure 4J:
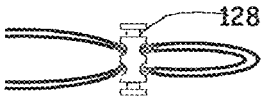
FIG. 4J shows FIG. 4G attached to a cord lock movable fastener having two (2) holes.
Figure 4O:
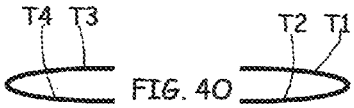
FIG. 4O shows the two (2) segment loops of embodiment B, which has two (2) movable fasteners that are separated, one movable fastener is on each side of the adjustable opening.

FIG. 4G-4J represent the movable fastener structure of embodiment A2. The two (2) segment loops are disposed inside each other. FIG. 4H shows a movable fastener with eyelet loop LP5 surrounding eyelet loop LP3, and a movable fastener with teeth 124, for a ratchet fastening. The two (2) segment loops attach to FIG. 4I by two (2) lugs or eyelet loops, LP3, LP4 that are on top of each other, and the movable fastener of FIG. 4I has slots 126 that hook onto a fixed fastener adjustable buckle (not shown). FIG. 4J shows two (2) segment loops attached to the two (2) holes in cord-lock 128 as shown in FIGS. 6C,7B.

FIGS. 4K-4N represent the movable fastener structure of embodiment A3. The two (2) segment loops are disposed side by side. FIG. 4L shows the two (2) segment loops attached to slotted movable fastener 126, by two (2) eyelet holes, H1, H2. FIG. 4M shows the two (2) segment loops attached by lugs or eyelet loops LP1,LP2 on movable fastener 122 that is locking tape. FIG. 4N shows the two (2) segment loops attached to cord lock 128.

Figure 4P:
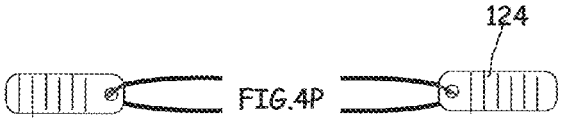
FIG. 4P shows FIG. 4O attached to movable fasteners having teeth.
Figure 4Q:
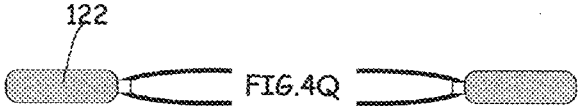
FIG. 4Q shows FIG. 4O attached to movable fasteners that are locking tape, or hook and loop.
Figure 4R:
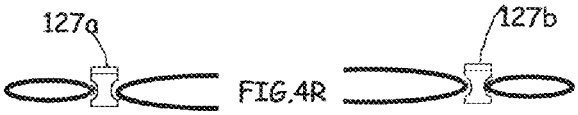
FIG. 4R shows FIG. 4O attached to movable fasteners that are cord locks having one (1) hole, that attach to each other.
Figure 4S:
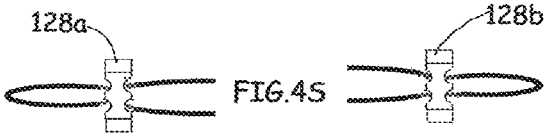
FIG. 4S shows FIG. 4O attached to movable fasteners that are cord locks having two (2) holes, that hook onto hooks.

FIGS. 4O-4S represent the movable fastener structure of embodiment B. The two (2) segment loops are separated, and are on either side of the adjustable opening. FIG. 4P shows the segment loops attached to two (2) movable fasteners with teeth 124, i.e., ratchet fasteners. FIG. 4Q shows the segment loops attached to two (2) locking tape 122 movable fasteners. FIG. 4R shows the two (2) segment loops attached to cord locks having one (1) hole that snap or hook together, as shown in FIGS. 5D-5F. FIG. 4S shows the segment loops attached to cord locks having two (2) holes, that can be hooked onto fixed fastener hooks on either side of the shoe as shown in FIGS. 8F-8F'.

The two (2) segment loops of embodiment A are preferably attached to the movable fastener by two (2) separate eyelets, but could have been combined and attached to the movable fastener by only one (1) eyelet.

FIGS. 5A-5G shows embodiments A and B on shoes having five (5) eyelets per side. FIGS. 6A-6G shows embodiments A and B on shoes having six (6) eyelets per side. FIGS. 7A-7F' shows embodiments A and B on shoes having seven (7) eyelets per side. FIGS. 8A-8F" shows embodiments A and B on shoes having eight (8) eyelets per side.

FIG. 5A shows embodiment A1. The lace segments at the bottom, B2 and B3 are angled, and the two (2) end anchors 103,105 are under eyelet R1. End anchors 103, 105, under eyelet R1 may be knots, which are adjustable, or crimped or sewn etc. Segments B1,B2 are disposed entirely above the segments M2,M3,M4 and therefore do not interfere with the smooth alignment of the segments in the opening. The moveable fastener 120, has two (2) holes H1,H2. Angle 502*b* of the movable fastener corresponds to angle 502*a* near the fixed fastener, for an adjustable opening that widens towards the top. Three (3) middle segments M1,M2,M3 are pulled by segments T1,T2,T3, directly to the bottom of the adjustable opening, for instant alignment and a tight fit. Middle segment M4 merges with bottom segment B3. The structure of embodiment A is such that:

a) A gap is formed by middle segment M1, and the left side, 502*a* of the adjustable opening, when the shoe is in the unfastened position.

b) At least two (2) top segments T1,T2 cover the gap when the shoe is fastened.

c) Three (3) top segments T2,T3,T4 cross over three (3) middle segments M1,M2,M3 of the adjustable opening when the shoe is fastened.

d) At least two (2) bottom segments B1,B2 cross at least one (1) middle segment M3, of the adjustable opening.

FIG. 5B shows embodiment A2, segments 320*a*, 320*b* are horizontal. The movable fastener 120 has two (2) lugs or eyelet loops LP3,LP5 in which LP5 surrounds LP3. Horizontal segment 320*b* has advantages since it doesn't touch the other segments in the adjustable opening. Segment 320*b*, may be used to attach a logo, a retainer as shown in FIG. 8E', or a cord-lock having a spring which anchors the ends for dynamic dual adjustability as shown in FIG. 8E.

FIG. 5C shows embodiment A3. The movable fastener 120 has two (2) holes, H1,H2 that are disposed side by side. The fixed end is stitched 101, and retained by the side of the shoe, near eyelet R1; or sewn into the edge or seam of the adjustable opening near eyelet R1. The free end 104, is knotted 105 under retainer R1, for adjustability. Since lace end 101 is sewn, the lace in this version is not replaceable, but it is adjustable, by moving knot 105. However, to make the lace of FIG. 5C replaceable, the user may remove the stitches 101 or cut the lace at 101. "Gross adjustability" is performed by moving the knot, and "fine adjustability" by the varying the position of the moveable fastener on the fixed fastener.

FIG. 5D shows embodiment B which has two (2) laces 100,500. Lace 100 has two (2) end anchors 103,105 under eyelet L1. Lace 500 has two (2) end anchors 503,505 under eyelet R1. The end anchors or stoppers 103,105,503,505 may be knots (which are adjustable) or sewn or crimped, or a combination. The four (4) bottom anchored segments B1,B2,B3,B4 fix the maximum distance of the two (2) movable fasteners to the two (2) sides of the adjustable opening, setting the maximum width of the adjustable opening in the fastened position (i.e., gross adjustment).

FIG. 5F shows FIG. 5D in the fastened position. The top segments of the two (2) moveable fasteners cross each other, wrap around hooks or knobs 330*a*, 330*b*, and then attach to each other in the middle of the adjustable opening. Cord-locks 127*a*,127*b* can either hook (not shown) or snap together as shown in FIG. 5E. Cord-lock 127*a* has a snap member 127*c* which snaps into cord-lock 127*b*. The user compresses the cord-locks allowing the top lace segments to flow through its' holes and change the size of the adjustable opening for fine adjustment. Since this configuration requires no change to the shoe, it can be sold an after market item. Hooks 330*a*,330*b* could be attached to the top eyelets. Button 127*d* is pressed to release the attached cord locks.

Embodiments A and B having cord-lock movable fastener (s) may be sold as an after market lacing system, since no modification to the shoe is required for installation.

FIG. 5G shows embodiment B with one (1) lace, end anchors 103,105 at retainer L1, and an interior adjustable knot anchor 326*a*, on bottom segment B2 under L2, and another interior adjustable knot anchor 326*b*, on bottom segment B4 under R2. The two (2) adjustable end anchors 103,105 fix the maximum width of the adjustable opening in the fastened position. The interior knot anchors combined with the end anchors set the maximum distance of the movable fasteners from the sides of the opening and fix the maximum width of the adjustable opening when fastened, thus customizing the width of the shoe for further fine adjustment.

FIG. 5H is prior art, and is shown FIG. 7D in Freed U.S. Pat. No. 6,941,683. The anchors in FIG. 5G are hidden under retainers L2,R2,L1 and FIG. 5G and FIG. 5H are alike (except for the anchors). Since prior art FIG. 5H does not anchor the four (4) top segments, the movable fasteners 120*a*,120*b* shift during use, and the distance 522*a*,522*b* of the movable fasteners to the sides of the shoe is not maintained, causing movable fasteners 120*a*,120*b* to shift and mis-align with the fixed fasteners 118*a*, 118*b*, and thus preventing the shoe from fastening. This shifting is caused by the unequal pull on the movable fasteners during use. The secondary interior anchor(s) of the present invention prevent (s) this shifting and misalignment. All four (4) top segments T1,T2,T3,T4 in FIG. 5G are anchored by the four (4) anchors. Prior art, FIG. 5H, does not teach anchoring technology, and thus the movable fasteners shift out of alignment and will not fasten.

Interior anchors are not necessary for embodiment A, since the two (2) segment loops move together, and can't get out of alignment. However a second set of anchors are preferred embodiment A, to facilitate alignment, because they reduce the friction created by a long opening, i.e., seven (7) or eight (8) eyelets.

Anchor Retainer Summary

The present invention has three (3) types of anchors; 1) end anchors 2) interior anchors and 3) dynamically adjustable end anchors. Anchors can be either "primary end" anchors or "secondary" anchors. The primary end anchors are the anchors at the two (2) ends of the first lace. The secondary anchors are either interior anchors or the anchors at the two (2) ends of the second lace.

1) The anchor can be a stopper which stops the lace from moving through the hole of the retainer. The bulge or stopper can be adjustable (such as a knot, a fold-over clasp, or the lace wrapped around an o-ring), or not adjustable (such as a crimp, the hard bulge formed by singeing the end of a synthetic lace, or stitches). Stoppers can be end anchors or interior anchors. Stitches anchor the lace, and retain it, near the eyelet's hole. The sides of the adjustable opening are stationary retainers, and retain the lace with either the hole of an eyelet or stitches near an eyelet.

2) The anchor can be the lace wrapped around or encircling a retainer's hole, which prevents the lace from moving through the hole during alignment. The wrap around anchor is adjustable, and is an interior anchor.

3) The anchor can be the spring in a cord-lock that compresses the lace end(s) so it doesn't move through the hole. The cord-lock is dynamically adjustable, and is an end anchor.

Summary of Lacing, Anchoring, and Retainer Configurations for Embodiments A and B Embodiments A and B may have one (1) or two (2) laces. The anchors are on bottom segments at, or near, the bottom of the adjustable opening. Embodiment A has at least two (2) bottom segments. Embodiment B has four (4) bottom segments. Bottom segments B1,B2,B3,B4 may continue into B1',B2',B3',B4' and into B1",B2",B3",B4" etc., depending on the embodiment, the number of eyelets, and the lacing pattern in the adjustable opening.

Embodiment A having one (1) lace:

a) has two (2) end anchors on two (2) bottom segments, anchored by at least one (1) retainer, or b) has two (2) end anchors and an interior anchor, and is anchored by at least two (2) retainers;

Embodiment A having two (2) laces:

(a) has two (2) end anchors on the two (2) bottom segments of the first lace, and two (2) end anchors on the two (2) bottom segments of the second lace, and the four (4) bottom segments are anchored by at least two (2) retainers.

Embodiment B having one (1) lace:

(a) has two (2) end anchors and an interior anchor, and is anchored by at least One (1) retainer.

Embodiment B having two (2) laces:

(a) has two (2) end anchors on the two (2) bottom segments of the first lace, and two (2) end anchors on the two (2) bottom segments of the second lace. The four (4) bottom segments are anchored by at least one (1) retainer.

Interior anchors are useful for embodiment A having one (1) lace if there are seven (7) or eight (8) eyelets, to facilitate the speed and alignment of the adjustable opening with more than six (6) eyelets per side. End anchors disposed on a horizontal bottom segment, as with embodiment B (FIG. 3C), or embodiment A (FIG. 6B), may be held by a cord lock retainer as shown in FIG. 8E. The anchors reduce friction and are preferably stationary, such as the anchors at the eyelets on the sides of the adjustable opening, thus facilitating the alignment of the lace segments in the adjustable opening.

The adjustable opening of a shoe expands and contracts the most at the top, (near the ankle), to give the user room to insert or remove his foot. The adjustable opening expands or contracts the least at the bottom, (near the toe). The end anchors and interior anchors are positioned at, or near, the bottom of the shoe, so as not to restrict the expansion and contraction of the shoe at the top (near the ankle) where it is needed. The anchors and retainers are in the anchor area at the bottom of the adjustable opening. The anchor area, is the area of the adjustable opening that includes the two bottom-most eyelets on the right side (R1,R2); the two bottom-most eyelets on the left side (L1,L2); and extends down to the bottom 112, of the adjustable opening. The anchors fix or set the maximum width of the adjustable opening when in the fastened position, thus providing "gross adjustment" for any width foot, i.e., narrow, medium, or wide. This is done when the user first customizes his shoes or when the width is set at the factory.

The movable fastener (which could be either locking tape, a strap with teeth or slots, or a cord-lock), then provides the user with "fine adjustment", each time the user fastens his shoes. Since the "gross adjustment" is set or fixed, the movable fastener need adjust only within a narrow range, further contributing to quick alignment and easy fastening. The movable fastener provides "fine" adjustment which could be "discrete" or "continuous", depending on the users preference. "Discrete" fine adjustment is provided by the teeth of the movable fastener which engage with a ratchet receptor, or the slots in the movable fastener which engage with an adjustable buckle. "Continuous" fine adjustment is provided by a locking tape fastener (such as hook and loop) or a cord lock movable fastener with a spring.

The anchors at the bottom of the adjustable opening, may be disposed at or near an eyelet, at or near the hole, or they may be disposed at a retainer within the adjustable opening, as shown in FIG. 6B, if they do not interfere with the other lace segments, i.e., where the lowest segment is horizontal. The anchors of the present invention are preferably stationary and attached to a stationary retainer. Stationary anchors reduce friction thus further facilitating alignment of the lace segments. Anchors attached to a hole, or near the hole, of an eyelet, which is attached to the side of the shoe, are stationary and preferred. A variety of end anchors and interior anchors in the adjustable opening are shown in FIGS. 8A-8F". In FIG. 8E, cord lock 324 anchors the lace ends, and makes the shoe dynamically, dually adjustable. Alternatively retainer 602, FIG. 8E', could be sewn or hooked etc. to the bottom of the shoe to retain the two (2) end anchors that are on bottom segments B2", B4". The interior anchor may be comprised of two (2) knots 326*a*, 326*b* shown in FIG. 8E". It is also stationary, since knots 326*a*,326*b* prevent segment L2-R2 from moving in either direction. Cord-lock 324, in FIG. 8E may be sewn, hooked, or have tubes 810*a*, 810*b*, on the segments of either side, to keep it stationary.

Embodiments A and B which have only one (1) lace, have two (2) end anchors, on two (2) bottom segments. Embodiment B having one (1) lace, also has interior anchor(s) to maintain the maximum distance of the movable fasteners 120*a*, 120*b* to the sides of the adjustable opening. Embodiment A having two (2) laces, as shown in FIG. 6C, also has four (4) end anchors. Two (2) end anchors on bottom segments B3,B4 and two (2) end anchors on bottom segments B1,B2, that are held by retainers R1,R2. The additional two (2) end anchors facilitate alignment, and may be used with embodiment A3, FIG. 6C, to vary snugness at the top and bottom of the adjustable opening. The snugness at the top and bottom of the instep can be independently adjusted in FIG. 6C by the cord-lock movable fastener.

There are three (3) segment types (Top, Middle, & Bottom). Top segments T1,T2,T3 continue into T1',T2',T3', etc. shown in FIGS. 5F, and 8F' depending on the number of knobs or hooks there are above the top eyelets. Middle segments are M1,M2,M3,M4. Bottom segments B1,B2,B3, B4 continue into B1',B2',B3',B3' and into B1",B2",B3",B4" etc. as shown in FIG. 8D. (depending on the number of eyelets to the bottom 112 of the adjustable opening). The end anchors and interior anchors are disposed on the bottom segments (either B,B', B" etc.), at or near the bottom of the adjustable opening, and therefore, the retainers, that hold the anchors, are also disposed at, or near, the bottom of the adjustable opening.

The end anchor knots or stoppers are preferably anchored "under" an eyelet or stationary retainer, so they are not visible and do not interfere with the lacing pattern. The anchored bottom segments in FIG. 1C, preferably approach the eyelet retainer R1 from the top, so the anchored segments lie "above" the segments they cross, which reduces crossing friction and facilitates the smooth alignment of the laces in the adjustable opening. The ends may be anchored at the same retainer, or individually at different retainers. The ends are anchored under a stationary retainer, by a knot, crimp, clasp, singe, sewn, etc., or may be anchored by the spring of a cord-lock retainer as in FIG. 3C.

A stationary retainer, such as an eyelet, is preferably disposed "above" the knotted end anchors because it applies pressure to the knot, holds it in place, and also prevents the knot from being effected by the environment. The two (2) ends of the lace are knotted or anchored individually, and may be anchored at the same retainer or different retainers. Individual end anchors are preferable for the following five (5) reasons:

1) A single knot on each lace end, is stronger than two (2) lace ends knotted together.

2) Each end has a different function, i.e., The fixed end 102, functions to anchor the lace for threading. The free end 104, is used to thread all the eyelets, and is also used for "gross" adjustment (i.e. moving the knot 105, to a different position on the bottom segment) to change or customize the width of the adjustable opening for different width feet.

3) Individual end anchors permit different anchoring choices for each end, e.g. the fixed end 102 could be sewn, crimped, or singed near the retainer, while the free end 104 could be knotted 105 as shown in FIGS. 8F-8F', or inserted into a spring cord-lock, so it is dynamically adjustable.

4) Two (2) individual knots or anchors are less bulky under the retainer, than the knot created by two (2) lace ends knotted or attached together.

5) An individual knot on a lace end, prevents the lace end from unraveling.

The types of anchors, the number of anchors, and the position and structure of the anchors and retainers in the adjustable opening, are significant factors in determining the speed and ease of fastening and unfastening of the adjustable opening.

FIG. 9F, FIG. 9G, and FIG. 9H are embodiment A2 having eight (8) eyelets. The difference between FIG. 9F and FIG. 9G is the position of the anchors. The difference between FIG. 9F and FIG. 9H is the type of secondary anchor and the fact the FIG. 9H has two (2) laces. The position of the anchors in FIG. 9F is preferred over FIG. 9G. The lace segments of FIGS. 9F,9G,9H are pulled by the movable fastener starting from R8,R7,R6,R5. The fewer turns a lace makes before it stops at an anchor, the more efficiently the adjustable opening aligns. Referring to FIG. 9G, bottom segments B3' and B1' are anchored at retainer L2, and bottom segments B2' and B4' are anchored at retainer L1. Each of the four (4) anchored segments B1', B2',B3',B4' turns exactly twice before anchoring. Each prime indicates another turn (i.e., segment B1 has one (1) turn, segment B1' has two (2) turns, and segment B1" has three turns etc.) In FIG. 9G however, B3 turns once, and segment B1" turns three (3) times prior to anchoring at eyelet R2; and segment B4 turns once and segment B2" turns three times prior to anchoring at eyelet R1. This results in an uneven pull from R8,R7,R6,R5, and the laces that turn three (3) times (segments B1" and B3") do not align as quickly or efficiently. Hence FIG. 9F aligns more efficiently than FIG. 9G, due to the preferred placement of the anchors.

The anchors in FIG. 9H are in the same preferred position as the anchors in FIG. 9F. Although FIG. 9F has one (1) lace and FIG. 9H has two (2) laces, both configurations align efficiently and although their anchors are different, they are at the same preferred positions (i.e., L1 and L2) for this configuration.

The diagrams in FIGS. 10A-24B show the two (2) or three (3) stage method of lacing various patterns of embodiment A and B having one (1) or two (2) laces, and show the preferred placement and types of the primary and secondary anchors for each configuration.

Detailed Description of the Exemplary Embodiments Having 6, 7 and 8 Eyelets

FIG. 6A-6G shows the shoes of the present invention, embodiments A and B with six (6) eyelets. The detailed description of the present invention for shoes with more eyelets is similar, and other exemplary embodiments are shown in detail.

FIG. 6A shows embodiment A1 and the two (2) end anchors under the stationary eyelet retainer R1. The fastener of FIG. 6A is an adjustable buckle, the movable fastener has slots 126, which engage with a fixed fastener (not shown), which hooks into one of the slots (i.e., discrete fastener).

FIG. 6B shows embodiment A2. The eyelets at each side of the adjustable opening could be holes or lugs. The lugs are usually flat loops made of fabric, but could be plastic or metal hooks, rings, or tubes (not shown). The eyelets on the two (2) sides of the adjustable opening in FIG. 6B are eyelet loops or lugs. The movable fastener has teeth 124 (i.e., discrete fastener), which engage with a fixed fastener that is a ratchet buckle (not shown). A stationary retainer, 602 is disposed on the bottom of the shoe, within the adjustable opening. Bottom segments B4 and B2' approach the stationary retainer from the top. The stationary retainer could be a cord-lock, and the bottom segments could enter the cord-lock from the back (as shown in FIG. 8E), the sides, or the top etc. (depending on the structure of the cord-lock). End anchors 103, 105 are under stationary retainer 602 and are not visible. Retainer 602 is preferably attached, sewn (or hooked etc.) to the shoe at 604, so that it is stationary.

Embodiment A has at least two (2) bottom segments and embodiment B has four (4) bottom segments. Segments may merge into each other, as shown in FIG. 6B where B1' and B3 merge and as shown in FIG. 5A where B3 and M4 merge.

FIG. 6C and FIG. 6D both show embodiment A3, where the two (2) segment loops are side by side. FIG. 6C has two (2) laces, and FIG. 6D, has one (1) lace. FIG. 6C shows each lace tightening a different area of the instep. The darkened lace 500 tightens the top area, and lace 100 tightens the bottom area. This is useful if the user has different tightening preferences, or an injury. Movable fastener cord-lock 128 in FIG. 6C provides continuous fine adjustment and engages with hook 518, in the fastened position. Beads 606, prevent the loops from being pulled through the hole in the cord-lock. The top and bottom of the instep can be adjusted individually by the movable fastener in this configuration.

FIG. 6E shows embodiment B, with two (2) movable fasteners having teeth 124*a*,124*b* and an adjustable interior anchor 312, created by the lace being wrapped around or encircling eyelet R1. The interior anchor 312 combined with end anchors 103,105, fix the maximum distance of the two (2) movable fasteners 120*a*,120*b* from the sides of the shoe, and fix the maximum width of the adjustable opening in the fastened position. This specification discloses adjustable interior anchors that are knots 326*a*,326*b*, or wrap around or encircle an eyelet 312. Other structures for interior anchors such as crimps, clasps, or sewing can also be used. End anchors 103,105 are under stationary retainer eyelet L1.

FIG. 6F shows embodiment B, having two (2) movable fastener cord-locks 127*a*,127*b* that wrap around fixed fastener knobs 330*a*,330*b*, and then attach to each other as shown in FIG. 5F. In FIG. 6F all the anchors are non-adjustable. End Anchor 106 at L1 is crimped above or below eyelet L1. End anchor 101 is sewn near eyelet L1, and interior anchor 107 is sewn near eyelet retainer R2. The movable fastener cord-locks 127*a*,127*b* perform continuous fine adjustment.

FIG. 6G shows embodiment B. It has two (2) moveable fasteners 120*a*,120*b*, and the bottom lace segments B3',B2' are horizontal. FIG. 6G has two (2) primary end anchors at L1, which anchors the ends on bottom segments B4,B2', and has a secondary interior retainer which anchors bottom segments B1,B3' with a wrap-around anchor at R2. The four (4) bottom anchored segments insure that the two (2) movable fasteners 120*a*,120*b* maintain their distance from the sides of the adjustable opening. The four (4) top segments T1,T2,T3,T4 are each anchored so that they don't change their distance from the sides of the shoe during use. Segment T1 is anchored by bottom segment B1 at retainer R2, segment T2 is anchored by bottom segment B2' at L1, segment T3 is anchored by bottom segment B3' at R2, and segment T4 is anchored by bottom segment B4 at L1. Two (2) retainers anchor the four (4) bottom segments B2',B4, B3',B1 to maintain the maximum distance of the two (2) movable fasteners from the sides of the adjustable opening, and also set the maximum width of the adjustable opening in the fastened position.

FIGS. 7A-7E shows the shoes of the present invention, embodiments A and B.

FIG. 7A shows embodiment A1, with an interior anchor comprised of knot 326*a* on segment B1' under retainer L1, and knot 326*c* on segment B2' above retainer L1.

FIG. 7B shows embodiment A2, with an interior knot anchor 326*a* on bottom segment B4 under retainer L2, and knot anchor 326*b* on bottom segment B2' under retainer R2. Bottom segment B4 merges with bottom segment B2'. Movable fastener cord lock 128 hooks onto hook 518 in the fastened position. FIG. 7B' shows a part of FIG. 7B, but having two (2) bottom segments B3 and B1' anchored by two (2) eyelet retainers, R1 and L1 respectively, and no interior anchor. FIG. 7C shows embodiment A3 with interior anchor 312 wrapped around eyelet R2.

Adjustable openings with one (1) movable fastener and only five (5) or six (6) eyelets per side, don't require interior anchors, however since FIGS. 7A,7B,7C have seven (7) eyelets (i.e., a long opening), interior anchors are preferred because they facilitate the alignment of the segments in the adjustable opening. FIG. 7C shows four (4) bottom segments B2,B4,B1',B3' anchored by two (2) retainers. Bottom segments B2 and B4 are anchored to retainer R2, and bottom segments B1' and B3' are anchored to retainer L1.

FIG. 7D shows embodiment B, having seven (7) eyelets per side, one (1) lace and an interior anchor 312, at eyelet retainer R2.

FIG. 7E shows embodiment B, having seven (7) eyelets per side, two (2) laces, and four (4) end anchors 103,105, 503,505, on four (4) bottom segments B1',B2',B3',B4'. Two (2) bottom segments are anchored to R1 and two (2) bottom segments are anchored at L1. The four (4) bottom anchored segments, anchor the four (4) top segments, so the movable fasteners maintain their maximum distance from the sides of the opening, and fix the maximum width of the adjustable opening in the fastened position.

FIG. 7F shows embodiment B, having one (1) lace, and seven (7) eyelets per side, and an interior wrap around anchor which wraps around eyelets R2 and R1. The two (2) ends of the lace are adjustably anchored under eyelets L2 and L1.

FIG. 7F' shows an alternative configuration for the interior anchor of FIG. 7F, in which the adjustable interior anchor includes knot 326*a* on bottom segment B2 under eyelet retainer R2 and knot 326*b* on bottom segment B3' under eyelet retainers R1.

FIGS. 8A-8C have 8 eyelets, and one (1) movable fastener and one (1) lace. FIG. 8A is embodiment A1, and has a continuous hook and loop fastener. FIG. 8B is embodiment A2, and has a movable fastener with teeth which engage with a ratchet receptacle (not shown), and an interior anchor comprised of a knot 326*a*, above L2 and another knot 326*a*, below L2. FIG. 8C is embodiment A3, and has a discrete movable fastener with slots which hook into an adjustable buckle (not shown). Both bottom segments, B4' and B2' in FIG. 8C approach eyelet anchor L1 from the above, and are adjustable, i.e., knotted under L1. If both ends and the interior anchor are adjustable, the lace is also replaceable. If only one end is adjustable (and the other end is sewn or crimped etc.). The lace is adjustable, but not easily replaceable. However, the user could replace the lace by removing the stitches or the crimp.

FIGS. 8D-8D' is embodiment B, having only one (1) lace. Where possible the lacing structure of FIG. 8D" is used, because it has less friction than the "weaved" lacing structure of FIG. 8D'". Referring to FIG. 8D, segments B3' and B4', lie totally above segments B1' and B2', and also segments M3 and M4 lie totally above segments M1 and M2. This configuration, as shown in FIG. 8D" reduces friction and therefore facilitates alignment of the adjustable opening. FIG. 8D' shows four (4) bottom segments anchored by two (2) retainers. Bottom segments B2' and B3" are anchored to retainer L1, and bottom segments B4' and B1" are anchored to retainer R1. FIG. 8D' shows FIG. 8D in the fastened position.

FIG. 8E and FIG. 8E" is embodiment B. Bottom segments B2" and B4" have tubes 810*a*, 810*b* attached to keep cord-lock 324 stationary in the middle of the adjustable opening. FIG. 8E' shows an alternate retainer 602, with the two (2) knotted end anchors 103, 105 under retainer 602. FIG. 8E" shows embodiment B fastened with two (2) ends anchored at L1, and two (2) adjustable interior knotted anchors 326*a*,326*b* on bottom segments B1" and B3" which merge into each other. Knots 326*a* and 326*b* are disposed below and near retainers L2 and R2.

FIG. 8F shows embodiment B with two (2) laces. The user squeezes the movable fasteners by compressing the springs in cord-locks 128*a*,128*b*, allowing the lace segments to move freely through the holes of the cord-locks and adjust the width of the opening. The user fastens the shoe by crossing the two (2) movable fasteners, and wrapping the segments around knobs or hooks 330*a*,330*b* as shown in FIG. 8F'. He then crosses the fasteners again and hooks cord-locks 128*a* and 128*b* around hooks 518*a*, 518*b*. The user can alternatively attach cord-locks 127*a*,127*b* to each other in the middle of the adjustable opening as shown in FIG. 5F. FIGS. 8F-8F' shows the fixed end of lace 100, non-adjustably anchored to eyelet L1 by stitches 101, and the fixed end of lace 500 non-adjustably anchored to eyelet R1 by stitches 501. Anchor 505 at eyelet L1 and anchor 105 at eyelet R1 are knots, and are adjustable. Bottom segments B1", B4' are anchored at retainer R1, and bottom segments B3",B2' are anchored at retainer L1. Four (4) bottom segments are anchored to two (2) retainers L1,R1 and fix the maximum width of the adjustable opening in the fastened position, and also maintain the maximum distance of each movable fastener cord-lock to its side of the adjustable opening.

FIG. 8F" shows a part of FIG. 8F', and shows an alternative anchoring configuration, where the four (4) bottom segments B1',B2',B3',B4' are anchored to four (4) retainers L1,L2,R1,R2. The four (4) bottom segments approach the retainers from above and are anchored under the retainers' hole by a knot, making the laces replaceable and adjustable. The replaceable laces in this configuration are suitable to be sold as an after market item, because no changes to the shoe are required. The after market package would include two (2) cord locks, two (2) laces, knobs 330*a*,330*b* and hooks 518*a*,518*b* that could be attached to the top eyelets, and instruction diagrams. The gross adjustment can be performed at the bottom anchors by moving the knots, and the fine adjustment by movable fastener cord locks.

The knot anchors in FIG. 8F" are purposely disposed under the eyelet retainers. For example, segments B1' goes UP retainer L2, then DOWN retainer L1, and is anchored under L1, by knot 505.

Anchored Parallel Lacing Technology

The technology of the present invention is "parallel" lacing, i.e., each of the four (4) lace segments (T1,T2,T3,T4) pull thru the eyelets in unison, straight to the bottom part of the shoe as shown in FIGS. 9B,9D. Prior art however, is "serial" lacing, as shown in FIGS. 9A,9C, in which two (2) lace ends 902*a*,902*b*, must pull thru all the six (6) eyelets on each side "serially", one after the other, until the pull reaches the bottom of the shoe. Therefore the pull at 902*a* and 902*b* has virtually no effect below line 906*a*, i.e., after two (2) turns. This is why, to get a snug and even fit when fastening prior art shoes, the user must pull at the laces "sequentially" (starting from the bottom and holding the tension of the previous pull), at every couple of eyelets, until he reaches the top of the opening, pulls the ends 902*a*,902*b* and ties the bow/knot.

The present invention combines end anchors and interior anchor(s) with parallel lacing technology for instant, easy, snug, and even fastening.

Comparing "serial' vs. "parallel" technology. FIGS. 9A,9B each have twelve (12) eyelets.

Prior art "serial" lacing in FIG. 9A shows the effect of a pull on lace ends 902*a*,902*b*. The friction from the two (2) turns of each lace, and the friction from the segments criss-crossing in the middle, prevent a large part of the adjustable opening from contracting (or expanding). Only four (4) of the twelve (12) eyelets are effected by the pull, since the pull has no effect below line 906*a*.

The present invention "Parallel" technology in FIG. 9B shows the effect of one pull on the movable fastener attached to segments T1,T2,T3,T4. A single pull causes all the eyelets attached to T1,T2,T3,T4 to instantly contract, since each segment turns only once at L1,L2,L3,L4, and there is no criss-crossing friction. Ten (10) of the twelve (12) eyelets contract or expand instantly (as opposed to only four (4) eyelets of the prior art).

Four (4) segments T1,T2,T3,T4, in which no segment turns more than twice, align instantly. Whereas one (1) segment, turning thru six (6) sequential eyelets, stops aligning after the second turn. Parallel lacing of the present invention is much more efficient than "serial" lacing of prior art.

FIG. 9C shows FIG. 9A prior art "serial" lacing totally laced. About three (3) pulls are required to contract the entire adjustable opening of prior art shoes. A pull at 906*b*, then another pull at 906*a*, and a third pull at the ends 902*a*,902*b*. There are a total of seventeen (17) points of friction, i.e., twelve (12) eyelets with turning friction and five (5) points of criss-crossing friction 904*a*,904*b*,904*c*,904*d*,904*e*.

FIG. 9D shows FIG. 9B totally laced and anchored at retainer R1. A single pull, effects all the eyelets instantly. The eyelet where bottom segment B1,B4 meet, is the only eyelet that has a second turn. The other eyelets in the adjustable opening have only one turn each. And there is no criss-crossing friction because segments B1,B2,B3 lie entirely above the segments underneath as shown in FIG. 1C.

FIG. 9E shows anchored parallel lacing technology of the present invention having two (2) movable fasteners, i.e., embodiment B, having six (6) eyelets on each side of the adjustable opening.

Additionally, the lacing of prior art shoes requires the user to accomplish both "gross" and "fine" adjustment each time the user laces his shoes. Fastening the shoes of the present invention however, requires only "fine" adjustment each time the user fastens his shoes, resulting in further reducing the friction at each eyelet.

FIG. 9D, shows segments T1,T2,T3,T4 acting in unison to tighten (or loosen) the entire adjustable opening. FIG. 9D of the present invention, shows that the pull from segments T2 and T3 turn only once prior to anchoring at R1. The pull from segments T1 and T4 turns twice prior to being pulled back again in the other direction at eyelet R2. No segment in the adjustable opening of FIG. 9D, turns more than twice, which is why anchored parallel lacing technology provides instant alignment of the entire adjustable opening.

Additionally, the two (2) anchored ends in FIG. 9D, approach eyelet R1, from the top, so that there is substantially no friction when segments B1,B2,B3 cross over segments M2,M3,M4 as shown in FIG. 1C. The end anchors further reduce friction (since there is no movement at R1), and facilitate alignment of the adjustable opening. Also, since the "gross" adjustment (for a medium, wide, or narrow foot) was set or fixed when purchased, the adjustable opening only requires minimal or "fine" adjustment each time the user fastens his shoe. No segment in FIG. 9D turns more than twice, and the adjustable opening expands and contracts instantly.

FIG. 9E shows embodiment B with one (1) lace, two (2) end anchors at R1, and an interior wrap around anchor 312 at L1. Segment T1 turns twice before anchoring at L1. Segment T2 turns once before anchoring at R1. Segment T3 turns twice before anchoring at R1. Segment T4 turns once before anchoring at L1. No segment in FIG. 9E turns more than twice, and the entire adjustable opening expands and contracts instantly.

Dually Adjustable Features and Benefits

The present invention has several dually adjustable features.

1) The opening is dually adjustable:

(a) The present invention has "gross" adjustment by moving the adjustable anchors at the bottom of the opening (to customize the width for the users foot), and (b) "fine" adjustment by the movable fastener, limited to the predetermined interval (wide, medium, narrow) fixed or set by "gross" adjustment.

2) The present invention has dual "fine" adjustment:

(a) The present invention has "fine" adjustment at the top by the movable fasteners, and (b) also has dynamic "fine" adjustment at the bottom by a cord-lock, as shown in FIG. 3C.

3) The knee high boot is "dually" adjustable:

(a) The present invention has an adjustable opening around the instep (or foot), and (b) another adjustable opening around the calf, as shown in FIGS. 29A-29B.

4) The present invention can be made loose in one area and tight in another area:

(a) The top of the instep can be adjusted to be tight, while (b) the bottom of the instep is loose, and visa-versa. This is useful when there is swelling or bandages due to injury, as shown in FIG. 6C.

Step by Step Diagrams for Installation of Lacing for the Currently Preferred Embodiments The lacing "down into" and "up out-of" the eyelets, and the laces "crossing over" or "crossing under" other segments in the opening is very precise. Therefore a method was devised to simplify the lacing and to help indicate that the lacing is correct.

When lacing conventional prior art shoes, the user threads the two (2) lace ends concurrently, alternating or not alternating, crossing over or under other lace segments, threading up or down the eyelets etc., in any manner he/she pleases. Threading two (2) laces concurrently makes following instructions for "precise" lacing difficult and error prone. The lacing method of the present invention, immediately anchors one end of the lace 102, called the fixed end, so the user is concerned with threading only the other end of the lace 104, called the free end. First, he chooses the appropriate lacing diagram (depending on the embodiment and number of eyelets in the opening). Then he laces the shoe using only the free end, following the steps in the diagram in this specification, exactly as shown and/or claimed. This method simplifies the lacing (since the user needs to be concerned with threading only one lace end). Additionally, the present disclosure teaches a method that helps indicate that the lacing was done correctly.

FIGS. 10A-24B shows the step by step method to lace shoes according to the present invention in two (2) or three (3) stages, FIGS. 10A-10B show the step by step method of lacing the shoe of FIG. 5A in two (2) stages. FIG. 10A shows the steps in stage 1 and starts at arrow S1. FIG. 10B continues with the steps in stage 2 and starts at arrow S2.

Each stage S1,S2 or S3 starts at a dark arrow indicating the starting direction for that stage. Each stage includes several steps. The threading for the shoes in the other diagrams FIGS. 11A-24B, are followed in the same manner.

The arrows within the lace segments show the direction of the threading. The darkened eyelets and areas, show the position of the end anchors and the interior anchors.

The two (2) stage method for lacing the adjustable opening of FIG. 5A are shown in detail in FIGS. 10A-10B, representing stage 1 (S1), and stage 2 (S2).

Stage 1: Start at S1 in FIG. 10A. Place the movable fastener on the right of the shoe, with the engagable side facing you, and the eyelets of the movable fastener about two (2) to three (3) inches from the side of the adjustable opening. This will probably change, after the shoe is laced, and the user customizes the shoe for his foot. Anchor one end of the lace, referred to as the fixed end, under eyelet R1, by making a knot 103. Use the other end, referred to as the free end of the lace, to thread the entire shoe, by following the arrows in the steps of stage 1 and stage 2. Continue in the direction of the darkened arrow by crossing the opening, and threading down eyelet L3, creating segment L3-R1. Then cross the opening threading up eyelet R5 and creating segment L3-R5. Thread up eyelet H2, creating segment R5-H2. Thread down eyelet R3, creating segment H2-R3. Cross under segment L3-R1 and thread up eyelet L1 creating segment R3-L1.

Stage 2: Continue at S2 in FIG. 10B in the direction of the darkened arrow. Cross the opening under segment L3-R1, threading up eyelet R2 and creating segment L1-R2. Thread down eyelet H1 creating segment R2-H1. Cross under segment R3-H2 and thread down eyelet R4, creating segment H1-R4. Cross under segment L3-R1, threading up eyelet L2, creating segment L2-R4. Cross over segment L1-R3 and cross over segment L1-R2, threading down eyelet R1.

If segments L3-R1 and L2-R1 lie entirely above the segments underneath, it is an indication that the lacing is correct.

To customize the lacing for different width feet (i.e., gross adjustment):

1) Put the shoe on your foot;

2) Pull (wiggle or shift), the movable fastener back and forth until all the lace segments are equally taut and the movable fastener is engagable with the fixed fastener;

3) Make a knot in the free end of the lace under eyelet R1;

4) Cut the excess lace or tuck it into the shoe.

FIGS. 10A-24B, show the detailed lacing methods in previously discussed embodiments.

FIGS. 10A-10B show the sequential lacing method for the shoe of FIG. 5A in two (2) stages.

FIGS. 11A-11B show the sequential lacing method for the shoe of FIG. 5B in two (2) stages.

FIGS. 12A-12B show the sequential lacing method for the shoe of FIG. 5D in two (2) stages.

FIGS. 13A,13A' shows the sequential lacing method for the shoe of FIG. 6A. One end, the fixed end, is immediately anchored by knot 103 under eyelet retainer R1 as shown in FIG. 1A. The other end, the free end 104, is used to lace the entire shoe. FIGS. 13A,13A' shows the precise lacing of stage one in a diagram and on the shoe. FIGS. 13B,13B' shows the second stage of the lacing method in a precise diagram and on the shoe. FIGS. 13C,13C' shows the final, third stage, of the lacing of the shoe of FIG. 6A. Knot 105 anchors the second, free end of the lace, under eyelet retainer R1. The remainder of the lace is either cut past knot 105, or tucked into the shoe. A drawing of this shoe in the fastened position is shown is FIG. 1E.

FIGS. 14A-14C show the sequential lacing method for the shoe of FIG. 6D in three (3) stages.

FIGS. 15A-15C show the sequential lacing method for the shoe of FIG. 6E in three (3) stages.

FIGS. 16A-16C show the sequential lacing method for the shoe of FIG. 6G in three (3) stages.

FIGS. 17A-17C show the sequential lacing method for the shoe of FIG. 7A in three (3) stages.

FIGS. 18A-18C show the sequential lacing method for the shoe of FIG. 7B in three (3) stages.

FIGS. 19A-19C show the sequential lacing method for the shoe of FIG. 7D in three (3) stages.

FIGS. 20A-20B show the sequential lacing method for the shoe of FIG. 7E in two (2) stages.

FIGS. 21A-21C show the sequential lacing method for the shoe of FIG. 8A in three (3) stages.

FIGS. 22A-22C show the sequential lacing method for the shoe of FIG. 8D in three (3) stages.

FIGS. 23A-23C show the sequential lacing method for the shoe of FIG. 8E in three (3) stages.

FIGS. 24A-24B show the sequential lacing method for the shoe of FIG. 8F in two (2) stages.

FIGS. 25A1 thru 25B' show some examples of lacing patterns for embodiments A and B for an adjustable opening having five (5) eyelets per side, end anchors and one (1) or two (2) laces.

FIGS. 26A1 thru 26B''' show some examples of lacing patterns for embodiments A and B for an adjustable opening having six (6) eyelets per side, end anchors, interior anchors, a dynamically adjustable anchor, and one (1) or two (2) laces.

FIGS. 27A1 thru 27B''' show some examples of lacing patterns of embodiments A and B having seven (7) eyelets and one (1) or two (2) laces. The darkened bars on the bottom eyelets represent the position of an interior wrap around anchor, if desired. FIG. 27A2" shows a retainer on the bottom horizontal segment.

FIGS. 28A1 thru 28B" show some examples of lacing patterns of embodiments A and B having eight (8) eyelets per side, and one (1) or two (2) laces. The darkened bars on the bottom eyelets represent the position of the interior anchors, if desired. FIGS. 28B',28B" show cord-locks on the bottom horizontal segments.

FIG. 29A shows the present invention on a knee high boot. The boot has two (2) adjustable openings. An adjustable opening over the instep, and an adjustable opening around the calf (from the ankle to the knee). The lacing of embodiment A, as shown in FIG. 1F, is over the instep. The lacing of embodiment B, (refer to FIG. 3B or FIG. 6E) is in front of the calf. A similar prior art shoe with twelve (12) eyelets per side has over 20 points of friction. A pull on the movable fastener(s) of the present invention, has at most, two (2) points of friction (i.e., no lace turns more than twice before being anchored), Using the present invention this boot can be easily, evenly, reliably, and snugly fastened and unfastened in seconds. FIG. 29B is the boot of 29A in the fastened position.

FIG. 30A shows the lacing system of the present invention on an arm brace. FIG. 30B shows the lacing system of the present on a pair of pants. FIG. 30C shows the lacing system of the present invention on a corset.

The present invention preferably uses laces that are fast and easy to align or adjust, and therefore the preferred lace minimizes friction. To minimize friction, the lace is preferably round and has a core which minimizes flattening during use. A flattened lace would increase friction. The currently preferred lace is relatively smooth and flexible, so that it turns easily and quickly through the eyelets, and holds a knot well. The preferred lace is also strong and durable, and can be made of synthetic and/or natural fibers. Therefore laces of the present invention are preferably smooth, flexible, round, with a core that minimizes flattening or distortion during use, and are strong and durable. The eyelets that are holes preferably have grommets, to further enable the lace segments to easily glide through the holes.

CONCLUSIONS, RAMIFICATIONS, AND SCOPE

Thus while there have been shown, described, and pointed out, fundamental novel features of the invention as applied to the preferred embodiments thereof, it will be understood that various omissions, substitutions, and changes in the form and details of the devices illustrated, and in their operation, may be made by those skilled in the art without departing from the spirit and scope of the invention. For example it is expressly intended that all combinations of those elements and/or steps which perform substantially the same function, in substantially the same way, to achieve the same results are within the scope of this invention. Substitution of elements from one described embodiment to another are also fully intended and contemplated. It is further fully intended that the method used to install and anchor the lace(s) and customize the article of manufacture, will be easily followed by those skilled in the art for the other lacing patterns by following the step by step diagrams, given the knowledge of the free lace method for installation, anchoring, customization, and the method for indicating that the lacing is correct. It is also to be understood that the drawings are not necessarily drawn to scale, but that they are merely conceptual in nature. It is the intention, therefore, to be limited only as indicated by the scope of the claims, appended hereto.

What is claimed is:

1. A lacing system used in combination with an article of apparel, wherein said article of apparel comprises:

(a) an adjustable opening defined by a first side, a second side, a top, and a bottom, wherein said adjustable opening defines a width extending from said first side to said second side; and wherein said adjustable opening has a fastened position and an unfastened position;

(b) a vertical axis defined by said top and said bottom; wherein the relative positions; above, below, top-most and bottom-most relate to said vertical axis;

(c) at least five eyelets on said first side, wherein the first eyelet is the top-most eyelet on said first side; and at least five eyelets on said second side, wherein the first eyelet is the top-most eyelet on said second side;

(d) an anchor area at said bottom of said adjustable opening, wherein said anchor area is formed by the two bottom-most eyelets on said first side, the two bottom-most eyelets on said second side, and said bottom;

(e) at least one lace having a first end and a second end; whereby at least one of said first end and said second end is used for lacing said adjustable opening;

(f) said at least one lace forming four lace segments, wherein said four lace segments form a first set of two lace segments and a second set of two lace segments;

(g) a first movable fastener movably attached to said first set of two lace segments; and a second movable fastener movably attached to said second set of two lace segments;

(h) and wherein said first set of said two lace segments contains a first lace segment and a second lace segment; and wherein said first lace segment comprises a first top segment, a first middle segment, and a first bottom segment; and said second lace segment comprises a second top segment, a second middle segment, and a second bottom segment; and wherein said second set of two lace segments contains a third lace segment and a fourth lace segment; and wherein said third lace segment comprises a third top segment, a third middle segment, and a third bottom segment; and wherein said fourth lace segment comprises a fourth top segment, a fourth middle segment, and a fourth bottom segment;

(i) wherein said first top segment and said second top segment extend from said first movable fastener to said first eyelet and the second eyelet on said first side respectively; and wherein said first middle segment and said second middle segment extend from said first eyelet and said second eyelet on said first side, to the third eyelet and the fourth eyelet on said second side respectively; and wherein said first bottom segment extends from said third eyelet on said second side to the fifth eyelet on said first side;

(j) wherein said third top segment and said fourth top segment extend from said second movable fastener to said first eyelet and the second eyelet on said second side respectively; and wherein said third middle segment and said fourth middle segment extend from said first eyelet and said second eyelet on said second side, to the third eyelet and the fourth eyelet on said first side respectively; and wherein said third bottom segment extends from said third eyelet on said first side to the fifth eyelet on said second side;

(k) a gap at said top of said adjustable opening in said unfastened position, wherein said gap is formed by said first middle segment, said third middle segment, and said top; and whereby said gap increases the width of said adjustable opening at said top to facilitate the insertion and removal of a body part from said article of apparel; and whereby said first top segment and said third top segment cover said gap, in said fastened position;

(l) at least one retainer in said anchor area, wherein said four lace segments are anchored to said at least one retainer, thereby fixing the maximum distance of said first movable fastener to said first side, and fixing the maximum distance of said second movable fastener to said second side, and thereby fixing the maximum width of said adjustable opening in said fastened position;

(m) and whereby pulling on said first movable fastener and pulling on said second movable fastener causes contraction of said adjustable opening; and (n) wherein said first movable fastener and said second movable fastener are engagable to maintain said contraction of said adjustable opening in said fastened position.

2. A lacing system according to claim 1, wherein at least two of said four anchored segments are adjustable, thereby changing said maximum width of said adjustable opening in said fastened position, and thereby customizing the width of said article of apparel.

3. A lacing system according to claim 2, wherein said at least one adjustable anchored segment is anchored by one of an encircled eyelet, an adjustable stopper, and a cord-lock.

4. A lacing system according to claim 1, wherein one of said four anchored segments is on said first end and another one of said four anchored segments is on said second end, and wherein at least one of said first end and said second end is adjustable.

5. A lacing system according to claim 4, wherein said at least one adjustable anchored end is anchored to said at least one retainer by an adjustable stopper, wherein said adjustable stopper is not visible.

6. A lacing system according to claim 4, wherein said first anchored end and said second anchored end are individually anchored.

7. A lacing system according to claim 1, wherein at least one retainer is stationary.

8. A lacing system according to claim 1, wherein at least one of said first movable fastener and said second movable fastener is continuously adjustable.

9. A lacing system according to claim 1, wherein at least one of said first movable fastener and said second movable fastener is discretely adjustable.

10. A lacing system according to claim 1, further including a first fixed fastener and a second fixed fastener; wherein said first fixed fastener is located at said top of said first side, and said second fixed fastener is located at said top of said second side; and wherein said first movable fastener engages with one of said first fixed fastener and said second fixed fastener; and said second moveable fastener engages with the other one of said first fixed fastener and said second fixed fastener, in said fastened position.

11. A lacing system according to claim 1, further including at least one first hook and at least one second hook; wherein said at least one first hook is located above said first eyelet on said first side and said at least one second hook is located above said first eyelet on said second side.

12. A lacing system according to claim 1, wherein said first movable fastener engages with said second movable fastener in said fastened position.

* * * * *